US012239888B2

(12) United States Patent
Greaney et al.

(10) Patent No.: US 12,239,888 B2
(45) Date of Patent: Mar. 4, 2025

(54) GOLF CLUB

(71) Applicant: Taylor Made Golf Company, Inc., Carlsbad, CA (US)

(72) Inventors: Mark Vincent Greaney, Vista, CA (US); Andrew Kickertz, San Diego, CA (US); Todd P. Beach, Encinitas, CA (US); Craig Richard Slyfield, San Diego, CA (US); Christopher John Harbert, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 18/136,180

(22) Filed: Apr. 18, 2023

(65) Prior Publication Data

US 2023/0356038 A1 Nov. 9, 2023

Related U.S. Application Data

(63) Continuation of application No. 17/547,519, filed on Dec. 10, 2021, now Pat. No. 11,701,555, which is a continuation of application No. 17/006,561, filed on Aug. 28, 2020, now Pat. No. 11,219,803.

(60) Provisional application No. 62/894,523, filed on Aug. 30, 2019.

(51) Int. Cl.
*A63B 53/04* (2015.01)

(52) U.S. Cl.
CPC ..... *A63B 53/0441* (2020.08); *A63B 53/0412* (2020.08); *A63B 53/0437* (2020.08); *A63B 53/0445* (2020.08); *A63B 53/0466* (2013.01)

(58) Field of Classification Search
CPC ..... A63B 53/0408; A63B 53/0441; A63B 69/3632
See application file for complete search history.

(56) References Cited

U.S. PATENT DOCUMENTS

| | | | | | |
|---|---|---|---|---|---|
| 1,291,967 | A | | 1/1919 | McDougal | |
| 1,402,537 | A | | 1/1922 | Reach | |
| 1,660,126 | A | * | 2/1928 | Heeter | A63B 53/0466 D21/733 |
| D89,332 | S | * | 2/1933 | Bartsch | D21/733 |
| 2,908,504 | A | * | 10/1959 | Pratt | A63B 69/3623 434/252 |
| 2,934,347 | A | * | 4/1960 | Siniscalchi | A63B 69/3632 473/242 |
| 2,954,231 | A | | 9/1960 | Macintyre | |
| 3,753,564 | A | * | 8/1973 | Brandell | A63B 69/3614 473/220 |

(Continued)

OTHER PUBLICATIONS

AdamsGolf, "DiXX Blu Putter," retrieved from https://web.archive.org/web/20080913151800/http://www.adamsgolf.com/products/shortgame/dixx.php, document dated Sep. 13, 2008, 1 page.

*Primary Examiner* — Alvin A Hunter
(74) *Attorney, Agent, or Firm* — Klarquist Sparkman, LLP

(57) ABSTRACT

Aspects of the invention are directed to golf club having a crown, a sole, a face, and a primary alignment feature hard tooled into the golf club head. In some embodiments the golf club has a primary alignment feature comprising a line delineating a transition between at least a portion of the crown having an area of contrasting shade or color with a shade or color of the face. The primary alignment feature is hard tooled into the golf club head with the face of the golf club body.

40 Claims, 43 Drawing Sheets

(56) References Cited

U.S. PATENT DOCUMENTS

D231,624 S 5/1974 Wilmoth
D237,289 S 10/1975 Calton
4,157,830 A * 6/1979 Taylor ..... A63B 69/3632 473/314
5,131,660 A 7/1992 Marocco
5,213,328 A 5/1993 Long et al.
5,433,446 A * 7/1995 Lindstedt, Jr. ..... A63B 69/3632 473/242
5,489,094 A 2/1996 Pritchett
5,776,011 A * 7/1998 Su ..... A63B 53/0466 473/345
5,788,584 A 8/1998 Parente et al.
5,935,020 A 8/1999 Stites et al.
6,126,556 A * 10/2000 Hsieh ..... A63B 53/047 473/340
6,196,932 B1 3/2001 Marsh et al.
6,248,024 B1 * 6/2001 Nelson ..... A63B 53/04 473/347
6,425,832 B2 * 7/2002 Cackett ..... A63B 53/02 473/348
6,475,099 B1 * 11/2002 Sumitomo ..... A63B 53/0466 473/331
6,669,580 B1 * 12/2003 Cackett ..... B29C 70/865 473/348
6,729,967 B2 5/2004 Ford
6,773,360 B2 8/2004 Willett et al.
D496,084 S 9/2004 Imamoto
6,800,038 B2 10/2004 Willett et al.
6,824,475 B2 11/2004 Burnett et al.
D505,701 S 5/2005 Dogan
6,926,872 B2 8/2005 Jakobi et al.
6,929,565 B2 8/2005 Nakahara
6,969,326 B2 11/2005 De Shiell et al.
6,997,820 B2 2/2006 Willett et al.
7,022,030 B2 4/2006 Best
D529,564 S 10/2006 Grace
7,166,038 B2 1/2007 Williams et al.
7,166,040 B2 1/2007 Hoffman et al.
7,186,190 B1 3/2007 Beach et al.
7,223,180 B2 5/2007 Willett et al.
7,235,021 B2 6/2007 Solheim
7,267,620 B2 * 9/2007 Chao ..... A63B 53/0466 473/348
7,303,487 B2 12/2007 Kumamoto
7,344,451 B2 3/2008 Tang
7,377,858 B2 5/2008 Kubota
7,396,289 B2 7/2008 Soracco
7,407,447 B2 8/2008 Beach et al.
7,410,425 B2 8/2008 Willett et al.
7,410,426 B2 8/2008 Willett et al.
7,419,441 B2 9/2008 Hoffman et al.
7,422,531 B2 9/2008 Tarng et al.
7,448,963 B2 11/2008 Beach et al.
7,452,285 B2 11/2008 Chao et al.
7,481,715 B2 * 1/2009 Byrne ..... A63B 69/3617 473/238
7,510,481 B2 3/2009 Sevon
7,530,904 B2 5/2009 Beach et al.
7,540,811 B2 6/2009 Beach et al.
7,568,985 B2 8/2009 Beach et al.
7,578,753 B2 8/2009 Beach et al.
7,591,738 B2 9/2009 Beach et al.
7,621,823 B2 11/2009 Beach et al.
7,628,707 B2 12/2009 Beach et al.
7,632,194 B2 12/2009 Beach et al.
7,713,142 B2 5/2010 Hoffman et al.
7,717,804 B2 5/2010 Beach et al.
7,717,805 B2 5/2010 Beach et al.
7,744,484 B1 6/2010 Chao
7,775,905 B2 8/2010 Beach et al.
7,828,669 B1 * 11/2010 Stites ..... A63B 53/047 473/238
7,846,041 B2 12/2010 Beach et al.
7,963,861 B2 6/2011 Beach et al.
7,993,216 B2 8/2011 Lee
8,025,587 B2 9/2011 Beach et al.
8,025,589 B2 9/2011 Brinton
8,083,612 B2 12/2011 Stites et al.
8,096,896 B2 * 1/2012 De Schiell ..... A63B 53/0466 473/347
8,210,960 B1 7/2012 Davenport
8,235,831 B2 8/2012 Beach et al.
8,257,191 B2 9/2012 Stites et al.
8,303,431 B2 11/2012 Beach et al.
8,337,319 B2 12/2012 Sargent et al.
8,348,780 B2 1/2013 Stites
8,353,786 B2 1/2013 Beach et al.
8,414,410 B1 * 4/2013 Flaherty ..... A63B 53/0466 473/238
8,444,505 B2 5/2013 Beach et al.
8,449,402 B2 5/2013 Jaekel et al.
8,496,544 B2 * 7/2013 Curtis ..... A63B 60/00 473/345
8,556,742 B2 * 10/2013 John ..... A63B 53/047 473/238
8,628,433 B2 * 1/2014 Stites ..... A63B 60/00 473/328
8,636,609 B2 1/2014 Chao et al.
8,690,700 B2 * 4/2014 Flaherty ..... A63B 53/0466 473/238
8,721,471 B2 5/2014 Albertsen et al.
8,727,909 B2 5/2014 Guerrette et al.
8,771,095 B2 7/2014 Beach et al.
8,821,312 B2 9/2014 Burnett et al.
8,827,831 B2 9/2014 Burnett et al.
9,011,267 B2 4/2015 Burnett et al.
9,056,230 B2 * 6/2015 Golden ..... A63B 60/02
9,089,749 B2 7/2015 Burnett et al.
9,168,428 B2 10/2015 Albertsen et al.
9,168,434 B2 10/2015 Burnett et al.
9,174,101 B2 11/2015 Burnett et al.
9,333,400 B2 5/2016 Girard et al.
D767,694 S 9/2016 Nielson
9,604,136 B1 3/2017 Ricky
9,662,548 B2 5/2017 Guerrette et al.
9,750,991 B2 9/2017 Chao et al.
9,849,352 B2 * 12/2017 Sander ..... A63B 53/0466
9,962,582 B2 * 5/2018 Antku ..... A63B 53/0466
10,052,530 B2 * 8/2018 Greaney ..... A63B 60/00
10,065,084 B2 * 9/2018 Myrhum ..... A63B 60/52
10,065,090 B2 9/2018 Guerrette et al.
10,099,102 B1 10/2018 Koo
10,155,145 B2 12/2018 Girard et al.
10,195,497 B1 2/2019 Greaney et al.
10,207,160 B2 2/2019 Johnson et al.
10,207,171 B2 2/2019 Davenport
10,293,219 B2 * 5/2019 Hayashi ..... A63B 53/0466
10,300,351 B2 5/2019 Greaney et al.
D857,816 S * 8/2019 Bazzel ..... D21/733
10,391,369 B2 * 8/2019 Greaney ..... A63B 53/0466
10,398,949 B2 * 9/2019 Hayashi ..... A63B 53/0466
10,413,784 B2 9/2019 Beach et al.
10,463,927 B2 11/2019 Bovee et al.
10,500,448 B2 * 12/2019 Sander ..... A63B 53/0466
10,561,922 B2 2/2020 Sanchez et al.
10,576,335 B2 3/2020 Greaney et al.
10,632,350 B2 4/2020 Beach et al.
10,751,585 B2 8/2020 Johnson et al.
10,799,778 B2 10/2020 Guerrette et al.
10,843,053 B2 11/2020 Carter
10,874,922 B2 12/2020 Harbert et al.
10,888,746 B1 1/2021 Greaney et al.
11,045,696 B2 6/2021 Burnett et al.
11,179,608 B2 * 11/2021 Greaney ..... A63B 60/00
11,219,803 B2 1/2022 Greaney et al.
11,318,358 B1 * 5/2022 Story ..... A63B 53/0458
11,666,806 B2 * 6/2023 Story ..... A63B 53/0429 473/345
11,701,557 B2 * 7/2023 Greensmith ..... A63B 53/0412 473/345
11,731,014 B2 * 8/2023 Greaney ..... A63B 53/0433 473/219

(56) References Cited

U.S. PATENT DOCUMENTS

2003/0130059 A1 7/2003 Billings
2003/0203762 A1 10/2003 Ross
2004/0162156 A1* 8/2004 Kohno ..... A63B 53/0466 473/314
2005/0187028 A1 8/2005 Chang et al.
2005/0209021 A1 9/2005 Hoffman et al.
2007/0004524 A1 1/2007 Harrison
2007/0026958 A1 2/2007 Barasch et al.
2007/0232409 A1 10/2007 Byrne
2008/0009344 A1 1/2008 Graham et al.
2008/0015045 A1* 1/2008 Payne ..... A63B 53/0487 473/252
2008/0096688 A1* 4/2008 Yokota ..... A63B 60/02 473/345
2009/0314398 A1 12/2009 Shaar
2010/0066677 A1 3/2010 Garrett et al.
2010/0093458 A1 4/2010 Davenport et al.
2010/0130298 A1 5/2010 Dugan et al.
2010/0173720 A1 7/2010 Kim
2010/0248852 A1 9/2010 Lee
2011/0081982 A1* 4/2011 John ..... A63B 53/0466 473/257
2011/0152000 A1 6/2011 Sargent et al.
2011/0159986 A1 6/2011 Chao et al.
2011/0312437 A1 12/2011 Sargent et al.
2012/0071264 A1 3/2012 Beach et al.
2012/0122601 A1 5/2012 Beach et al.
2012/0258818 A1 10/2012 Beach et al.
2013/0123040 A1* 5/2013 Willett ..... F15D 1/10 473/327
2013/0172103 A1* 7/2013 Greensmith ..... A63B 60/00 473/345
2014/0057738 A1 2/2014 Albertsen et al.
2014/0127659 A1 5/2014 Barasch et al.
2014/0179460 A1 6/2014 Beach et al.
2014/0206469 A1 7/2014 Girard et al.
2014/0213390 A1 7/2014 Guerrette et al.
2014/0228153 A1 8/2014 Albertsen et al.
2014/0260637 A1 9/2014 Molinari
2014/0274446 A1 9/2014 Greaney et al.
2014/0342848 A1 11/2014 Burnett et al.
2014/0371002 A1 12/2014 Burnett et al.
2014/0373630 A1 12/2014 Taniguchi
2015/0182822 A1 7/2015 Burnett et al.
2015/0231455 A1 8/2015 Burnett et al.
2016/0016054 A1 1/2016 Burnett et al.
2016/0236046 A1 8/2016 Girard et al.
2016/0299570 A1 10/2016 Davydov
2016/0317896 A1 11/2016 Albelo
2017/0232313 A1 8/2017 Guerrette et al.
2018/0185719 A1 7/2018 Johnson et al.
2018/0345099 A1 12/2018 Harbert et al.
2019/0009145 A1 1/2019 Guerrette et al.
2019/0111326 A1 4/2019 Girard et al.
2019/0184246 A1 6/2019 Harbert et al.
2019/0336834 A1 7/2019 Greaney et al.
2019/0232120 A1 8/2019 Johnson et al.
2019/0232121 A1 8/2019 Greaney et al.
2021/0001189 A1 1/2021 Johnson et al.
2021/0146203 A1 2/2021 Greaney et al.
2021/0060392 A1 3/2021 Greaney et al.
2021/0069559 A1 3/2021 Albertsen et al.
2021/0113896 A1 4/2021 Greensmith et al.
2021/0138323 A1 5/2021 Harbert et al.
2021/0170248 A1 6/2021 Girard et al.
2021/0213334 A1 7/2021 Honea et al.
2022/0176211 A1 6/2022 Greaney et al.
2022/0212067 A1 7/2022 Greaney et al.

* cited by examiner

GOLF CLUB

CROSS-REFERENCE TO RELATED APPLICATIONS

This application is a continuation of U.S. patent application Ser. No. 17/547,519, filed Dec. 10, 2021, now U.S. Pat. No. 11,701,555, which is a continuation of U.S. patent application Ser. No. 17/006,561, filed Aug. 28, 2020, now U.S. Pat. No. 11,219,803, which claims the benefit of U.S. Provisional Application No. 62/894,523, filed Aug. 30, 2019, all of which are incorporated by reference herein in their entirety.

BACKGROUND

When a golf club head strikes a golf ball, a force is seen on the club head at the point of impact. If the point of impact is aligned with the center face of the golf club head in an area of the club face typically called the sweet spot, then the force has minimal twisting or tumbling effect on the golf club. However, if the point of impact is not aligned with the center face, outside the sweet spot for example, then the force can cause the golf club head to twist around the center face. This twisting of the golf club head causes the golf ball to acquire spin. For example, if a typical right handed golfer hits the ball near the toe of the club this can cause the club to rotate clockwise when viewed from the top down. This in turn causes the golf ball to rotate counter-clockwise which will ultimately result in the golf ball curving to the left. This phenomenon is what is commonly referred to as "gear effect."

Bulge and roll are golf club face properties that are generally used to compensate for this gear effect. The term "bulge" on a golf club typically refers to the rounded properties of the golf club face from the heel to the toe of the club face.

The term "roll" on a golf club typically refers to the rounded properties of the golf club face from the crown to the sole of the club face. When the club face hits the ball, the ball acquires some degree of backspin. Typically this spin varies more for shots hit below the center line of the club face than for shots hit above the center line of the club face.

Golf club alignment features, such as golf club head toplines, are currently painted in an imprecise manner. To paint an alignment feature on a golf club head, workers manufacturing the golf club head typically apply masking stickers that provide for a guide in painting the alignment feature. However, masking stickers and other guides are not easily affixed or aligned on the golf club head consistently. Because the location of the masking stickers ultimately determines the alignment feature shape and angle, the current manufacturing methods lead to variability between golf club heads manufactured to the same specifications, and consequently, variability in the performance of the product.

FIELD

This disclosure relates to golf clubs. More specifically, this disclosure relates to golf club alignment.

SUMMARY

Aspects of the invention are directed to golf club heads including a body having a face, a crown and a sole together defining an interior cavity, the golf club body including a heel and a toe portion and having x, y and z axes which are orthogonal to each other having their origin at USGA center face and wherein the golf club head has a primary alignment feature comprising a paint or masking line which delineates the transition between at least a first portion of the crown having an area of contrasting shade or color with the shade or color of the face.

In some embodiments the golf club head includes a body having a face, a sole and a crown, the crown having a first portion having a first color or shade and a second portion having a second color or shade, the face crown and sole together defining an interior cavity, the golf club body including a heel and a toe portion and having x, y and z axes which are orthogonal to each other having their origin at USGA center face and wherein the golf club head has a primary alignment feature comprising a paint or masking line which delineates the transition between at least a first portion of the crown having an area of contrasting shade or color and the area of shade or color of the face, and the club head also includes a secondary alignment feature including a paint or masking line which delineates the transition between the first portion of the crown having an area of contrasting shade or color with the shade or color of the face; and a second portion of the crown having an area of contrasting shade or color with the shade or color of the first portion, the secondary alignment feature comprising a first elongate side having a length of from about 0.5 inches to about 1.7 inches, and a second and third elongate side extending back from the face and rearward from and at an angle to the first elongate side.

In some embodiments the golf club heads have a body having a face, a crown and a sole together defining an interior cavity, the golf club body also includes a heel and a toe portion and a portion of the crown comprises an electronic display, wherein the electronic display includes an organic light-emitting diode (OLED) display for providing active color and wherein the OLED display is divided into independently operating electronic display zones.

In some embodiments the golf club heads have a body having a face, a crown and a sole together defining an interior cavity, the golf club body also includes a heel and a toe portion and a portion of the crown or a layer covering at least a portion of the crown of the golf club head is covered by a dielectric coating system.

In some embodiments, a golf club head is provided with a golf club body. The golf club body has a face, a crown and a sole, together defining an interior cavity. The golf club body also includes a heel and a toe portion, and has an x, y and z axes which are orthogonal to each other having their origin at USGA center face. At least one of the sole, crown, or face may be at least in part a composite material. The golf club head further has a primary alignment feature comprising a paint or masking line which delineates a transition between at least a first portion of the crown having an area of contrasting shade or color with a shade or color of the face and a $CG_x$ of 0 to about −4 mm. The primary alignment feature has a Sight Adjusted Perceived Face Angle (SAPFA) of from about −2 to about 10 degrees, a Sight Adjusted Perceived Face Angle 25 mm Heelward (SAPFA25H) of from about −5 to about 2 degrees, a Sight Adjusted Perceived Face Angle 25 mm Toeward (SAPFA25T) of from 0 to about 9 degrees, a Sight Adjusted Perceived Face Angle 50 mm Toeward (SAPFA50T) of from about 2 to about 9 degrees, and a Radius of Curvature (circle fit) of from about 300 to about 1000 mm.

In some embodiments, score lines are provided in a location on the face corresponding to center of gravity at the negative location with respect to the x-axis.

In some embodiments, a toe side roll contour is more lofted than the center face roll contour, a heel side roll contour is less lofted than the center face roll contour, a crown side bulge contour is more open than the center face bulge contour, and a sole side bulge contour is more closed than the center face bulge contour.

In some embodiments, the golf club body has a discretionary mass on the sole positioned at an angle with respect to the striking face, the discretionary mass positioned toeward along the negative x-axis and rearward along the positive y-axis.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1A:
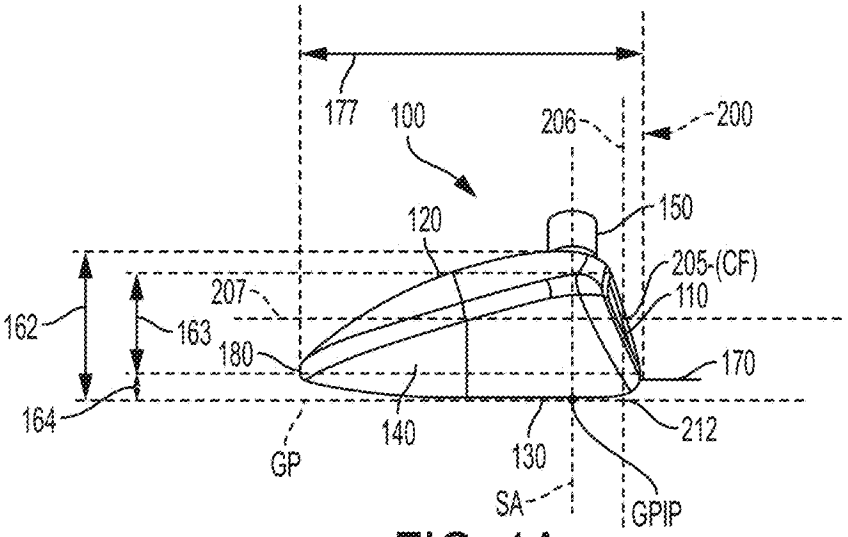
FIG. 1A is a toe side view of a golf club head in accord with one embodiment of the current disclosure.

Disclosed are various golf clubs as well as golf club heads including alignment features along with associated methods, systems, devices, and various apparatus. It would be understood by one of skill in the art that the disclosed golf clubs and golf club heads are described in but a few exemplary embodiments among many. No particular terminology or description should be considered limiting on the disclosure or the scope of any claims issuing therefrom.

The sport of golf is fraught with many challenges. Enjoyment of the game is increased by addressing the need to hit the golf ball further, straighter, and with more skill. As one progresses in golfing ability, the ability to compete at golf becomes a source of enjoyment. However, one does not simply hit a golf ball straighter or further by mere desire. Like most things, skill is increased with practice be it repetition or instruction so that certain elements of the game become easier over time. But it may also be possible to improve one's level of play through technology.

Much technological progress in the past several decades of golf club design has emphasized the ability to hit the golf ball further. Some of these developments include increased coefficient of restitution (COR), larger golf club heads, lighter golf club heads, graphite shafts for faster club speed, and center of gravity manipulation to improve spin characteristics, among others. Other developments have addressed a golfer's variability from shot-to-shot, including larger golf club heads, higher moment of inertia (MOI), variable face thickness to increase COR for off-center shots, and more. Still further developments address a golfer's consistent miss-hits—of which the most common miss-hit is a slice-including flight control technology (FCT), such as loft and lie connection sleeves to adjust, inter alia, face angle), moveable weights, sliding weight technologies, and adjustable sole pieces (ASP). Such technologies aid golfers in fixing a consistent miss, such that a particular error can be addressed.

As such, modern technology has done much to improve the golfer's experience and to tailor the golf club to the needs of the particular player. However, some methods are more effective than others at achieving the desired playing results. For example, research suggests that—for a drive of about 280 yards—a 1° difference in face angle at impact may account for about 16 yards of lateral dispersion in the resultant shot. Similarly, for moveable weights, changes in balance of weight by 12 grams moving for about 50 mm may result in about 15 yards of lateral dispersion on the resultant shot. However, it is also understood that a change in lie angle of the golf club head affects the face angle, but at a much smaller degree. As such, simply by increasing lie angle by 1°, the face angle alignment of the golf club head may be adjusted by 0.1° open or closed. As such, for better players who are simply trying to tune their ball flight, adjusting lie angle may be much more finely tunable than adjusting face angle. However, for many golfers, slicing (a rightward-curving shot for a right-handed golfer, as understood in the art) is the primary miss, and correction of such shot is paramount to enjoyment of the game.

One of the major challenges in the game of golf involves the difference between perception and reality. Golf includes psychological challenges—as the player's confidence wanes, his or her ability to perform particular shots often wanes as well. Similarly, a player's perception of his or her own swing or game may be drastically different from the reality. Some technology may address the player's perception and help aid in understanding the misconceptions. For example, technology disclosed in U.S. Pat. No. 8,771,095 to Beach, et al, entitled "CONTRAST-ENHANCED GOLF CLUB HEADS," filed Mar. 18, 2011, provides a player with a clearer understanding of his or her alignment than some of the preexisting art at the time, which may improve that player's ability to repeat his or her shots. However, it may be more helpful to provide those players a method to address the misconceptions and provide correction for them.

We have now surprisingly found that alignment features that includes all or a portion of the interface region between the areas of contrasting shade or color on the crown of the club head and the face of the club head and/or all or a portion of the interface region between areas of contrasting shade or color on different portions on the crown of the club head allows for improved performance in the resulting clubs by accounting for not only the actual alignment of the club head by the golfer during the shot but also as modified by the perceived alignment of the club head by the golfer. One example of a combination of contrasting colors or shades would be for example a black or metallic grey or silver color contrasting with white, but also included are other combinations which provide at a minimum a "just noticeable difference" to the human eye.

Figure 11:
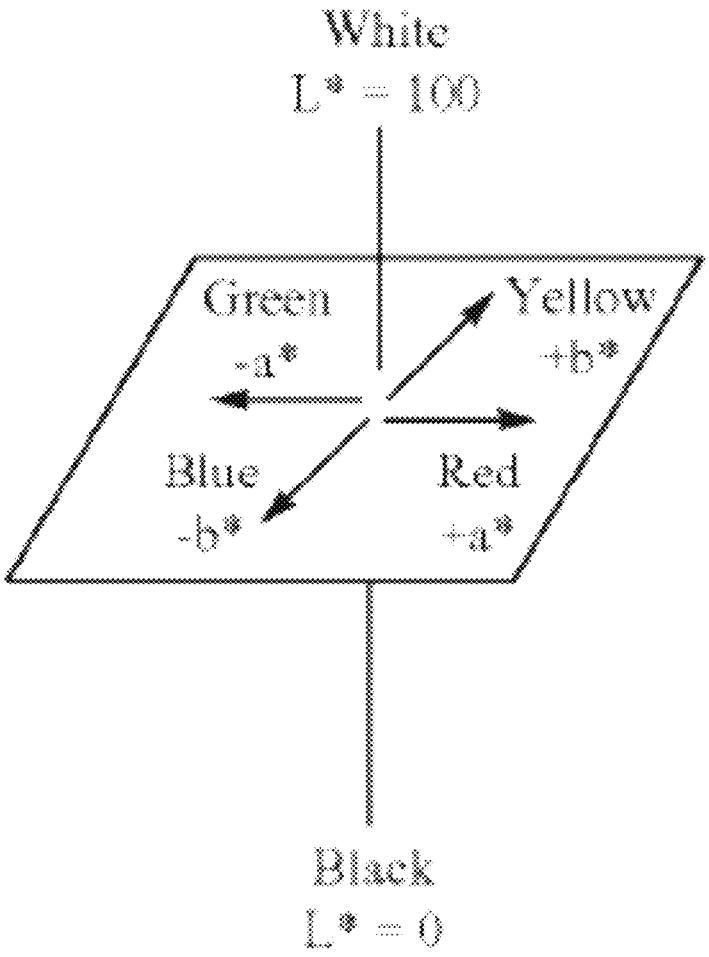
FIG. 11 is a reference to the CIELAB color system.

Although a "just noticeable difference" in terms of colors of a golf club head is to a degree somewhat subjective based on an individual's visual acuity, it can be quantified with reference to the CIELAB color system, a three dimensional system which defines a color space with respect to three channels or scales, one scale or axis for Luminance (lightness) (L) an "a" axis which extends from green (−a) to red (+a) and a "b" axis from blue (−b) to yellow (+b). This three dimensional axis is illustrated in FIG. 11.

A color difference between two colors can then be quantified using the following formula;

$$\Delta E^*_{ab} = \sqrt{(L^*_2 - L^*_1)^2 + (a^*_2 - a^*_1)^2 + (b^*_2 - b^*_1)^2}$$

where ($L^*_1$, $a^*_1$ and $b^*_1$) and ($L^*_2$, $a^*_2$ and $b^*_2$) represents two colors in the L,a,b space and where $\Delta E^*_{ab}$=2.3 sets the threshold for the "just noticeable difference" under illuminant conditions using the reference illuminant D65 (similar to outside day lighting) as described in CIE 15.2-1986.

Thus, for the alignment features of the golf clubs of the present invention, a contrasting color difference, $\Delta E^*_{ab}$, is greater than 2.3, preferably greater than 10, more preferably greater than 20, even more preferably greater than 40 and even more preferably greater than 60.

For general reference, a golf club head 100 is seen with reference to FIGS. 1A-1D. One embodiment of a golf club head 100 is disclosed and described with reference to FIGS. 1A-1D. As seen in FIG. 1A, the golf club head 100 includes a face 110, a crown 120, a sole 130, a skirt 140, and a hosel 150. Major portions of the golf club head 100 not including the face 110 are considered to be the golf club body for the purposes of this disclosure.

The metal wood club head 100 has a volume, typically measured in cubic-centimeters ($cm^3$), equal to the volumetric displacement of the club head 100, assuming any apertures are sealed by a substantially planar surface. (See United States Golf Association "Procedure for Measuring the Club Head Size of Wood Clubs," Revision 1.0, Nov. 21, 2003). In other words, for a golf club head with one or more weight ports within the head, it is assumed that the weight ports are either not present or are "covered" by regular, imaginary surfaces, such that the club head volume is not affected by the presence or absence of ports. In several embodiments, a golf club head of the present application can be configured to have a head volume between about 110 $cm^3$ and about 600 $cm^3$. In more particular embodiments, the head volume is between about 130 $cm^3$ and about 280 $cm^3$, or between about 250 $cm^3$ and about 500 $cm^3$. In yet more specific embodiments, the head volume is between about 300 $cm^3$ and about 500 $cm^3$, between 300 $cm^3$ and about 360 $cm^3$, between about 360 $cm^3$ and about 420 $cm^3$, between about 390 $cm^3$ and about 500 $cm^3$, or between about 420 $cm^3$ and about 500 $cm^3$. In some embodiments, the head volume is between about 370 $cm^3$ and about 500 $cm^3$.

In the case of a driver, the golf club head has a volume between approximately 300 $cm^3$ and approximately 460 $cm^3$, and a total mass between approximately 145 g and approximately 245 g. In the case of a fairway wood, the golf club head 10 has a volume between approximately 100 $cm^3$ and approximately 250 $cm^3$, and a total mass between approximately 145 g and approximately 260 g. In the case of a utility or hybrid club the golf club head 10 has a volume between approximately 60 $cm^3$ and approximately 150 $cm^3$, and a total mass between approximately 145 g and approximately 280 g.

A three dimensional reference coordinate system 200 is shown. An origin 205 (CF) of the coordinate system 200 is located at the center of the face (CF) of the golf club head 100. See U.S.G.A. "Procedure for Measuring the Flexibility of a Golf Clubhead," Revision 2.0, Mar. 25, 2005, for the methodology to measure the center of the striking face of a golf club. The coordinate system 200 includes a z-axis 206, a y-axis 207, and an x-axis 208 (shown in FIG. 1B). Each axis 206,207,208 is orthogonal to each other axis 206,207,208. The x-axis 208 is tangential to the face 110 and parallel to a ground plane (GP). The golf club head 100 includes a leading edge 170 and a trailing edge 180. For the purposes of this disclosure, the leading edge 170 is defined by a curve, the curve being defined by a series of forward most points, each forward most point being defined as the point on the golf club head 100 that is most forward as measured parallel to the y-axis 207 for any cross-section taken parallel to the plane formed by the y-axis 207 and the z-axis 206. The face 110 may include grooves or score lines in various embodiments. In various embodiments, the leading edge 170 may also be the edge at which the curvature of the particular section of the golf club head departs substantially from the roll and bulge radii.

Figure 1B:
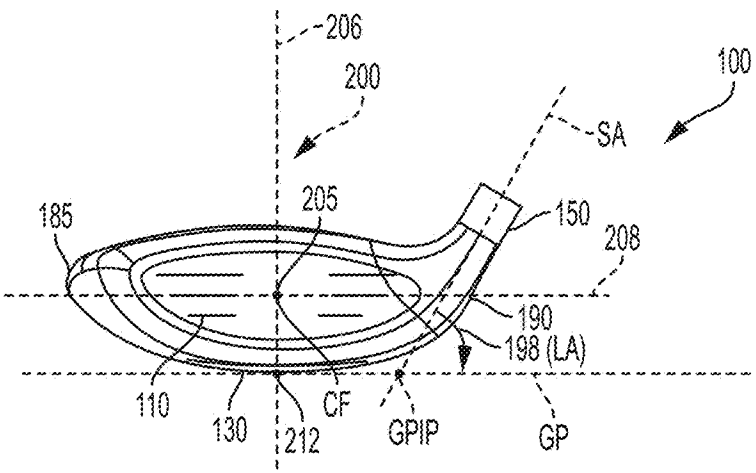
FIG. 1B is a face side view of the golf club head of FIG. 1A.
Figure 1C:
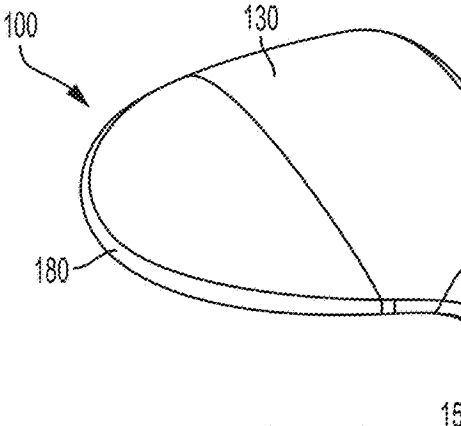
FIG. 1C is a perspective view of the golf club head of FIG. 1A.
Figure 1D:
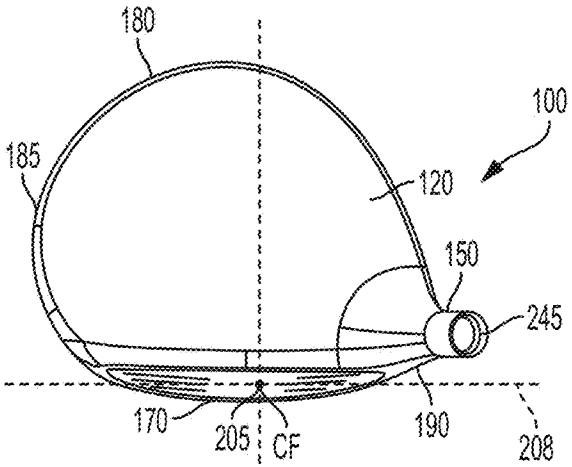
FIG. 1D is a top view of the golf club head of FIG. 1A.

As seen with reference to FIG. 1B, the x-axis 208 is parallel to the GP onto which the golf club head 100 may be properly soled-arranged so that the sole 130 is in contact with the GP in the desired arrangement of the golf club head 100. The y-axis 207 is also parallel to the GP and is orthogonal to the x-axis 208. The z-axis 206 is orthogonal to the x-axis 208, the y-axis 207, and the GP. The golf club head 100 includes a toe 185 and a heel 190. The golf club head 100 includes a shaft axis (SA) defined along an axis of the hosel 150. When assembled as a golf club, the golf club head 100 is connected to a golf club shaft (not shown). Typically, the golf club shaft is inserted into a shaft bore 245 defined in the hosel 150. As such, the arrangement of the SA with respect to the golf club head 100 can define how the golf club head 100 is used. The SA is aligned at an angle 198 with respect to the GP. The angle 198 (LA) is known in the art as the lie angle (LA) of the golf club head 100. A ground plane intersection point (GPIP) of the SA and the GP is shown for reference. In various embodiments, the GPIP may be used as a point of reference from which features of the golf club head 100 may be measured or referenced. As shown with reference to FIG. 1A, the SA is located away from the origin 205 such that the SA does not directly intersect the origin or any of the axes 206,207,208 in the current embodiment. In various embodiments, the SA may be arranged to intersect at least one axis 206,207,208 and/or the origin 205. A z-axis ground plane intersection point 212 can be seen as the point that the z-axis intersects the GP. The top view seen in FIG. 1D shows another view of the golf club head 100. The shaft bore 245 can be seen defined in the hosel 150.

Referring back to FIG. 1A, a crown height 162 is shown and measured as the height from the GP to the highest point of the crown 120 as measured parallel to the z-axis 206. The golf club head 100 also has an effective face height 163 that is a height of the face 110 as measured parallel to the z-axis 206. The effective face height 163 measures from a highest point on the face 110 to a lowest point on the face 110 proximate the leading edge 170. A transition exists between the crown 120 and the face 110 such that the highest point on the face 110 may be slightly variant from one embodiment to another. In the current embodiment, the highest point on the face 110 and the lowest point on the face 110 are points at which the curvature of the face 110 deviates substantially from a roll radius. In some embodiments, the deviation characterizing such point may be a 10% change in the radius of curvature. In various embodiments, the effective face height 163 may be 2-7 mm less than the crown height 162. In various embodiments, the effective face height 163 may be 2-12 mm less than the crown height 162. An effective face position height 164 is a height from the GP to the lowest point on the face 110 as measured in the direction of the z-axis 206. In various embodiments, the effective face position height 164 may be 2-6 mm. In various embodiments, the effect face position height 164 may be 0-10 mm. A distance 177 of the golf club head 100 as measured in the direction of the y-axis 207 is seen as well with reference to FIG. 1A. The distance 177 is a measurement of the length from the leading edge 170 to the trailing edge 180. The distance 177 may be dependent on the loft of the golf club head in various embodiments.

For the sake of the disclosure, portions and references disclosed above will remain consistent through the various embodiments of the disclosure unless modified. One of skill in the art would understand that references pertaining to one embodiment may be included with the various other embodiments.

Figure 2:
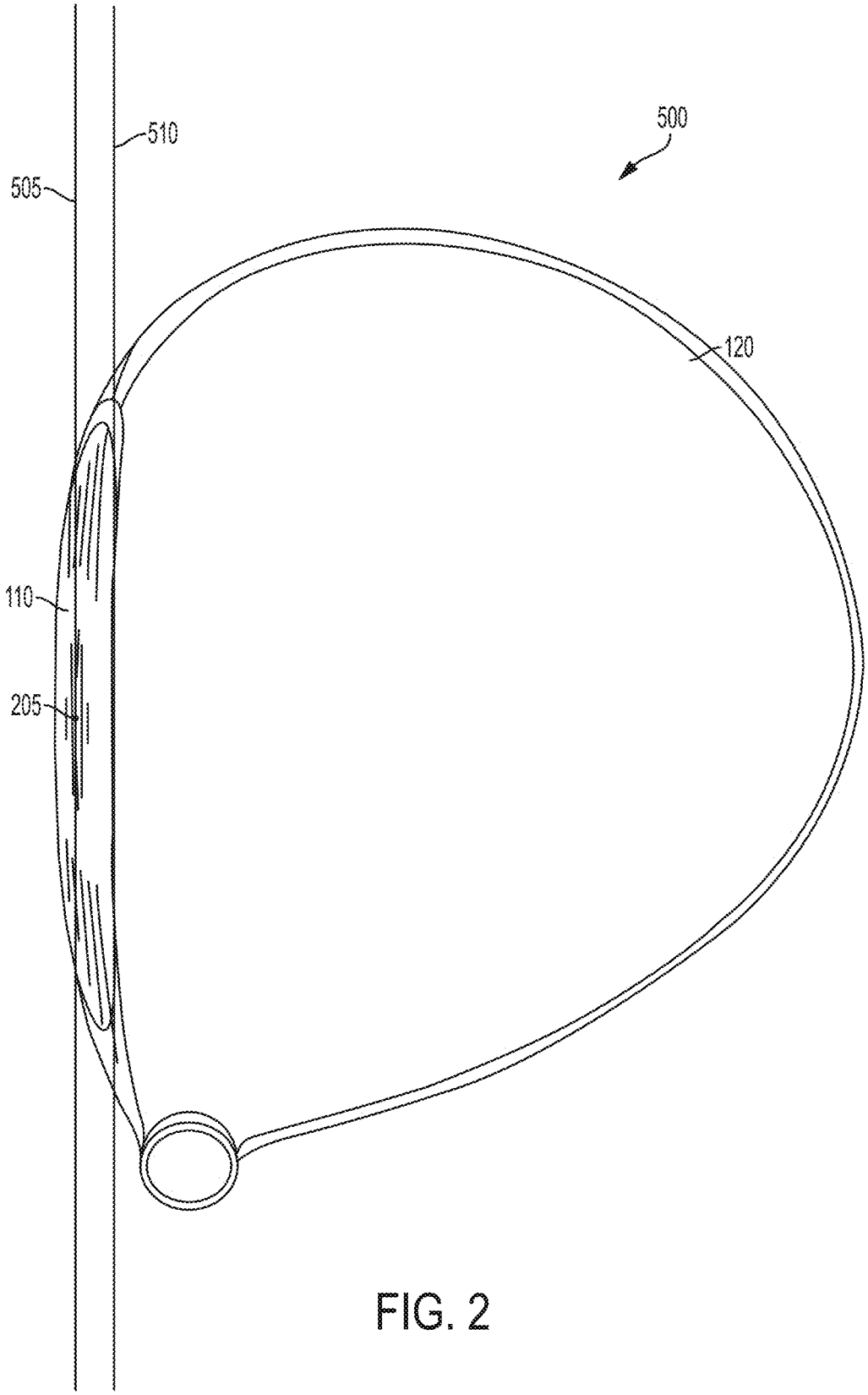
FIG. 2 is a top view of a golf club head in accord with one embodiment of the current disclosure.

As seen with reference to FIG. 2, a golf club head 500 includes a painted crown 120 and unpainted face 110. Painted or otherwise contrast-enabled crowns have been utilized as described in U.S. Pat. No. 8,771,095 to Beach, et al, entitled "CONTRAST-ENHANCED GOLF CLUB HEADS," filed Mar. 18, 2011, to provide golfers with aided alignment. Typically the golfer employs the crown to face transition or top-line to align the club with the desired direction of the target line. The top-line transition is clearly delineated by a masking line between the painted crown and the unpainted face. While such features may have been described to some degree, use of the features to bias alignment has not been conceived in the art. With the golf club head 500 of the current embodiment, one of skill in the art would understand that the high-contrast described in U.S. Pat. No. 8,771,095 to Beach, et al, entitled "CONTRAST-ENHANCED GOLF CLUB HEADS," filed Mar. 18, 2011, may be beneficial for emphasizing various alignment features. As such, the disclosure is incorporated by reference herein in its entirety.

For reference, a face angle tangent 505 is seen in FIG. 2. The face angle tangent 505 indicates a tangent line to the center face 205. The face angle tangent 505 in the current embodiment is coincident with the x-axis 206 (as seen with reference to prior FIGS.). Also seen in FIG. 2 is a top tangent 510. In the current embodiment, the top tangent 510 is a line made tangent to a top of the face 110 because, in the current embodiment, a joint between the face 110 and the crown 120 is coincident with paint lines. The top tangent 510 in the several embodiments of the current disclosure will follow the contours of various paint lines of the crown 120, and one of skill in the art would understand that the top tangent 510 need not necessarily be coincident with a tangent to the face 110. However, in the current embodiment, the top tangent 510 is parallel to the face angle tangent 505. As such, the paint of the crown 120 can be described as appearing square with the face angle.

The purpose of highlighting such features of the golf club head 500 is to provide a basis for the discussion of alignment with respect to the current disclosure. Through variations in alignment patterns, it may be possible to influence the golfer such that the golfer alters his or her play because of the appearance of misalignment. If a player perceives that the golf club head is such that the face is open with reference to the intended target, he or she would be more likely to try to "square up" the face by manually closing it. Many golfers prefer not to perceive a metal wood golf club head as appearing closed, as such an appearance is difficult to correct. However, even if such a player were to perceive the metal wood head as being closed, such perception does not mean that the golf club head is aligned in a closed position relative to the intended target.

Figure 3:
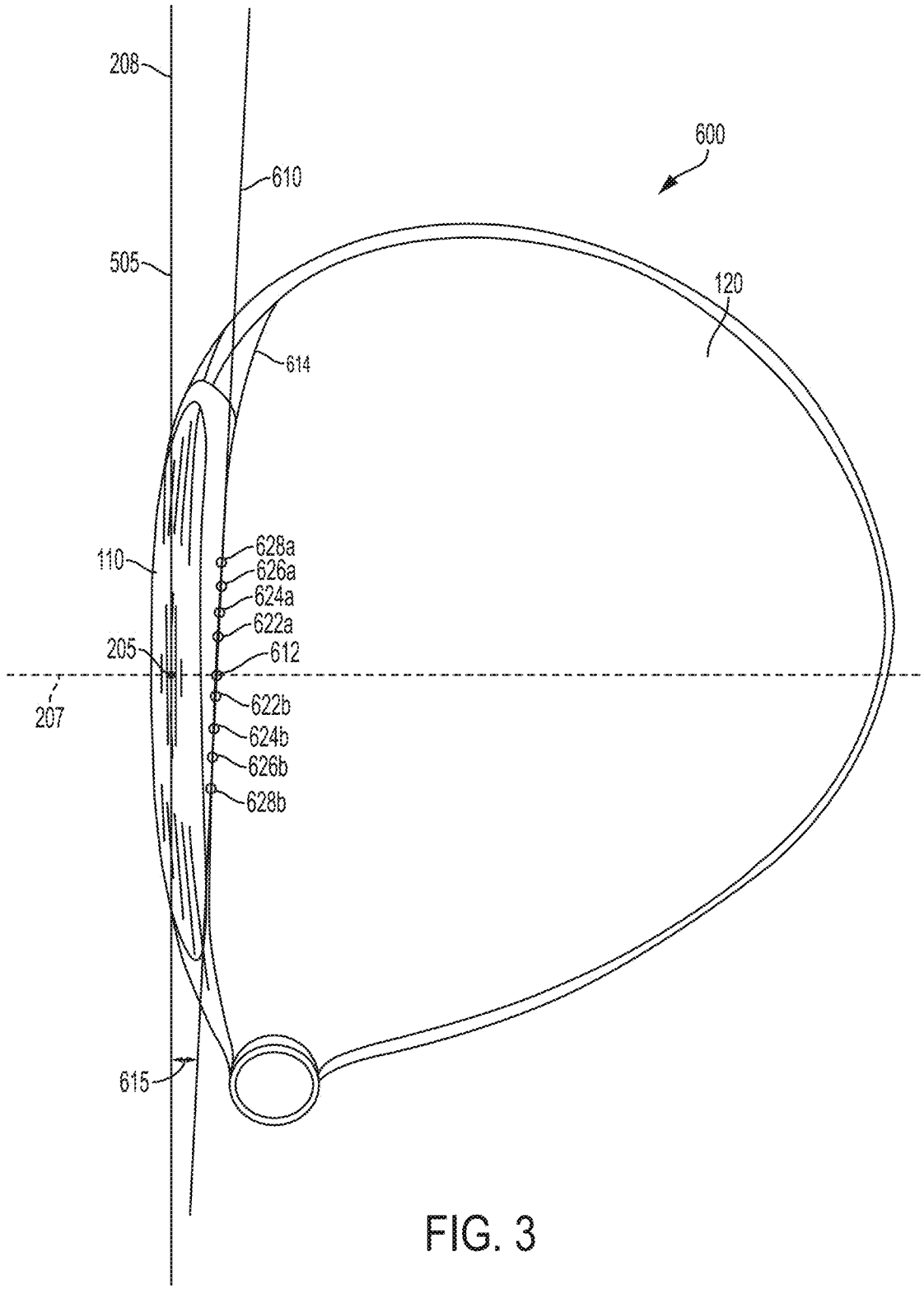
FIG. 3 is a top view of a golf club head in accord with one embodiment of the current disclosure.

As seen with reference to FIG. 3, a golf club head 600 includes similar head geometries to golf club head 500. However, the golf club head 600 includes a feature to alter the perceived angle of the face 110 for the user. In the current embodiment, a top tangent 610 that is aligned at an angle 615 with respect to the face angle tangent 505 such that the perceived angle of the face (Perceived Face Angle, PFA) is different from the actual alignment of the face angle tangent 505. In the current embodiment, the angle 615 is about 4°. In various embodiments, the angle 615 may be 2°-6°. In various embodiments, the angle 615 may be less than 7°. In various embodiments, the angle 615 may be 5-10°. In various embodiments, the angle 615 may be less than 12°. In various embodiments, the angle 615 may be up to 15°. As indicated with respect to top tangent 510, the top tangent 610 is an indicator of the alignment of an edge of an area of contrasting paint or shading of the crown 120 delineated by a masking line between the painted crown and the unpainted face relative to the color or shading of the face 110 and is the line that is tangent to an edge 614 of the contrasting crown paint or crown shading at a point 612 where the edge 614 intersects a line parallel to the y-axis 207.

In various embodiments, a perceived angle may be determined by finding a linear best-fit line of various points. For such approximation, a perceived angle tangent may be determined by best fitting points on the edge 614 at coordinates of the x-axis 208 that are coincident with center face 205—point 612—and at points ±5 mm of CF 205 (points 622*a,b*), at points ±10 mm of CF 205 (points 624*a,b*), at points ±15 mm of CF 205 (points 626*a,b*), and at points ±20 mm of CF 205 (points 628*a,b*). As such, nine points are defined along the edge 614 for best fit of the top tangent 610. In the current embodiment, the perceived angle tangent is the same as the top tangent 610.

However, such method for determining the perceived angle tangent may be most useful in cases where the edge 614 of an area of contrasting paint or shading of the crown 120 relative to the color or shading of the face 110 includes different radii of relief along the toe portion and the heel portion. In such an embodiment, a line that is tangent to the edge 614 at point 612 may not adequately represent the appearance of the alignment of the golf club head 600. Such an example can be seen with reference to FIG. 4.

Figure 4:
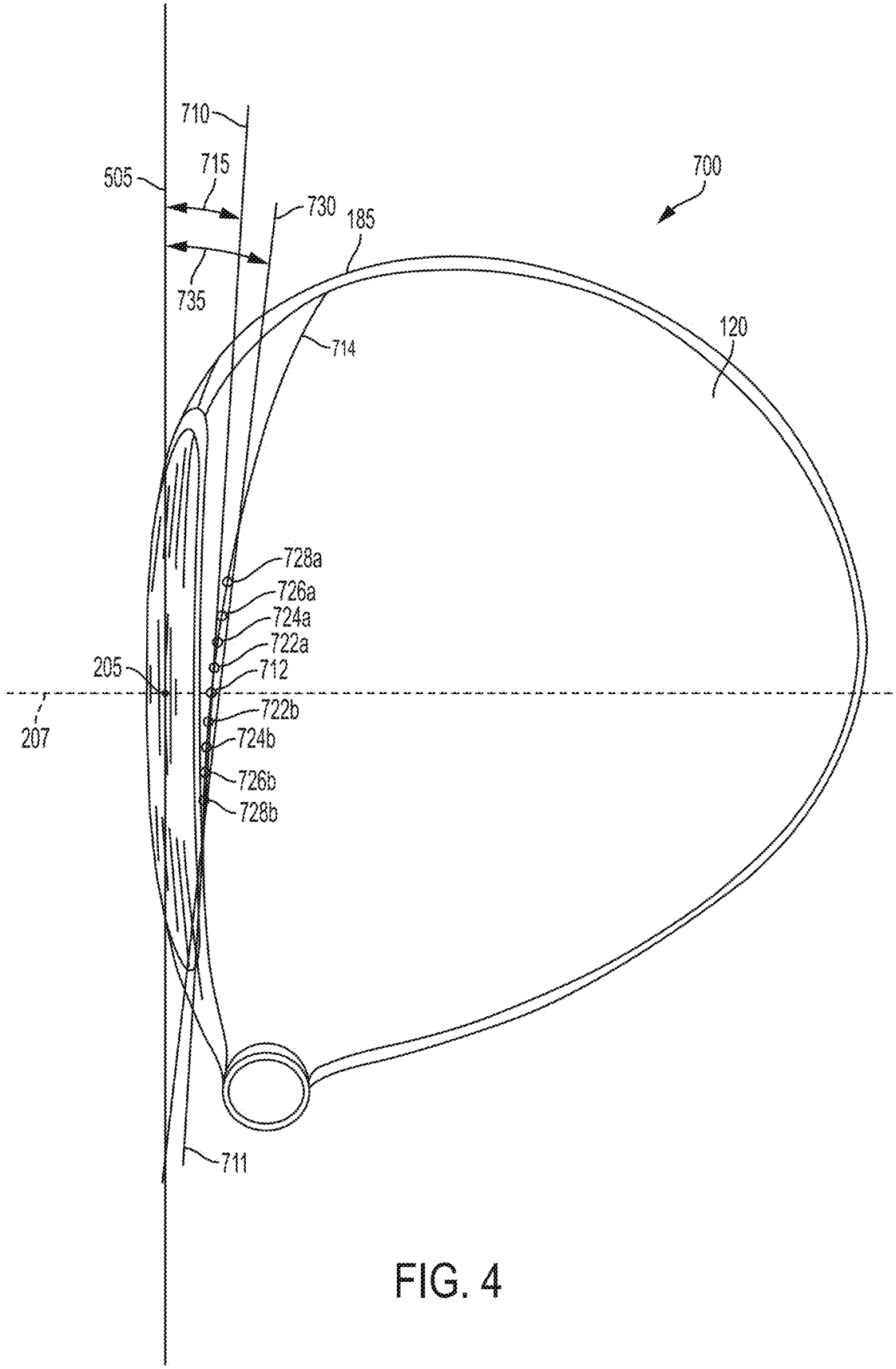
FIG. 4 is a top view of a golf club head in accord with one embodiment of the current disclosure.

As seen in FIG. 4, a golf club head 700 includes an edge 714 of an area of contrasting paint or shading of the crown 120 relative to the color or shading of the face 110 that is more aggressively rounded proximate the toe 185 than prior embodiments. As such, a line 711 that is literally tangent to the edge 714 at a point 712 that is coincident with the y-axis 207 may not adequately describe the perception. Such a line would be the top tangent 710. However as noted previously with reference to golf club head 600, points 712, 722*a,b*, 724*a,b*, 726*a,b*, and 728*a,b*, can be used to form a best fit line 730 that is aligned at a perceived angle 735 that is greater than an angle 715 of the top tangent 710. In various embodiments, the perceived angle 735 may be within the increments of angle 615, above, or may be up to 20° in various embodiments. In most embodiments, the perceived angle 735 may be 8-10°. In various embodiments, the perceived angle 735 may be 9-10°. In various embodiments, the perceived angle 735 may be 7-11®. In various embodiments, the perceived angle 735 may be 7-8.5°. In various embodiments, alignment may be influenced by the inclusion of an alignment feature that does not invoke an edge such as edges 614, 714. As seen with reference to FIG. 5, various embodiments of alignment features may be suggestive of the face angle and, as such, provide an appearance of alignment to the golfer without modifying paint lines.

Figure 5:
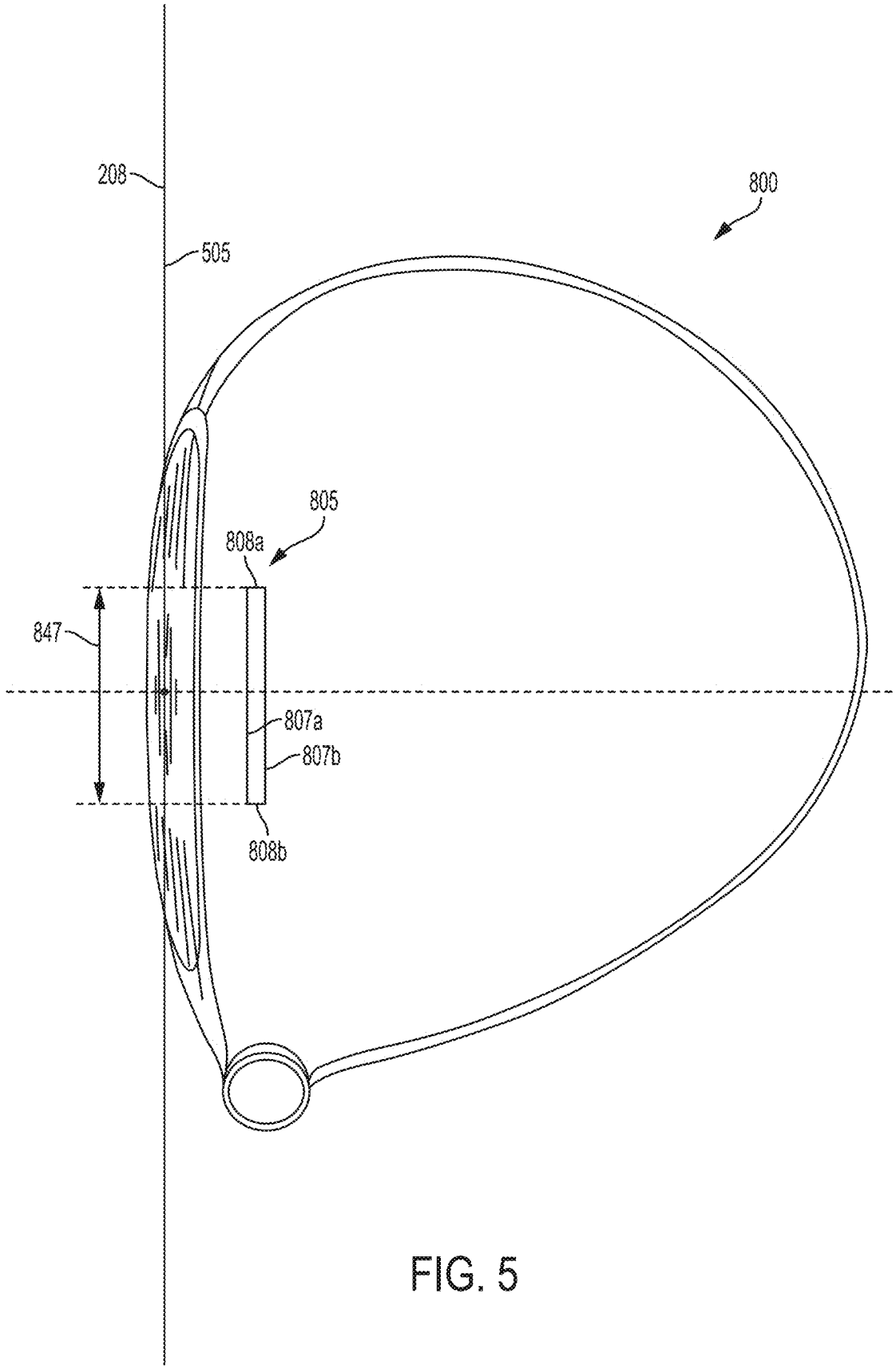
FIG. 5 is a top view of a golf club head in accord with one embodiment of the current disclosure.

A golf club head 800, as seen in FIG. 5, includes an alignment feature 805. The alignment feature 805 of the current embodiment includes at least one elongate side 807—and in the current embodiment, two elongate sides 807*a* and 807*b* are included. The alignment feature 805 of the current embodiment also includes two additional sides 808*a* and 808*b*. As can be seen, the alignment feature 805 is arranged such that the at least one elongate side 807 is aligned about parallel to the x-axis. As such, a golfer is able to use the alignment feature 805 by aligning the direction of the elongate side 807 in an orientation that is about perpendicular to the intended target. The alignment feature 805 has a length 847 as measured parallel to the x-axis 208. In the current embodiment, the length 847 is about the same as the diameter of a golf ball, or about 1.7 inches. However, in various embodiments, the length 847 may be 0.5 inches, 0.75 inches, 1 inch, 1.25 inches, 1.5 inches, 1.75 inches, 2 inches, 2.25 inches, 2.5 inches, or various lengths therein. If the length 847 of the dominant elongate side 807*a* or 807*b* is less than about 0.3 inches, the impact of the alignment feature 805 on biasing the golfer's perception decreases substantially.

However, with sufficient use, the alignment feature 805 can become the primary focus of the golfer's attention and, as such, modifications to the arrangement of the alignment feature 805 with respect to the x-axis 208 (which is coincident with the face angle tangent 505) may allow the golfer to bias his or her shots and thereby modify his or her outcome.

Figure 6:
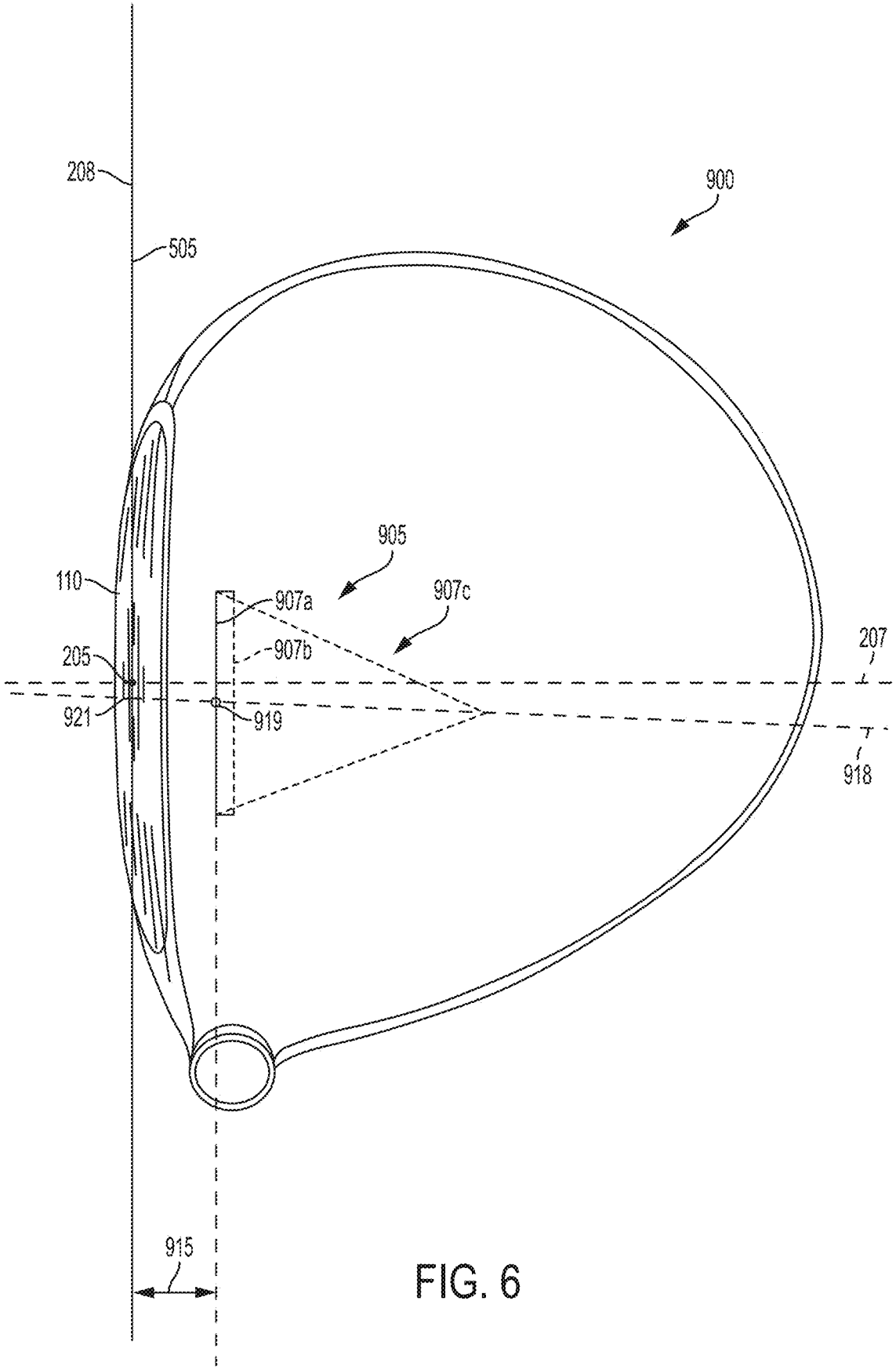
FIG. 6 is a top view of a golf club head in accord with one embodiment of the current disclosure.

As seen with reference to FIG. 6, a golf club head 900 includes an alignment feature 905. The alignment feature 905 of the current embodiment includes one elongate side 907*a* on a side of the alignment feature 905 that is proximate the face 110. The alignment feature 905 includes several potential rear portions. Similar to golf club head 800, golf club head 900 includes the alignment feature 905 having a potential second elongate side 907*b* in one embodiment. In another embodiment, an extended rear portion 907*c* may also be included or may be included separately from elongate side 907*b*. In the current embodiment, the elongate side 907*b* is oriented at an angle 915 with respect to the face angle tangent 505.

For the embodiment including second elongate side 907*b*, the second elongate side 907*b* is about parallel to the elongate side 907*a*. As such, the embodiment is similar to golf club head 800 but is oriented at angle 915. With respect to extended rear portion 907*c*, the orientation of such an embodiment may appear less askew and, consequently, may be more effective at modifying the golfer's perception of the club's alignment. A perpendicular reference line 918 is seen as a reference for being orthogonal to the elongate side 907*a*. The perpendicular reference line 918 intersects the elongate side 907*a* at a point 919 that bisects the elongate side 907*a*. Further, the perpendicular reference line 918 intersects the x-axis 208 at an intersection point 921 that is heelward of the center face 205. In the current embodiment, the intersection point 921 is heelward of center face 205 by about 2 mm. In various embodiments, the intersection point 921 may be about the same as center face 205. In various embodiments, the intersection point 921 may be up to 2 mm heelward of center face 205. In various embodiments, the intersection point 921 may be up to 5 mm heelward of center face 205. In various embodiments, the intersection point 921 may be somewhat toeward of center face 205. In various embodiments, the intersection point 921 may be ±2 mm of the center face 205.

Figure 7:
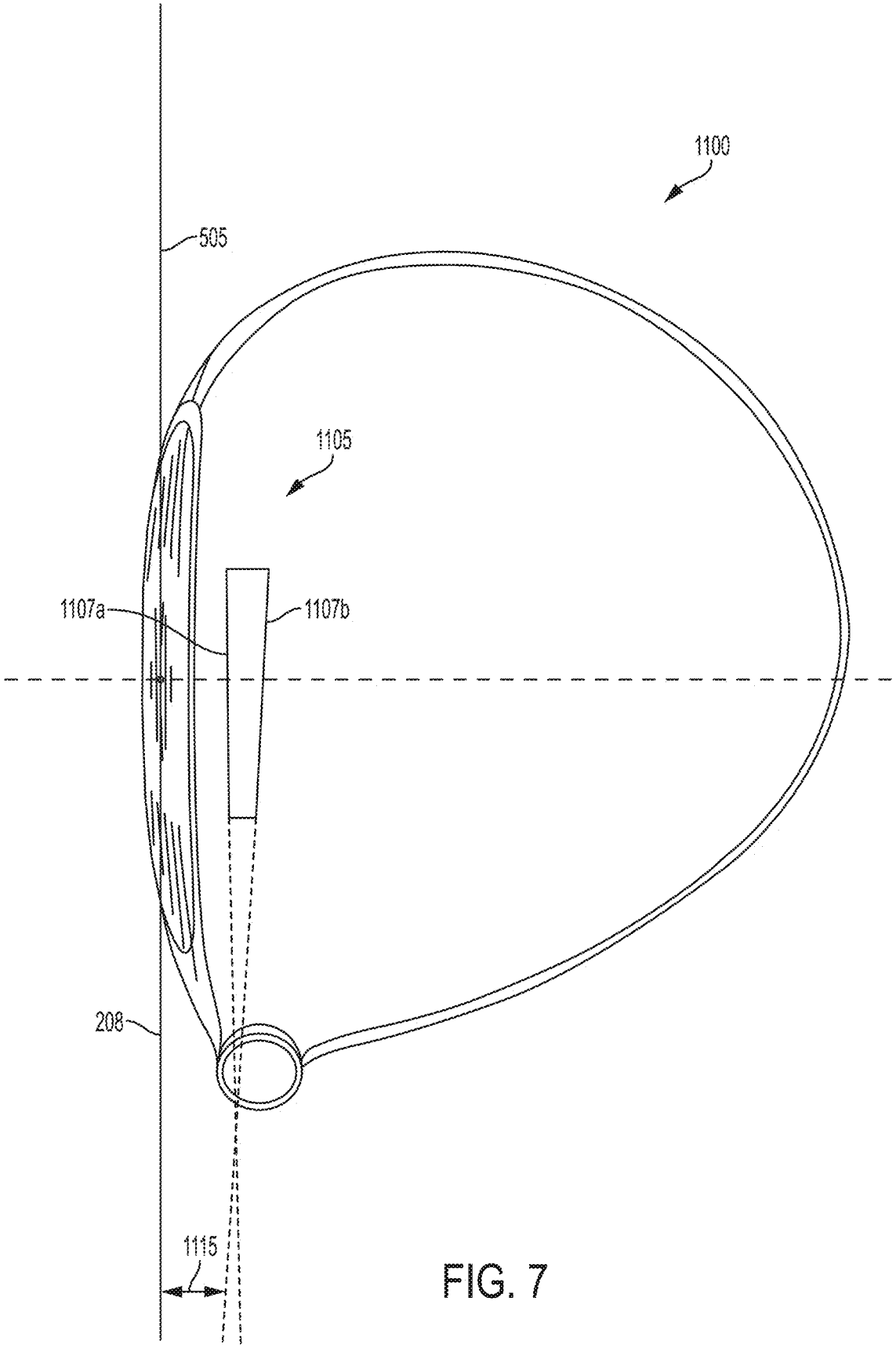
FIG. 7 is a top view of a golf club head in accord with one embodiment of the current disclosure.

Another embodiment of a golf club head 1100, shown in FIG. 7, includes an alignment feature 1105. The alignment feature has a first elongate side 1107*a* and a second elongate side 1107*b*. In the current embodiment, however, the first elongate side 1107*a* is about parallel with the face angle tangent 505 and the x-axis 208. However, the second elongate side 1107*b* is oriented at an angle 1115 with respect to the face angle tangent 505 such that the golfer's perception of alignment may be altered.

A preferred method for measuring the perceived face angle observed by a golfer further takes into account the fact that most golfers have a dominant left eye and when they address the ball with the club head, a direct line between the left eye and center face would actually cross the topline heel ward of center face and thus this is where an alignment feature which includes an edge of an area of contrasting paint or shading of the crown 120 relative to the color or shading of the face 110 would exert the most effect on the golfer's perception of the face angle. This perceived face angle is thus called a Sight Adjusted Perceived Face Angle (SAPFA) and is measured using the apparatus shown in FIGS. 8A-8C.

Figure 8B:
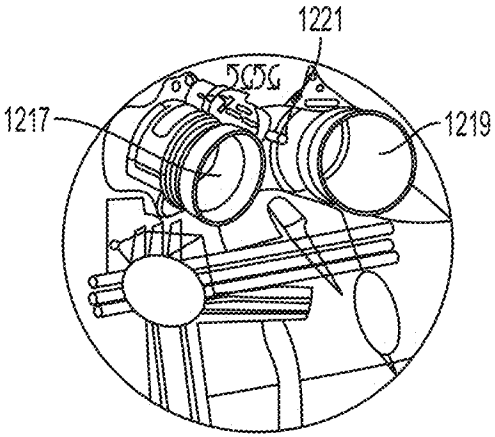
FIG. 8B is a close up view of the arrangement of the laser and cameras in the apparatus used for measuring a Sight Adjusted Perceived Face Angle in accordance with the current disclosure.
Figure 8A:
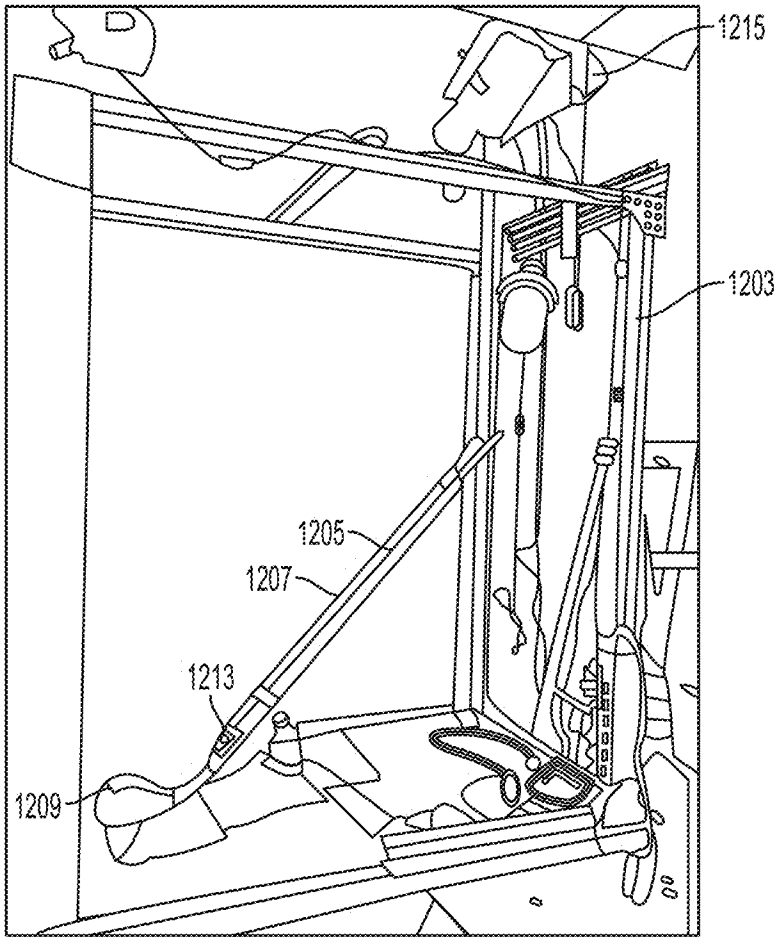
FIG. 8A is a front view of the apparatus used for measuring a Sight Adjusted Perceived Face Angle in accordance with the current disclosure.
Figure 8C:
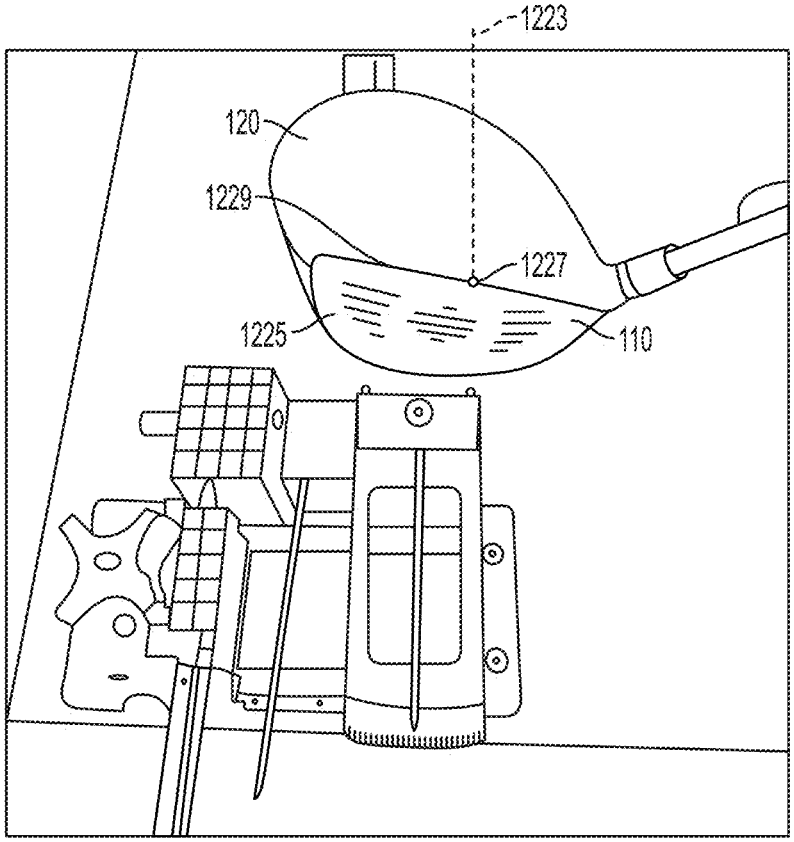
FIG. 8C is a side view of a golf club head fixture in an 69apparatus used for measuring a Sight Adjusted Perceived Face Angle in accordance with the current disclosure.

The apparatus used is shown in FIGS. 8A, 8B and 8C and includes a frame 1203 which holds a fixture 1205 for holding and aligning a golf club shaft 1207 and attached golf club head 1209 at a Lie Angle of 45°. The face of the golf club head 1209 is also set at a face angle of 0° using a face angle gauge 1211. The face angle gauge may be any commonly used in the industry such as a De la Cruz face angle gauge). After setting the loft and lie angle the club is clamped in the fixture using a screw clamp 1213. The frame 1203 also includes an attachment point 1215 for mounting two cameras 1217 and 1219 and a Calpac Laser CP-TIM-230-9-1L-635 (Fine/Precise Red Line Laser Diode Module Class II: 1 mW/635 nm), 1221. The center of the lens of camera 1219 is situated at the x, y and z coordinates (namely 766 mm, 149 mm, 1411 mm) using the previously defined x y and z axes with USGA center face (as measured using the procedure in U.S.G.A. "Procedure for Measuring the Flexibility of a Golf Clubhead," Revision 2.0, Mar. 25, 2005, "USGA Center Face") as the origin, and where a positive x coordinate represents a position heel ward of center face, a positive y coordinate represent a position rearward of center face and a positive z coordinate represents a position above center face. The laser is situated between the two cameras.

As shown in FIG. 8C the laser produces a line 1223 having an axis parallel to the camera axis and projecting along the y axis which is adjusted such that the line intersects USGA Center Face 1225. The point 1227 at which the line then intersects the edge of an area of contrasting paint or shading of the crown 120 relative to the color or shading of the face 110 which in this case corresponds to the white paint line of the crown 1229 is then physically marked on the paint line using a marker and acts a the datum or reference point. A camera is then activated to take an image of the club head including the datum or reference point 1227 and the paint line 1229.

The image from the camera is then analyzed using an image analyzer software package (which can be any of these known in the art able to import an image and can fit a line to the image using a curve fitting function). A best fit line to the paint line is then determined. For most embodiments the best fit to the paint line results from fitting the line to a quadratic equation of the form $y=ax^2+bx+c$. Two points are then selected on this best fit line at arc length between +/−0.25 mm from the datum point. A straight line is then drawn between the two points and a line perpendicular to this line is then drawn through the datum. The Sight Adjusted Perceived Face Angle (SAPFA) is then measured as the angle between the perpendicular line and the y axis.

Using this method the Sight Adjusted Perceived Face Angle (SAPFA) of the golf clubs of the present invention may be from −2 to 10, preferably from 0 to 6, more preferably from 0.5 to 4 even more preferably from 1 to 2.5 and most preferably from 1.5 to 2 degrees.

EXAMPLES

Four identical club heads were taken and the paint line edge of an area of contrasting paint or shading of the crown 120 relative to the color or shading of the face 110 was varied and the Sight Adjusted Perceived Face Angles (SAPFA) measured.

In addition to the Sight Adjusted Perceived Face Angles (SAPFA) four additional measurements were taken to describe the paint line edge alignment feature of the four clubs and these values are summarized in Table 1.

In addition to the SAPFA, three additional angles were measured at different points as measured from the datum along the best fit line to the paint line edge alignment feature determined as for the SAPFA. The first angle was obtained at a point along the best fit line at an arc length 25 mm heelward of the datum. Again as for the SAPFA measurement, two points at arc length between +/−0.25 mm from the 25 mm point were selected. A straight line is then drawn between these two points and a line perpendicular to this line is then drawn at the 25 mm point. The angle is then measured between this perpendicular line and the y axis. This angle is reported as the Sight Adjusted Perceived Face Angle 25 mm Heelward ("$SAPFA_{25H}$").

The second angle was obtained at a point along the best fit line at an arc length 25 mm toeward of the datum. Again as for the SAPFA measurement, two points at arc length between +/−0.25 mm from the 25 mm point were selected. A straight line is then drawn between the two points and a line perpendicular to this line is then drawn at the 25 mm point. The angle is then measured between this perpendicular line and the y axis. This angle is reported as the Sight Adjusted Perceived Face Angle 25 mm Toeward ("$SAPFA_{25T}$").

In addition, to capture any effect of greater rounding of the paint line edge alignment feature towards the toe of the golf club head, a third angle was obtained at a point along the best fit line at an arc length 50 mm toeward of the datum. Again as for the SAPFA measurement, two points at arc length between +/−0.25 mm from the 25 mm point were selected. A straight line is then drawn between the two points and a line perpendicular to this line is then drawn at the 50 mm point. The angle is then measured between this perpendicular line and the y axis. This angle is reported as the Sight Adjusted Perceived Face Angle 50 mm Toeward ("$SAPFA_{50T}$").

Finally, in an attempt to describe more of the paint line edge alignment feature, the image of the paint line edge alignment feature imported into the image analyzer as for the SAPFA measurement was also fit to a circle using the formula $(x-a)^2+(y-b)^2=r^2$, and the radius of curvature of this circular fit line determined and reported in Table 1 as the Radius of Curvature (circle fit).

TABLE 1

| Example No. | Sight Adjusted Perceived Face Angle (SAPFA) (degrees) | Radius of Curvature (circle fit, mm) | Angle 25 mm Heelward (degrees) | Angle 25 mm Toeward (degrees) | Angle 50 mm Toeward (degrees) |
|---|---|---|---|---|---|
| 1 | 3.5722 | 570.47 | 1.1377 | 5.9453 | 8.2757 |
| 2 | 5.2813 | 419.53 | 1.7509 | 8.6871 | 11.9168 |
| 3 | 0.2927 | 781.02 | −1.4461 | 2.0189 | 3.7129 |
| 4 | −0.5925 | 568.21 | −3.06 | 1.8533 | 4.245 |

Each club was then hit between 6 to 12 times by 10 different players into a blank screen with no trajectory or other feedback available to the player, and a Trackman 3e launch monitor and the TPS software package were used to calculate the total dispersion from a center target line with a positive total dispersion indicating the number of yards right of the center target line and a negative total dispersion indicating the number of yards left of the center target line. Thus, a player who has a tendency to slice the ball i.e. produce a ball flight right of the target line would be assisted in producing a shot closer to the target line if the golf club tended to yield a more negative dispersion.

Figure 9:
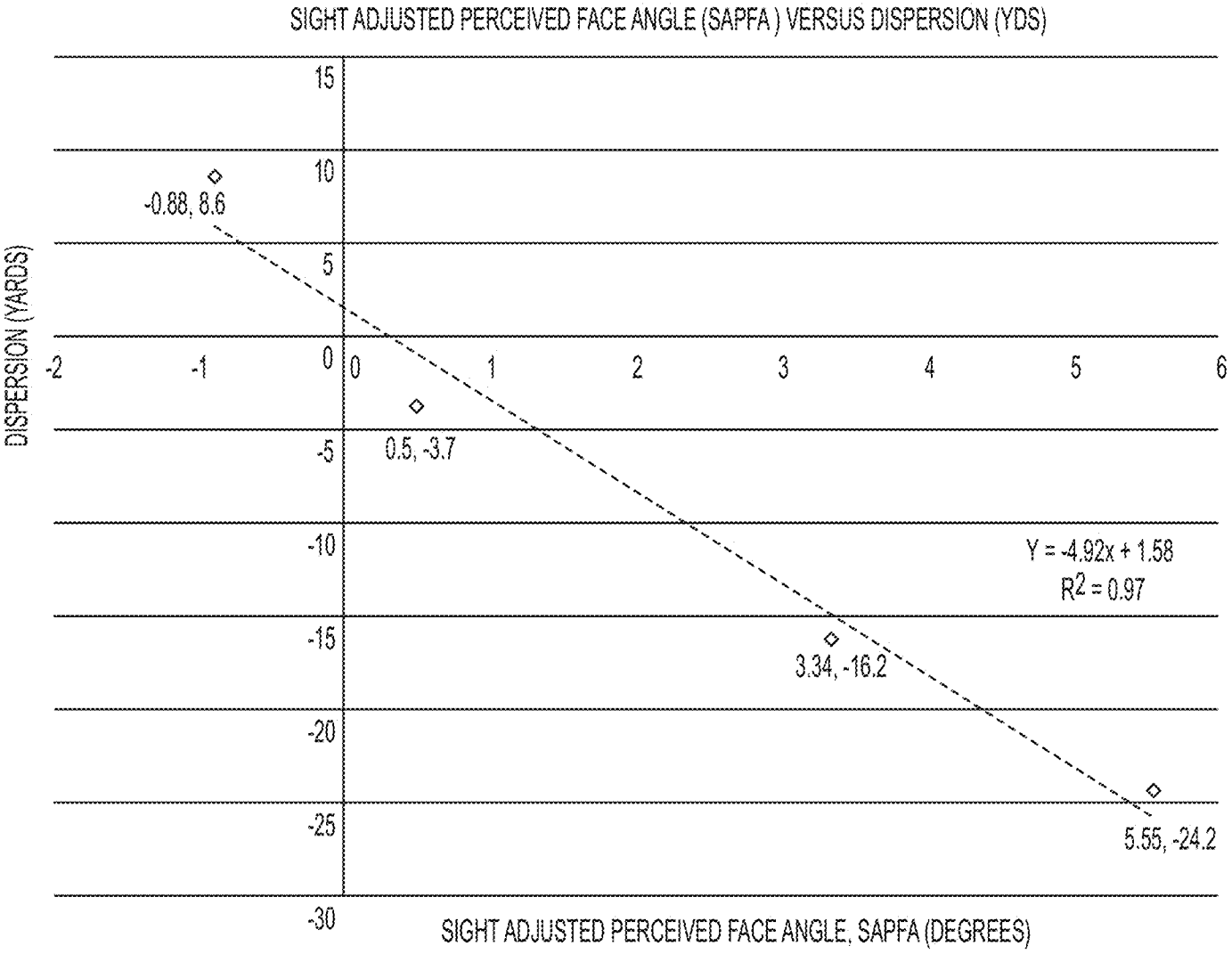
FIG. 9 is a graph of the Sight Adjusted Perceived Face Angle vs. the Dispersion in Ball Flight for four clubs having the alignment features in accordance with the current disclosure.

The graph in FIG. 9 plots the Sight Adjusted Perceived Face Angle (SAPFA) versus the average total dispersion of each club when hit 6-12 times by each player. The data show that adjustment of the edge of an area of contrasting paint or shading of the crown relative to the color or shading of the face such that the Sight Adjusted Perceived Face Angle (SAPFA) of the golf club goes from −0.88 degrees through 0.5 degrees through 3.34 degrees to 5.55 degrees results in an overall change in total dispersion from 8.6 yards to the right of the target line to 24.2 yards to the left of the target i.e. an absolute change in total dispersion of 32.8 yards from the same club head by solely manipulating the appearance of the paint line comprising the primary alignment feature.

The golf club heads of the present invention have a Sight Adjusted Perceived Face Angle (SAPFA) of from about −2 to about 10, preferably of from about 0 to about 6, more preferably of from about 0.5 to about 4 even more preferably of from about 1 to about 2.5 and most preferably of from about 1.5 to about 2 degrees.

The golf club heads of the present invention also have a Sight Adjusted Perceived Face Angle 25 mm Heelward ("$SAPFA_{25H}$") of from about −5 to about 2, more preferably of from about −3 to 0, even more preferably of from about −2 to about −1 degrees.

The golf club heads of the present invention also have a Sight Adjusted Perceived Face Angle 25 mm Toeward ("$SAPFA_{25T}$") of from 0 to about 9, more preferably of from about 1 to about 4.5, even more preferably of from about 2 to about 4 degrees.

The golf club heads of the present invention also have a Sight Adjusted Perceived Face Angle 50 mm Toeward ("$SAPFA_{50T}$") of from about 2 to about 9, more preferably of from about 3.5 to about 8, even more preferably of from about 4 to about 7 degrees.

The golf club heads of the present invention also have a Radius of Curvature (circle fit) of from about 300 to about 1000, more preferably of from about 400 to about 900, even more preferably of from about 500 to about 775 mm.

In other embodiments, the golf club head in addition to having a first or primary alignment feature as described earlier with reference to FIGS. 1-4, may also have a second or secondary alignment feature including the alignment features as described earlier with reference to FIGS. 5, 6 and 7.

Figure 10B:
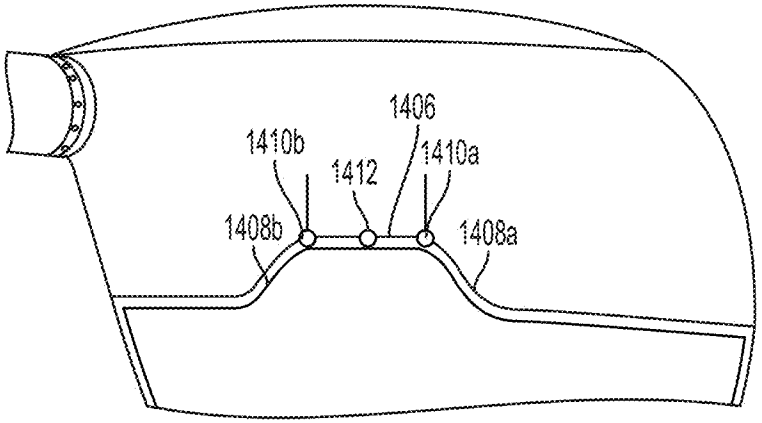
FIG. 10B is a top view of a golf club head in accord with one embodiment of the current disclosure.
Figure 10A:
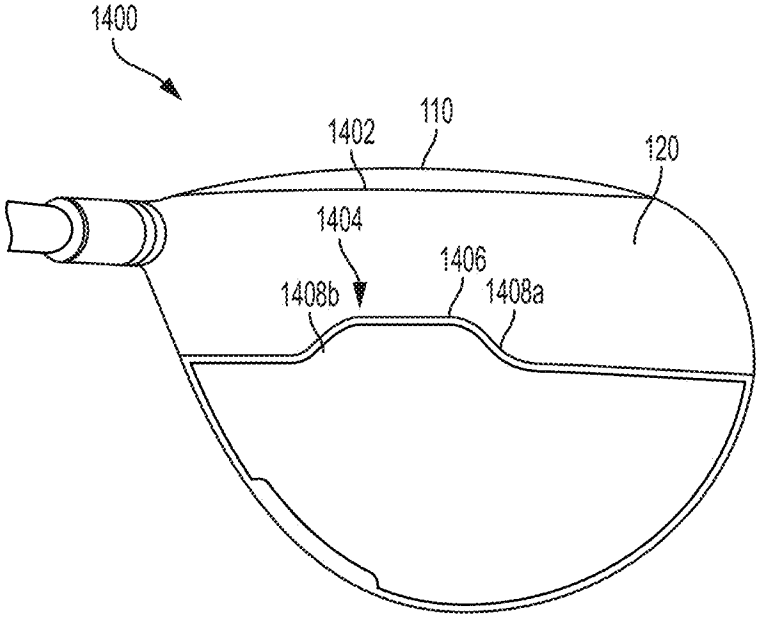
FIG. 10A is a top view of a golf club head in accord with one embodiment of the current disclosure.

In an especially preferred embodiment, shown in FIG. 10A and FIG. 10B, the golf club head 1400 of the present invention can have a crown having a first portion having a first color or shade and a second portion having a second color or shade, and a primary alignment feature consisting of a an edge 1402 of an area of contrasting paint or shading of the first portion of the crown 120 relative to the color or shading of the face 110 as described earlier and illustrated in FIGS. 3 and 4. In addition the club head has a secondary alignment feature 1404 proximate the face but rearward of the primary alignment feature and delineated by a second paint or masking line which delineates the transition between the first portion of the crown having an area of contrasting shade or color with the shade or color of the face; and a second portion of the crown having an area of contrasting shade or color with the shade or color of the first portion. The secondary alignment feature a comprises an elongate side 1406 having a length of from about 0.5 inches to about 1.7 inches, and a second and third elongate side 1408*a* and 1408*b* extending back from the face and at an angle to elongate side 1406 and rearward of elongate side 1406.

The Sight Adjusted Perceived Face Angle Secondary Alignment Feature, ("$SAPFA_{SAF}$") of the secondary alignment feature constituting elongate side 1406 and the second and third elongate sides 1408*a* and 1408*b* may be measured by importing the image of the club head obtained as per the measurement for the SAPFA. Points 1410*b* and 1410*a* are selected which are the innermost ends of the radii connecting lines 1408*b* and 1408 *a* with elongate side 1406 as shown in FIG. 10B. A best fit quadratic line is then fit for the secondary alignment feature between point 1410 *a* and 1410*b* and then a datum 1412 is determined as the center point along the arc length of the best fit line, again as for the SAPFA measurement, two points at arc length between +/−0.25 mm from the datum were selected. A straight line is then drawn between these two points and a line perpendicular to this line is then drawn at the datum. The Sight Adjusted Perceived Face Angle Secondary Alignment Feature, ("$SAPFA_{SAF}$") is then measured as the angle between this perpendicular line and the y axis.

In some embodiments, the golf club heads of the present invention also have a Sight Adjusted Perceived Face Angle Secondary Alignment Feature, ("$SAPFA_{SAF}$") of from about −2 to about 6, more preferably of from 0 to about 5, even more preferably of from about 1.5 to about 4 degrees.

The primary and secondary alignment features as described herein typically utilize paint lines which demark the edge of an area of contrasting paint or shading of the crown relative to the color or shading of the face. Preferably the contrasting colors are white in the crown area and black in the face area. Typically painting or shading of golf club heads is performed at the time of manufacture and thus are fixed for the lifetime of the club absent some additional painting performed after purchase by the owner. It would be highly advantageous if the profile of the alignment feature could be adjusted by the user using a simple method which would allow adjustment of the perceived face angle by the user in response to the golfer's observed ball direction tendency on any given day.

In some embodiments of the golf club heads of the present invention the crown comprises a rotatable or otherwise movable portion, with one side of said portion including the edge of an area of contrasting paint or shading of the crown relative to the color or shading of the face or the color or shading of the second portion of the crown which can be rotated or moved sufficient to yield the desired Perceived Face Angle, PFA and/or Sight Adjusted Perceived Face Angle (SAPFA) and/or Sight Adjusted Perceived Face Angle Secondary Alignment Feature, ("$SAPFA_{SAF}$") to produce the desired ball flight. The movable portion of the crown is held in position by a fastening device such as a screw or bolt which is loosened to allow for rotation or movement and then subsequently tightened to fix the position of the crown after adjustment.

In addition to a portion of the crown being movable other embodiments include a movable layer or cover on top of the crown with one side of said movable layer or cover including the edge of an area of contrasting paint or shading of the crown relative to the color or shading of the face or the color or shading of the second portion of the crown which can be rotated or moved sufficient to yield the desired Perceived Face Angle, PFA and/or Sight Adjusted Perceived Face Angle (SAPFA) and/or Sight Adjusted Perceived Face Angle Secondary Alignment Feature, ("$SAPFA_{SAF}$"). The movable portion of the layer or cover is again held in position by a fastening device such as a screw or bolt or other fastening means which is loosened to allow for rotation or movement and then subsequently tightened to fix the position of the movable layer or cover after adjustment.

In other embodiments a portion of the crown may comprise electronic features which can be selectively activated to generate the required appearance including but not limited to light emitting diodes (LED), organic LED's (OLED), printed electronics with illumination devices, embedded electronics with illumination devices, electroluminescent devices, and so called quantum dots.

In other embodiments, a portion of the crown may comprise a coating that alters its characteristics when exposed to external conditions including but not limited to thermochromic coatings, photochromic coatings, electrochromic coatings and paramagnetic paint.

In one preferred embodiment, at least a portion of the crown of the golf club head or a layer covering at least a portion of the crown of the golf club head comprises an electronic graphic display. The display provides active color and graphic control for either the entire top portion of the crown or layer covering at least a portion of the crown or a portion thereof. The display may be constructed from flexible organic light-emitting diodes (OLED) displays, e-ink technology, digital fabrics, or other known means of active electronic color and graphic display means. For example, an organic light emitting diode (OLED) (e.g., a light emitting polymer (LEP), and organic electro luminescence (OEL)) is a light-emitting diode (LED) whose emissive electroluminescent layer is composed of a film of organic compounds. The layer usually contains a polymer substance that allows suitable organic compounds to be deposited in rows and columns onto a carrier substrate such as the at least a portion of the crown of the golf club head or a layer covering at least a portion of the crown of the golf club head, by a simple "printing" process. The resulting matrix of pixels can emit light of different colors.

In some embodiments, the at least a portion of the crown of the golf club head or a layer covering at least a portion of the crown of the golf club head is segmented into portions which may be controlled differently from each other. For example, one side of the alignment feature has a static surface color and the other side a second static and contrasting surface color display capability.

The display is operatively connected to a microprocessor disposed in the golf club head (e.g., via wires). The microprocessor is further operatively connected to a data port, for example a universal serial bus (USB) port (e.g., via wires). The data port allows transfer and retrieval of data to and from the microprocessor. Data ports and data transfer protocols are well known to one of ordinary skill in the art. The data port (USB port) may be disposed in the rearward area of the golf club head.

Data can be obtained from a variety of sources. In some embodiments, an Internet website is dedicated to support of the golf club head of the present invention. For example, the website may contain downloadable data and protocols (e.g., colors, color patterns, images, video content, logos, etc.) that can be uploaded into the microprocessor of the golf club head (via the data port, via a cable, via a computer). As an example, the website may have a gallery for choosing colors to be displayed, as well as patterns of the colors In some embodiments, data can be uploaded from other sources, for example DVDs, CDs, memory devices (e.g., flash memory), and the like. Sources may also include cellular phones, smart phones, personal digital assistants (PDAs), digital vending kiosks, and the like. In some embodiments, the data can be uploaded and downloaded via other mechanisms, for example wired or wireless mechanisms. Such mechanisms may include Bluetooth™, infrared datalink (IrDa), Wi-Fi, UWB, and the like.

In some embodiments, one or more control buttons are disposed on the golf club head allowing a user to manipulate the display as desired. The control buttons are operatively connected to the microprocessor. The microprocessor is configured to receive input signals from the control buttons and further send output commands to manipulate the. The control buttons may be operatively connected to the display and/or the microprocessor via one or more wires.

The microprocessor and/or display are operatively connected to a power source, for example a battery. The battery may be rechargeable. In some embodiments, the battery comprises a control means for turning on and off the device. All wires and data ports and other electronic systems are adapted to sustain the impact forces incurred when a golfer hits a golf ball with the golf club head.

In other embodiments of the golf club heads of the present invention a method to accomplish user adjustably of the alignment feature would involve at least a portion of the crown of the golf club head or a layer covering at least a portion of the crown of the golf club head being covered by a dielectric electroluminescent coating system using as one example the materials and methods as described in U.S. Pat. No. 6,926,972 by M. Jakobi et al., issuing on Aug. 9, 2005 and assigned to the BASF Corporation, the entire contents of which are incorporated by reference herein. Using this technology an electric current (provided by a small battery fixed securely in the golf club head cavity) could be selectively employed to use electroluminescence to highlight (or eliminate) a particular color thereby adjusting the alignment feature orientation.

In some embodiments, the golf club head may include sensors, such as described in U.S. patent application Ser. No. 15/996,854, filed Jun. 4, 2018, which is incorporated herein by reference. For example, the golf club may include one or more sensors for measuring swing speed, face angle, lie angle, tempo, swing path, face angle to swing path relationships, dynamic loft, and shaft lean. Other measurements may include back stroke time, forward stroke time, total stroke time, tempo, impact stroke speed, impact location, back stroke length, back stroke rotation, forward stroke rotation, rotation change, lie, and loft. Further measurements may include golf shot locations during play and golf shot distance data. Additional and different measurements may also be captured. The measurements may be captured during a full swing, short game, putting, or during other golf swings.

The one or more sensors may include motion sensors, accelerometers, gyro sensors, magnetometers, global positioning system (GPS) sensors, optical markers, or other sensors. The one or more sensors may be attached to the golf club head, integrated into a display of the golf club, attached to or integrated into the shaft of the golf club (e.g., proximate to the butt end of golf club grip, along the shaft, or at another location), housed within the golf club grip, and/or attached to or integrated into another portion of the golf club. In an embodiment, multiple sensors are provided on the golf club, such as at the same or different portions of the golf club. For example, a first sensor may be attached to or integrated into the golf club head and a second sensor housed within the grip of the golf club or attached to the golf club shaft. Additional and different multiple sensor arrangements may be used.

In an embodiment, a display or another electronic feature of the golf club may display one or more of the measured values on the crown or another portion of the golf club head. For example, the display or another electronic feature may be a removable display device, or may integrated into user device, such as a PDA, smart phone, iPhone, iPad, iPod, or other computing device. The one or more measured values may be displayed using an application running on the display device or using a device associated with the display or other electronic feature of the golf club head. In some embodiments, the sensors may be configured to communicate with an external device, such as a computing device (e.g., personal computer (PC), laptop computer, tablet, smart phone, cell phone, iPhone, iPad, Personal Digital Assistant (PDA), server computer, or another computing device), a launch monitor, a club fitting platform, or another device. In these embodiments, the one or more measured values may be displayed using an application running on the external device. In some embodiments, the one or more sensors interact with an external device, such as a video camera, to capture one or more measured values.

Referring back to FIG. 1B, a coordinate system for measuring a center of gravity (CG) location is located at the face center 205. In one embodiment, the positive x-axis 208 is projecting toward the heel side of the club head and the negative x-axis 208 is projecting toward the toe side of the golf club head. Further, the positive z-axis 206 is projecting toward the crown side of the club head and the negative z-axis 206 is projecting toward the sole side of the golf club head. Finally, the positive y-axis 209 is projecting toward the rear of the club head parallel to a ground plane.

In exemplary embodiments, a projected CG location on the striking face is considered the "sweet spot" of the club head. The projected CG location is found by balancing the clubhead on a point. The projected CG location is generally projected along a line that is perpendicular to the face of the club head. In some embodiments, the projected CGy (y-axis coordinate) location is less than 2 mm above the center face location, less than 1 mm above the center face, or up to 1 mm or 2 mm below the center face location 205. In some embodiments, the golf club head has a CG with a CGx (x-axis) coordinate between about −10 mm and about 10 mm from the center face location 205, a CGy between about 15 mm and about 50 mm, and a CGz (z-axis coordinate)

between about −10 mm and about 5 mm. In some embodiments, the CGy is between about 20 mm and about 50 mm.

The golf club head also has moments of inertia defined about three axes extending through the golf club head CG orientation, including: a CGz extending through the CG in a generally vertical direction relative to the ground plane when the club head is at address position, a CGx extending through the CG in a heel-to-toe direction generally parallel to the striking face 110 and generally perpendicular to the CGz, and a CGy extending through the CG in a front-to-back direction and generally perpendicular to the CGx and the CGz. The CGx and the CGy both extend in a generally horizontal direction relative to the ground plane when the club head 100 is at the address position.

The moment of inertia about the golf club head CGx is calculated by the following equation:

$$I_{CGx}=\int(y+z^2)dm$$

In the above equation, y is the distance from a golf club head CG xz-plane to an infinitesimal mass dm and z is the distance from a golf club head CG xy-plane to the infinitesimal mass dm. The golf club head CG xz-plane is a plane defined by the CGx and the CGz. The CG xy-plane is a plane defined by the CGx and the CGy.

The moment of inertia about the golf club head CGy is calculated by the following equation:

$$I_{CGx}=\int(x^2+z^2)dm$$

In the above equation, x is the distance from a golf club head CG yz-plane to an infinitesimal mass dm and z is the distance from a golf club head CG xy-plane to the infinitesimal mass dm. The golf club head CG yz-plane is a plane defined by the CGy and the CGz. The CG yx-plane is a plane defined by the CGy and the CGx.

Moreover, a moment of inertia about the golf club head CGz is calculated by the following equation:

$$I_{CGz}=\int(x^2+y^2)dm$$

In the equation above, x is the distance from a golf club head CG yz-plane to an infinitesimal mass dm and y is the distance from the golf club head CG xz-plane to the infinitesimal mass dm. The golf club head CG yz-plane is a plane defined by the CGy and the CGz.

In certain implementations, the club head can have a moment of inertia about the CGz between about 450 kg·mm$^2$ and about 650 kg·mm$^2$, and a moment of inertia about the CGx between about 300 kg·mm$^2$ and about 500 kg·mm$^2$, and a moment of inertia about the CGy between about 300 kg·mm$^2$ and about 500 kg·mm$^2$.

For a variety of reasons, it may be advantageous to orient the center of gravity (CG) of the golf club head toward the toe. For example, users often strike the golf ball high (e.g., +3 to +4 mm on the z-axis) and toeward (e.g., −5 to −7 mm on the x-axis) on the striking face. Striking the ball off-center (i.e., in a location different from the projected CG location on the striking face) generally decreases ball-speed, and as a result, decreases the distance traveled by the golf ball.

Further, as discussed above, striking the face toeward also produces a gear effect, producing hook spin. Increasing the negative CGx orientation (i.e., from −2 to −10 mm on the x-axis) may alter the gear effect by decreasing the counter-clockwise spin (i.e., for a right-handed golfer) which ultimately results in the golf ball curving to the left.

Additionally, in order to maximize the moment of inertia (MOI) about a z-axis extending through the CGz, a negative CGx orientation may be provided. Working in conjunction with the weight of the hosel of the golf club, a negative CGx orientation allows for greater MOI about the z-axis by strategically distributing club head weight on the x-axis at corresponding positive and negative orientations.

Alternatively, it may be advantageous to orient the CG of the golf club head toward the heel. For example, by increasing positive CGx orientation (i.e., from +2 mm to 0 mm on the x-axis), the club head may close faster (i.e., at 400-500 rpm), increasing local club head speed and producing more ball-speed, and as a result, increasing the distance traveled by the golf ball.

In certain implementations, the golf club head can have a CGx between about +2 and about −10 mm. For example, the CGx for a golf club head with adjustable weights (discussed below) is between about −3 mm to about −4 mm. In certain implementations, the club head can have a low CGz of less than 0, such as between 0 and about −4 mm. In certain implementations, the club head can have a CGz positioned below a geometric center of the face. In certain implementations, the club head can have a moment of inertia about the CGz (also referred to as "Izz") above 400 kg·mm$^2$, above 460 kg·mm$^2$ or above 480 kg·mm$^2$. A moment of inertia about the CGx (also referred to as "Ixx") can be above 300 kg·mm$^2$. The moments of inertia of the golf club head can also be expressed as a ratio, such as a ratio of Ixx to Izz. For example, in some embodiments, a ratio of Ixx to Izz is at most 0.6, or 60%. In an example, the golf club head can have an Ixx above 300 kg·mm$^2$ and an Izz above 500 kg·mm$^2$, such that Ixx/Izz is less than or equal to 0.6. In another example, the Ixx is greater than 280 kg·mm$^2$ and the Izz is greater than 465 kg·mm$^2$.

In certain implementations, the golf club head can have a Zup less than 30 mm. For example, above ground, an alternative club head coordinate system places the head origin at the intersection of the z-axis and the ground plane, providing positive z-axis coordinates for every club head feature. As used herein, "Zup" means the CG z-axis location determined according to this above ground coordinate system. Zup generally refers to the height of the CG above the ground plane as measured along the z-axis.

In certain implementations, the golf club head can have a Delta 1 (i.e., measure of how far rearward in the golf club head body the CG is located) greater than 20, such as greater than 26 in certain implementations. More specifically, Delta 1 is the distance between the CG and the hosel axis along the y axis (in the direction straight toward the back of the body of the golf club face from the geometric center of the striking face). It has been observed that smaller values of Delta 1 result in lower projected CGs on the golf club head face. Thus, for embodiments of the disclosed golf club heads in which the projected CG on the ball striking club face is lower than the geometric center, reducing Delta 1 can lower the projected CG and increase the distance between the geometric center and the projected CG. Note also that a lower projected CG can promote a higher launch and a reduction in backspin due to the z-axis gear effect. Thus, for particular embodiments of the disclosed golf club heads, in some cases the Delta 1 values are relatively low, thereby reducing the amount of backspin on the golf ball helping the golf ball obtain the desired high launch, low spin trajectory.

The United States Golf Association (USGA) regulations constrain golf club head shapes, sizes, and moments of inertia. Due to these constraints, golf club manufacturers and designers struggle to produce golf club heads having maximum size and moment of inertia characteristics while maintaining all other golf club head characteristics. For example, one such constraint is a volume limitation of 460 cm$^3$. In general, volume is measured using the water displacement method. However, the USGA will fill any significant cavities in the sole or series of cavities which have a collective volume of greater than 15 $cm^3$.

In some embodiments, as in the case of a fairway wood, the golf club head may have a volume between about 100 $cm^3$ and about 300 $cm^3$, such as between about 150 $cm^3$ and about 250 $cm^3$, or between about 130 $cm^3$ and about 190 $cm^3$, or between about 125 $cm^3$ and about 240 $cm^3$, and a total mass between about 125 g and about 260 g, or between about 200 g and about 250 g. In the case of a utility or hybrid club, the golf club head may have a volume between about 60 $cm^3$ and about 150 $cm^3$, or between about 85 $cm^3$ and about 120 $cm^3$, and a total mass between about 125 g and about 280 g, or between about 200 g and about 250 g. In the case of a driver, the golf club head may have a volume between about 300 $cm^3$ and about 600 $cm^3$, between about 350 $cm^3$ and about 600 $cm^3$, and/or between about 350 $cm^3$ and about 500 $cm^3$, and can have a total mass between about 145 g and about 1060 g, such as between about 195 g and about 205 g.

Historically, $CG_x$ locations were heelward about 4-6 mm. More recently, $CG_x$ locations have been moved toeward to about −1 mm. $CG_x$ locations will likely continue to be toeward, such as in the example $CG_x$ locations described in U.S. patent application Ser. No. 16/171,237, filed Oct. 25, 2018, which is incorporated herein by reference. For example, club head has a center of gravity (CG), the location of which may be defined in terms of the coordinate system described above and shown in FIGS. 1A, 1B and 1D, and in some embodiments, the club head has a $CG_x$ toeward of center face as, for example, no more than −2 mm toeward. In some embodiments the club head has a $CG_x$ of 0 to −4 mm. In some embodiments the club head has a moment of inertia about the z-axis (Izz) of 480 to 600 $Kg{\cdot}mm^2$ or in some embodiments greater than 490 $Kg{\cdot}mm^2$, a moment of inertia about the x-axis (Ixx) of about 280 to 420 $Kg{\cdot}mm^2$ or in some embodiments greater than 280 $Kg{\cdot}mm^2$.

There are a variety of ways to position the CG orientations of the golf club head. For example, in some embodiments, a composite crown and/or sole is provided to help overcome manufacturing challenges associated with conventional golf club heads having normal continuous crowns made of titanium or other metals, and can replace a relatively heavy component of the crown with a lighter material, freeing up discretionary mass which can be strategically allocated elsewhere within the golf club head. In certain embodiments, the crown may comprise a composite material, such as those described herein and in the incorporated disclosures, having a density of less than 2 grams per cubic centimeter. In still further embodiments, the composite material has a density of no more than 1.5 grams per cubic centimeter, or a density between 1 gram per cubic centimeter and 2 grams per cubic centimeter. Providing a lighter crown further provides the golf club head with additional discretionary mass, which can be used elsewhere within the golf club head to serve the purposes of the designer. For example, with the discretionary mass, additional weight can be strategically added to the hollow interior of the golf club head, or strategically located on the exterior of the golf club head, to shift the effective CG fore or aft, toeward or heelward or both (apart from any further CG adjustments made possible by adjustable weight features), and/or to improve desirable MOI characteristics, as described above.

In some embodiments, the crown and/or sole may be formed in whole or in part from a composite material, such as a carbon composite, made of a composite including multiple plies or layers of a fibrous material (e.g., graphite, or carbon fiber including turbostratic or graphitic carbon fiber or a hybrid structure with both graphitic and turbostratic parts present. Examples of some of these composite materials for use in the metalwood golf clubs and their fabrication procedures are described in U.S. patent application Ser. No. 10/442,348 (now U.S. Pat. No. 7,267,620), Ser. No. 10/831,496 (now U.S. Pat. No. 7,140,974), Ser. Nos. 11/642,310, 11/825,138, 11/998,436, 11/895,195, 11/823,638, 12/004,386, 12/004,387, 11/960,609, 11/960,610, and 12/156,947, which are incorporated herein by reference.

Alternatively, the crown and/or sole may be formed from short or long fiber-reinforced formulations of the previously referenced polymers. Exemplary formulations include a Nylon 6/6 polyamide formulation which is 30% Carbon Fiber Filled and available commercially from RTP Company under the trade name RTP 285. The material has a Tensile Strength of 35000 psi (241 MPa) as measured by ASTM D 638; a Tensile Elongation of 2.0-3.0% as measured by ASTM D 638; a Tensile Modulus of $3.30{\times}10^6$ psi (22754 Mpa) as measured by ASTM D 638; a Flexural Strength of 50000 psi (345 Mpa) as measured by ASTM D 790; and a Flexural Modulus of $2.60{\times}10^6$ psi (17927 Mpa) as measured by ASTM D 790.

Also included is a polyphthalamide (PPA) formulation which is 40% Carbon Fiber Filled and available commercially from RTP Company under the trade name RTP 4087 UP. This material has a Tensile Strength of 360 Mpa as measured by ISO 527; a Tensile Elongation of 1.4% as measured by ISO 527; a Tensile Modulus of 41500 Mpa as measured by ISO 527; a Flexural Strength of 580 Mpa as measured by ISO 178; and a Flexural Modulus of 34500 Mpa as measured by ISO 178.

Also included is a polyphenylene sulfide (PPS) formulation which is 30% Carbon Fiber Filled and available commercially from RTP Company under the trade name RTP 1385 UP. This material has a Tensile Strength of 255 Mpa as measured by ISO 527; a Tensile Elongation of 1.3% as measured by ISO 527; a Tensile Modulus of 28500 Mpa as measured by ISO 527; a Flexural Strength of 385 Mpa as measured by ISO 178; and a Flexural Modulus of 23,000 Mpa as measured by ISO 178.

In other embodiments, the crown and/or sole is formed as a two layered structure comprising an injection molded inner layer and an outer layer comprising a thermoplastic composite laminate. The injection molded inner layer may be prepared from the thermoplastic polymers, with preferred materials including a polyamide (PA), or thermoplastic urethane (TPU) or a polyphenylene sulfide (PPS). Typically the thermoplastic composite laminate structures used to prepare the outer layer are continuous fiber reinforced thermoplastic resins. The continuous fibers include glass fibers (both roving glass and filament glass) as well as aramid fibers and carbon fibers. The thermoplastic resins which are impregnated into these fibers to make the laminate materials include polyamides (including but not limited to PA, PA6, PA12 and PA6), polypropylene (PP), thermoplastic polyurethane or polyureas (TPU) and polyphenylene sulfide (PPS).

The laminates may be formed in a continuous process in which the thermoplastic matrix polymer and the individual fiber structure layers are fused together under high pressure into a single consolidated laminate, which can vary in both the number of layers fused to form the final laminate and the thickness of the final laminate. Typically the laminate sheets are consolidated in a double-belt laminating press, resulting in products with less than 2 percent void content and fiber volumes ranging anywhere between 35 and 55 percent, in thicknesses as thin as 0.5 mm to as thick as 6.0 mm, and may include up to 20 layers. Further information on the structure and method of preparation of such laminate structures is disclosed in European patent No. EP1923420B1 issued on Feb. 25, 2009 to Bond Laminates GMBH, the entire contents of which are incorporated by reference herein.

The composite laminates structure of the outer layer may also be formed from the TEPEX® family of resin laminates available from Bond Laminates which preferred examples are TEPEX® dynalite 201, a PA66 polyamide formulation with reinforcing carbon fiber, which has a density of 1.4 g/cm$^3$, a fiber content of 45 vol %, a Tensile Strength of 785 MPa as measured by ASTM D 638; a Tensile Modulus of 53 GPa as measured by ASTM D 638; a Flexural Strength of 760 MPa as measured by ASTM D 790; and a Flexural Modulus of 45 GPa) as measured by ASTM D 790.

Another preferred example is TEPEX® dynalite 208, a thermoplastic polyurethane (TPU)-based formulation with reinforcing carbon fiber, which has a density of 1.5 g/cm$^3$, a fiber content of, 45 vol %, a Tensile Strength of 710 MPa as measured by ASTM D 638; a Tensile Modulus of 48 GPa as measured by ASTM D 638; a Flexural Strength of 745 MPa as measured by ASTM D 790; and a Flexural Modulus of 41 GPa as measured by ASTM D 790.

Another preferred example is TEPEX® dynalite 207, a polyphenylene sulfide (PPS)-based formulation with reinforcing carbon fiber, which has a density of 1.6 g/cm$^3$, a fiber content of 45 vol %, a Tensile Strength of 710 MPa as measured by ASTM D 638; a Tensile Modulus of 55 GPa as measured by ASTM D 638; a Flexural Strength of 650 MPa as measured by ASTM D 790; and a Flexural Modulus of 40 GPa as measured by ASTM D 790.

There are various ways in which the multilayered composite crown may be formed. In some embodiments the outer layer, is formed separately and discretely from the forming of the injection molded inner layer. The outer layer may be formed using known techniques for shaping thermoplastic composite laminates into parts including but not limited to compression molding or rubber and matched metal press forming or diaphragm forming.

The inner layer may be injection molded using conventional techniques and secured to the outer crown layer by bonding methods known in the art including but not limited to adhesive bonding, including gluing, welding (preferable welding processes are ultrasonic welding, hot element welding, vibration welding, rotary friction welding or high frequency welding (Plastics Handbook, Vol. 3/4, pages 106-107, Carl Hanser Verlag Munich & Vienna 1998)) or calendaring or mechanical fastening including riveting, or threaded interactions.

Before the inner layer is secured to the outer layer, the outer surface of the inner layer and/or the inner of the outer layer may be pretreated by means of one or more of the following processes (disclosed in more detail in Ehrenstein, "Handbuch Kunststoff-Verbindungstechnik", Carl Hanser Verlag Munich 2004, pages 494-504):

Mechanical treatment, preferably by brushing or grinding,

Cleaning with liquids, preferably with aqueous solutions or organics solvents for removal of surface deposits Flame treatment, preferably with propane gas, natural gas, town gas or butane Corona treatment (potential-loaded atmospheric pressure plasma)

Potential-free atmospheric pressure plasma treatment

Low pressure plasma treatment (air and $O_2$ atmosphere)

UV light treatment

Chemical pretreatment, e.g. by wet chemistry by gas phase pretreatment

Primers and coupling agents

In an especially preferred method of preparation a so called hybrid molding process may be used in which the composite laminate outer layer is insert molded to the injection molded inner layer to provide additional strength. Typically the composite laminate structure is introduced into an injection mold as a heated flat sheet or, preferably, as a preformed part. During injection molding, the thermoplastic material of the inner layer is then molded to the inner surface of the composite laminate structure the materials fuse together to form the crown as a highly integrated part. Typically the injection molded inner layer is prepared from the same polymer family as the matrix material used in the formation of the composite laminate structures used to form the outer layer so as to ensure a good weld bond.

In addition to being formed in the desired shape for the aft body of the club head, a thermoplastic inner layer may also be formed with additional features including one or more stiffening ribs to impart strength and/or desirable acoustical properties as well as one or more weight ports to allow placement of additional tungsten (or other metal) weights.

The thickness of the inner layer is typically of from about 0.25 to about 2 mm, preferably of from about 0.5 to about 1.25 mm.

The thickness of the composite laminate structure used to form the outer layer, is typically of from about 0.25 to about 2 mm, preferably of from about 0.5 to about 1.25 mm, even more preferably from 0.5 to 1 mm.

As described in detail in U.S. Pat. No. 6,623,378, filed Jun. 11, 2001, entitled "METHOD FOR MANUFACTURING AND GOLF CLUB HEAD" and incorporated by reference herein in its entirety, the crown or outer shell (or sole) may be made of a composite material, such as, for example, a carbon fiber reinforced epoxy, carbon fiber reinforced polymer, or a polymer. Furthermore, U.S. patent application Ser. No. 12/974,437 (now U.S. Pat. No. 8,608,591) describes golf club heads with lightweight crowns and soles.

Composite materials used to construct the crown and/or sole should exhibit high strength and rigidity over a broad temperature range as well as good wear and abrasion behavior and be resistant to stress cracking. Such properties include, a) a Tensile Strength at room temperature of from about 7 ksi to about 330 ksi, preferably of from about 8 ksi to about 305 ksi, more preferably of from about 200 ksi to about 300 ksi, even more preferably of from about 250 ksi to about 300 ksi (as measured by ASTM D 638 and/or ASTM D 3039);

b) a Tensile Modulus at room temperature of from about 0.4 Msi to about 23 Msi, preferably of from about 0.46 Msi to about 21 Msi, more preferably of from about 0.46 Msi to about 19 Msi (as measured by ASTM D 638 and/or ASTM D 3039);

c) a Flexural Strength at room temperature of from about 13 ksi to about 300 ksi, from about 14 ksi to about 290 ksi, more preferably of from about 50 ksi to about 285 ksi, even more preferably of from about 100 ksi to about 280 ksi (as measured by ASTM D 790);

d) a Flexural Modulus at room temperature of from about 0.4 Msi to about 21 Msi, from about 0.5 Msi to about 20 Msi, more preferably of from about 10 Msi to about 19 Msi (as measured by ASTM D 790);

Composite materials that are useful for making club-head components comprise a fiber portion and a resin portion. In general the resin portion serves as a "matrix" in which the fibers are embedded in a defined manner. In a composite for club-heads, the fiber portion is configured as multiple fibrous layers or plies that are impregnated with the resin component. The fibers in each layer have a respective orientation, which is typically different from one layer to the next and precisely controlled. The usual number of layers for a striking face is substantial, e.g., forty or more. However for a sole or crown, the number of layers can be substantially decreased to, e.g., three or more, four or more, five or more, six or more, examples of which will be provided below. During fabrication of the composite material, the layers (each comprising respectively oriented fibers impregnated in uncured or partially cured resin; each such layer being called a "prepreg" layer) are placed superposedly in a "lay-up" manner. After forming the prepreg lay-up, the resin is cured to a rigid condition. If interested a specific strength may be calculated by dividing the tensile strength by the density of the material. This is also known as the strength-to-weight ratio or strength/weight ratio.

In tests involving certain club-head configurations, composite portions formed of prepreg plies having a relatively low fiber areal weight (FAW) have been found to provide superior attributes in several areas, such as impact resistance, durability, and overall club performance. (FAW is the weight of the fiber portion of a given quantity of prepreg, in units of $g/m^2$.) FAW values below 100 $g/m^2$, and more desirably below 70 $g/m^2$, can be particularly effective. A particularly suitable fibrous material for use in making prepreg plies is carbon fiber, as noted. More than one fibrous material can be used. In other embodiments, however, prepreg plies having FAW values below 70 $g/m^2$ and above 100 $g/m^2$ may be used. Generally, cost is the primary prohibitive factor in prepreg plies having FAW values below 70 $g/m^2$.

In particular embodiments, multiple low-FAW prepreg plies can be stacked and still have a relatively uniform distribution of fiber across the thickness of the stacked plies. In contrast, at comparable resin-content (R/C, in units of percent) levels, stacked plies of prepreg materials having a higher FAW tend to have more significant resin-rich regions, particularly at the interfaces of adjacent plies, than stacked plies of low-FAW materials. Resin-rich regions tend to reduce the efficacy of the fiber reinforcement, particularly since the force resulting from golf-ball impact is generally transverse to the orientation of the fibers of the fiber reinforcement. The prepreg plies used to form the panels desirably comprise carbon fibers impregnated with a suitable resin, such as epoxy. An example carbon fiber is "34-700" carbon fiber (available from Grafil, Sacramento, Calif.), having a tensile modulus of 234 Gpa (34 Msi) and a tensile strength of 4500 Mpa (650 Ksi). Another Grafil fiber that can be used is "TR50S" carbon fiber, which has a tensile modulus of 240 Gpa (35 Msi) and a tensile strength of 4900 Mpa (710 ksi). Suitable epoxy resins are types "301" and "350" (available from Newport Adhesives and Composites, Irvine, Calif.). An exemplary resin content (R/C) is between 33% and 40%, preferably between 35% and 40%, more preferably between 36% and 38%.

Each of the golf club heads discussed throughout this application may include a separate crown, sole, and/or face that may be a composite, such as, for example, a carbon fiber reinforced epoxy, carbon fiber reinforced polymer, or a polymer crown, sole and/or face.

In some embodiments, the CGx, CGy and CGz orientations of the golf club head may be adjustable. For example, in an embodiment, the golf club head is provided with one or more adjustable weight features, such as weight ports, tracks, and/or slots in conjunction with one or more adjustable weights located in the weight port(s), track(s), and/or slot(s). For example, U.S. Pat. No. 9,868,036, which is incorporated herein by reference, describes weight tracks with slidable weights for adjusting the CG orientations of the golf club head. Other adjustable weight features may be used to adjust the CG orientations.

In some embodiments, the CGx, CGy and CGz orientations of the golf club head are positioned in conjunction with the aerodynamic properties of the golf club head. In some implementations, aerodynamic drag forces on the golf club head are reduced by the shape of the striking face. For example, aerodynamic drag forces can be reduced by providing a striking face that is shorter along the positive x-axis 208 projecting toward the heel side of the club head and taller on the negative x-axis 208 is projecting toward the toe side of the golf club head. In other words, the striking face may be provided with bulge oriented in the portion of the face in the negative x-axis. For example, as discussed below, the golf club head may have a crown height to face height ratio of at least 1.12. As a result of this configuration, more material and mass is provided along the negative x-axis of the striking face than along the positive x-axis, which may orient the CGx on the negative x-axis. This aerodynamic shape tends to move CGx toeward naturally.

In addition to the features described above, additional aerodynamic shapes are described in U.S. Pat. Nos. 8,858,359 and 9,861,864. For example, various properties may be modified to improve the aerodynamic aspects of the golf club head. In various embodiments, the volume of the golf club head may be 430 cc to 500 cc. In various embodiments, there may be no inversions, indentations, or concave shaping elements on the crown of the golf club head, and, as such, the crown remains convex over its body, although the curvature of the crown may be variable in various embodiments.

For example, in an embodiment, the golf club head a face height of about 59.1 mm and a crown height of about 69.4 mm. As can be seen, a ratio of the crown height to the face height is 69.4/59.1, or about 1.17. In other embodiments, the golf club head may have a crown height to face height ratio of at least 1.12. Other crown height to face height ratios may be used. For example, a face height of about 58.7 mm may be provided in an embodiment. The corresponding crown height is about 69.4 mm in the current embodiment. A ratio of the crown height to the face height is 69.4/58.7, or about 1.18. Alternatively, a face height of about 58.7 mm may be provided in another embodiment. The crown height is about 69.4 mm in the current embodiment. A ratio of the crown height to the face height is 69.4/58.7, or about 1.18. As such, the ratio of crown height to face height may be between about 1 and about 2, depending on the embodiment.

In another example, the golf club head may have a minimum and/or a maximum face area. For example, the larger the face area, the more drag is produced (i.e., lowers aerodynamic features of the golf club head. In addition to aerodynamic features, the minimum and/or maximum face areas may be dictated by other golf club head properties, such as mass savings and ball speed benefits. Accordingly, in one embodiment, the golf club head has a minimum face area of 3300 $mm^2$. In other embodiments, the golf club head has a face area between about 3700 $mm^2$ and about 4000 $mm^2$. In other embodiments, the golf club head has a face area between about 3500 $mm^2$ and about 4200 $mm^2$. In other embodiments, the golf club head has a face area between about 4100 $mm^2$ and about 4400 $mm^2$, preferably between 4200 $mm^2$ and 4300 $mm^2$. In yet another embodiment, the golf club head has a maximum face area of about 4500 $mm^2$. Other face areas may be used.

In some implementations, discretionary mass is strategically positioned at an angle with respect to the striking face 110, such as in the same plane as the golf club head as the club is designed to travel on the downswing. In some embodiments, the discretionary mass is strategically provided low (along the negative z-axis), rearward (along the positive y-axis 209), and toeward (along the negative x-axis 208), orienting the mass in the location where air is flowing, thereby reducing aerodynamic drag forces and orienting CGx on the negative x-axis.

Examples of strategically positioned discretionary masses are described in U.S. provisional patent application Ser. No. 62/755,319, which is incorporated herein by reference. For example, as illustrated in FIGS. 12, 13, 14A, 15-19, golf club head 300 comprises an inertia generator 360, which may comprise an elongate center sole portion 362 that extends in a generally Y-direction—though as illustrated, and as further described below, is also angled toewardly—from a position proximate the golf club head center of gravity 350 to the rear portion of the body.

In one or more embodiments, golf club head 300 includes a hollow body 310 defining a crown portion 312, a sole portion 314, a skirt portion 316, and a striking surface 318. The striking surface 318 can be integrally formed with the body 310 or attached to the body. The body 310 further includes a hosel 320, which defines a hosel bore 324 adapted to receive a golf club shaft. The body 310 further includes a heel portion 326, a toe portion 328, a front portion 330, and a rear portion 332. Included are a number of features that may improve playability, including at least an inertia generator 360, front channel 390, a slot or channel insert 395, one or more front channel support ribs 396, an additional rib 397 that connects to front channel support ribs 396, as well as composite panels on the sole 344, 348 and on the crown 335, along with discretionary mass elements and other additional features, as will be further described herein. The front channel 390 may have a certain length L (which may be measured as the distance between its toeward end and heelward end), width W (e.g., the measurement from a forward edge to a rearward edge of the front channel 390), and offset distance OS from the front end, or striking surface 318 (e.g., the distance between the face 318 and the forward edge of front channel 390. During development, it was discovered that the COR feature length L and the offset distance OS from the face play an important role in managing the stress which impacts durability, the sound or first mode frequency of the club head, and the COR value of the club head. All of these parameters play an important role in the overall club head performance and user perception.

Figure 12:
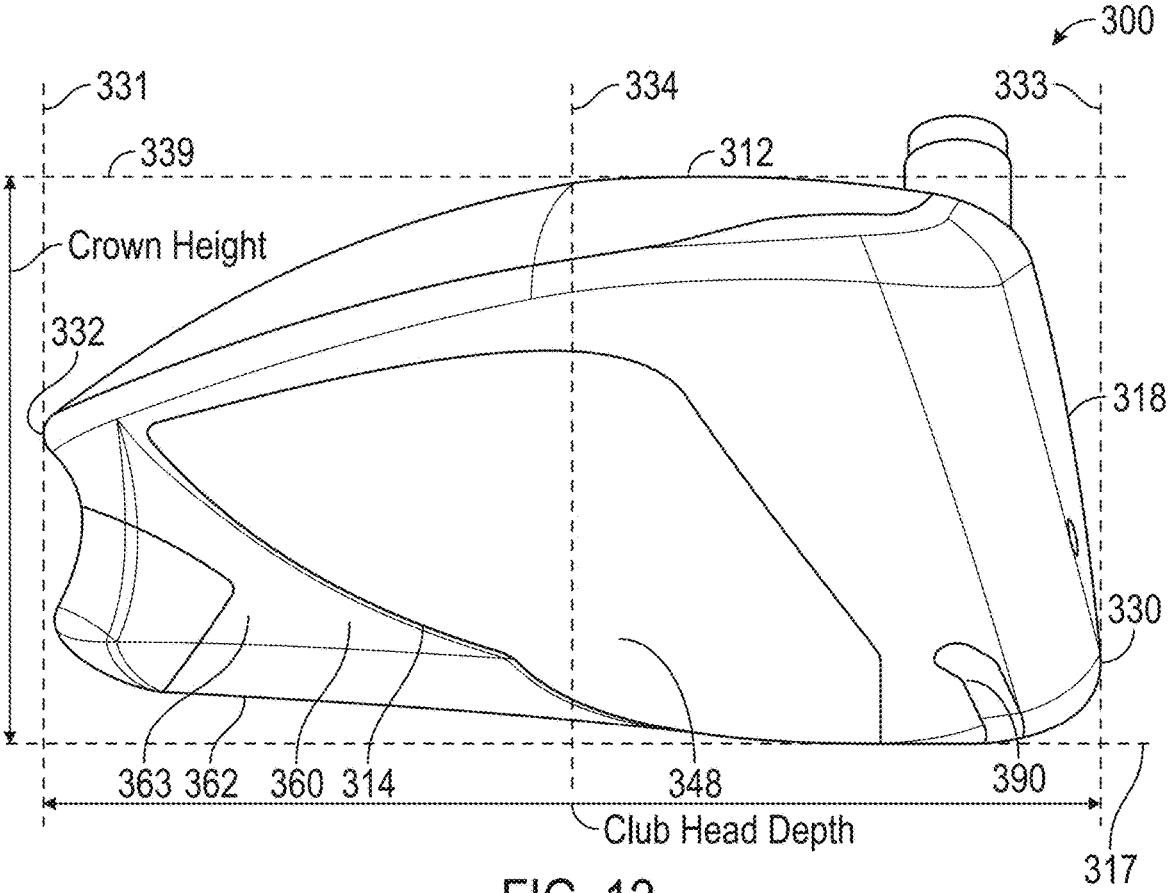
FIG. 12 is a side elevation view from a toe side of a golf club head in accord with one embodiment of the current disclosure.
Figure 13:
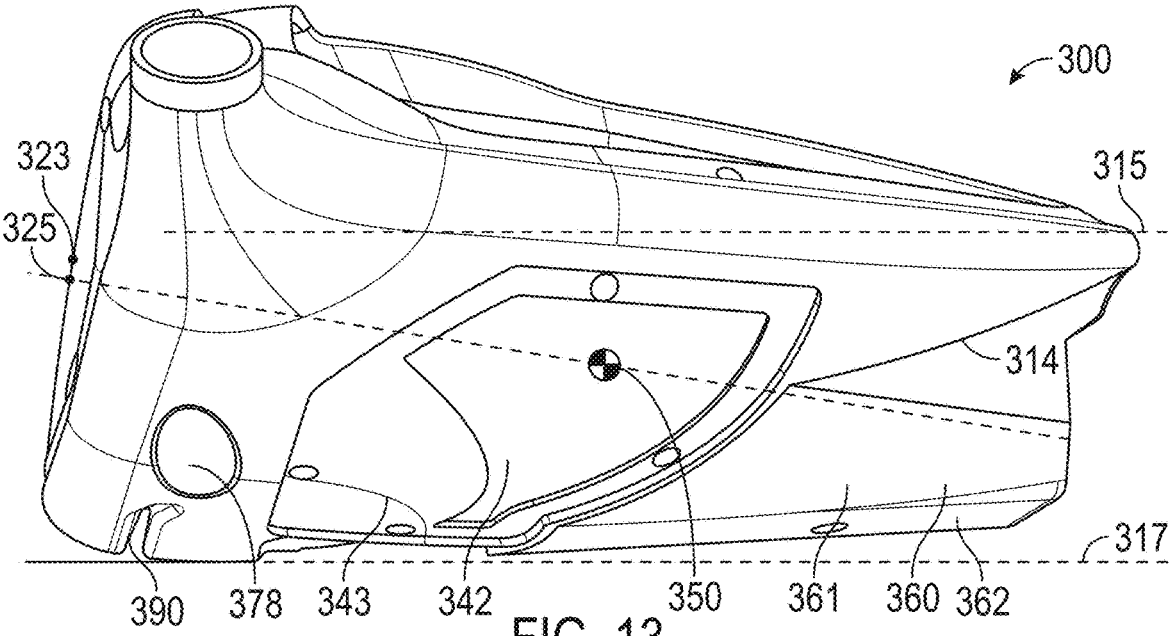
FIG. 13 is a side elevation view from a heel side of a golf club head in accord with one embodiment of the current disclosure, with sole and crown inserts removed.

A front plane 333 that extends from a forwardmost point of the golf club head, and a rear plane 331 that extends from a rearward most point of the golf club head. Each of these planes extends from its respective point and is perpendicular to the ground plane 317. Together, the planes may be used to measure the front to back depth of the golf club head ("club head depth"), as illustrated in FIG. 12. A midpoint plane 334 extends perpendicular to the ground plane 317 halfway between the front plane 333 and the rear plane 331. As illustrated in FIG. 13, a center 323 is disposed on the striking surface 318. Also shown on the face is the projected CG point 325. Golf club head 300 also has a skirt height 315, which may measure the lowest point above the ground plane at which the skirt meets the crown. In some embodiments, the skirt height 315 may be between 25 mm and 40 mm, such as between 30 mm and 40 mm, or between 30 mm and 35 mm.

Figure 14A:
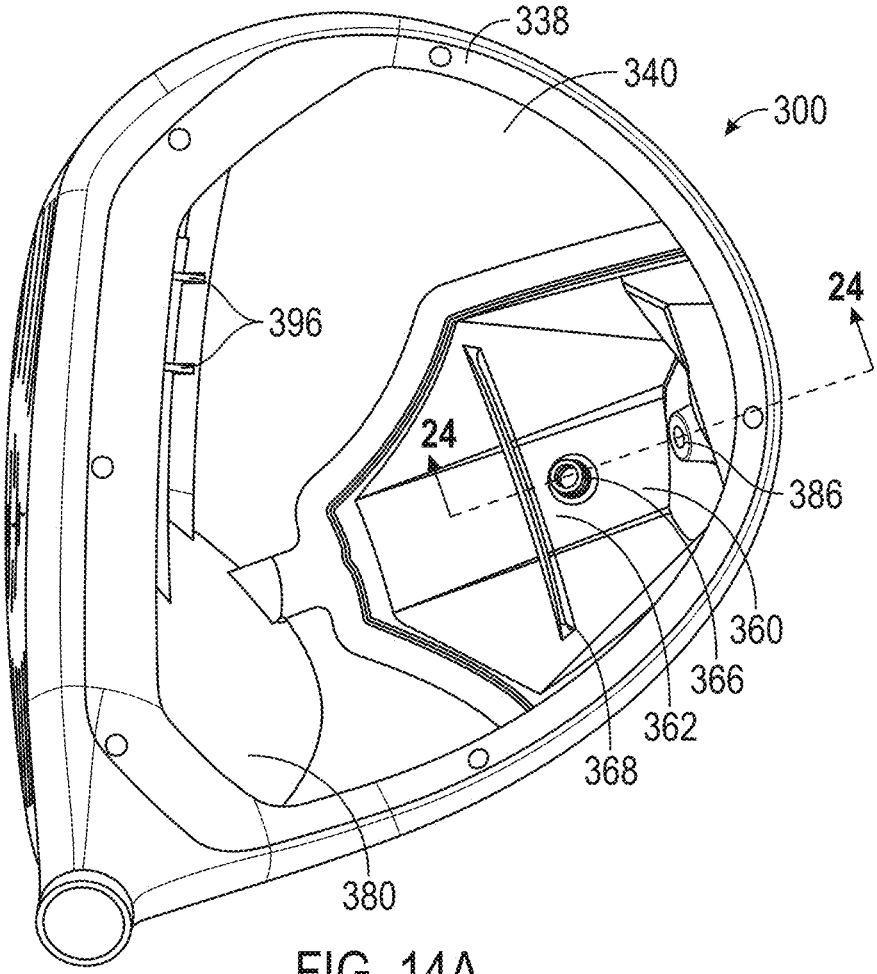
FIG. 14A is a top view of a golf club head in accord with one embodiment of the current disclosure, with a crown insert removed.
Figure 14B:
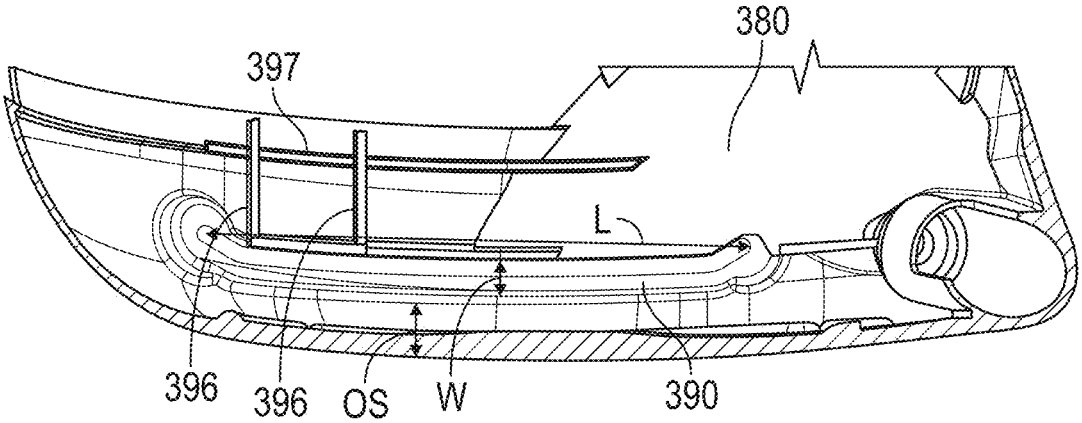
FIG. 14B is a top cross-sectional view of a front portion of a golf club head in accord with one embodiment of the current disclosure.
Figure 15:
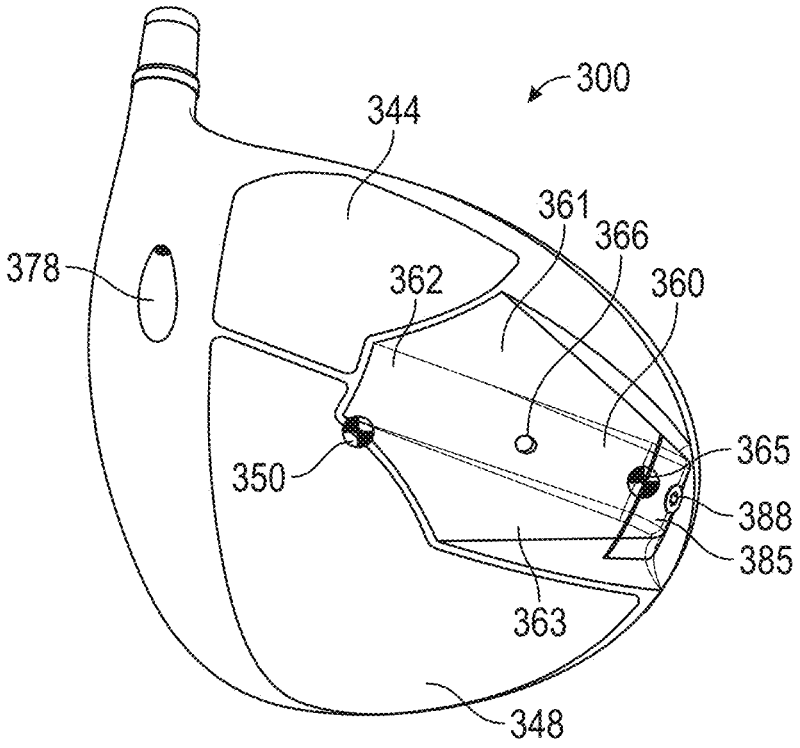
FIG. 15 is a bottom perspective view of a golf club head in accord with one embodiment of the current disclosure.
Figure 16:
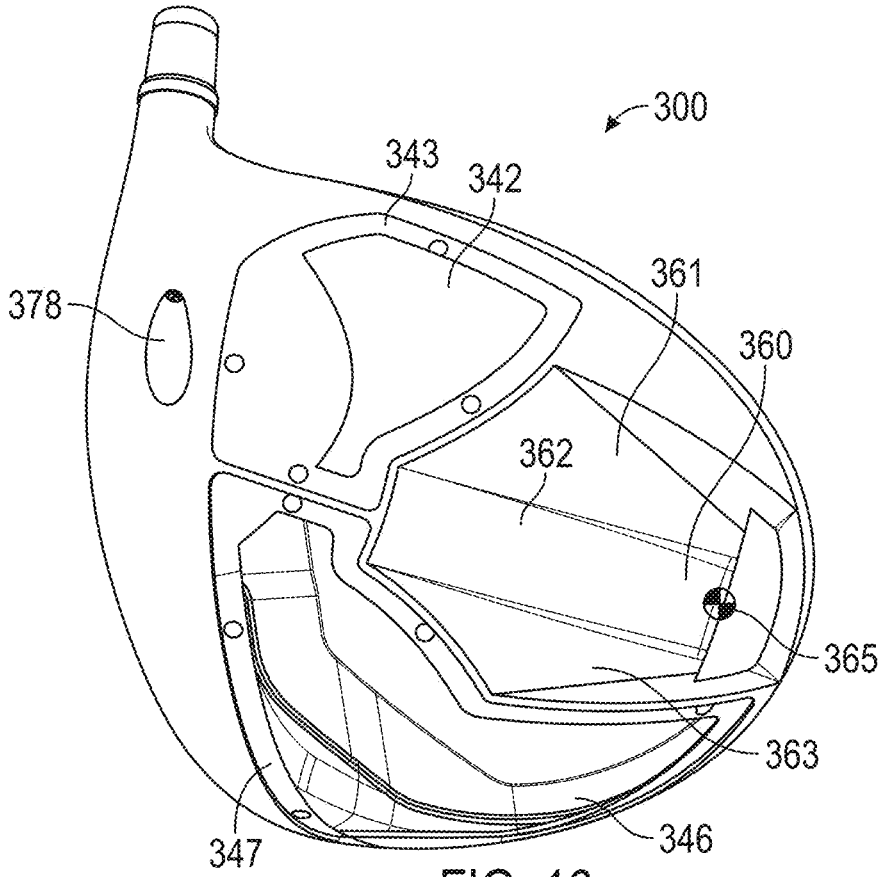
FIG. 16 is a bottom perspective view of a golf club head in accord with one embodiment of the current disclosure, with two sole inserts removed.

As best illustrated in FIGS. 12 and 13, the center sole portion 362 comprises an elongate and substantially planar surface that is closer to the ground plane 317 than the surrounding portions of the sole 314 that are toeward and heelward of the inertia generator 360. In certain embodiments, the inertia generator 360 is angled so that a rear end of the inertia generator is toeward of a front end. An angle of the inertia generator relative to the y-axis may be in the range of 10 to 25 degrees, such as between 15 and 25 degrees, such as between 17 and 22 degrees. As illustrated in FIGS. 14A and 15, an aperture 366 may be provided within the center sole portion 362, which aperture may be used for introducing hot melt into the inner cavity of the golf club head. Also provided is an inertia generator support rib 368, which may run along the inside of the golf club head under inertia generator 360. A cross-section of the inertia generator may be taken along line 24-24. Inertia generator support rib 368 may not only help provide structural support for the inertia generator, it may also help constrain any hot melt that is injected using aperture 366.

As best illustrated in FIGS. 12 and 15, the inertia generator further comprises a heelward sole surface 361 and a toeward sole surface 363 that slope upwardly from the center sole portion 362 to the sole 314 when viewed in the normal address position. The heelward sole surface 361 may have a generally triangular shape, with: a base that faces generally forward and heelward (and may be substantially parallel to the heel sole insert 344, a first edge adjacent the center sole portion 362 that extends rearwardly from the toeward end of the base generally parallel to the center sole portion, and a second edge that extends from the heelward end of the base at a position on the sole 314 to a position that is "raised up" from the sole at or proximate to the heelward side of the center sole portion 362 at the rear 332 of the golf club head. The toeward sole surface 363 may likewise have a generally triangular shape, with: a base that faces generally forward and toeward (and may be substantially parallel to the toe sole insert 348, a first edge adjacent the center sole portion 362 that extends rearwardly from the heelward end of the base generally parallel to the center sole portion, and a second edge that extends from the toeward end of the base at a position on the sole 314 to a position that is "raised up" from the sole at or proximate to the toeward side of the center sole portion 362 at the rear 332 of the golf club head. The inertia generator is configured so that a center of gravity 365 may in certain embodiments be positioned toeward of the x axis and lower (or closer to the ground plane 317) than the z-axis. In other words, the inertia generator may help to move the club's overall center of gravity 350 toeward, while also lowering its center of gravity, reducing Zup, as described above.

Example values for the inertia generator's center of gravity 365 are set forth below. In certain embodiments, the inertia generator may have a center of gravity 365 relative to the center 323 of the striking surface 318 as measured on the:

- x-axis ($CG_x$) of between −10 mm and −25 mm, such as between −15 mm and −20 mm;
- y-axis ($CG_y$) of between 80 and 110 mm, such as between 90 and 100 mm; and
- z-axis ($CG_z$) of between 0 and −20 mm, such as between −10 mm and −20 mm.

Additionally, due to its shape and orientation, the inertia generator is configured to generally align with a typical swing path, permitting increased inertia generated during a golf swing. Example moments of inertia for golf club head 300 are set forth below.

As best illustrated in FIG. 14A, the crown can be formed to have a recessed peripheral ledge or seat 338 to receive the crown insert 335, such that the crown insert is either flush with the adjacent surfaces of the body to provide a smooth seamless outer surface or, alternatively, slightly recessed below the body surfaces. The crown insert 335 may cover a large opening 340 (illustrated in FIG. 14A) at the top and rear of the body, forming part of the crown 312 of the golf club head. Heel sole insert 344 and toe sole insert 348 may be secured to the body 310 to cover heel sole opening 342 and toe sole opening 346, respectively, in the sole rearward of the hosel (illustrated in FIG. 16). Heel sole opening 342 has a heel sole ledge 343 for supporting heel sole insert 344. Similarly, toe sole opening 346 has a toe sole ledge 347 for supporting toe sole insert 348. The golf club head may comprise a forward mass pad 380 positioned heelward and forward on the sole 314.

As best illustrated in FIG. 15, a plurality of characteristic time ("CT") tuning screws 375 may be inserted through apertures 374 in the striking surface. Dampening material such as tuning foam 376 may be inserted through one or both of these apertures into the inner cavity 394 of the golf club head 300 to adjust the characteristic time. For example, a dampening material may be added that, upon hardening, may lower the CT time. Additional details about providing tuning of the characteristic time are provided in U.S. patent application Ser. No. 15/857,407, filed Dec. 28, 2017, the entire contents are hereby incorporated by reference herein.

Positioned on a rear side of the inertia generator 360 is inertia generator mass element 385, which may comprise a steel or tungsten weight member or other suitable material. Inertia generator mass element 385 may be removably affixed to the rear of the inertia generator 360 using a fastener port 386 that is positioned in the rear of the inertia generator 360 and configured to receive a fastener 388, which may be removably inserted through an aperture 387 in the inertia generator mass element 385 and into the fastener port 386. Fastener port 386 and aperture 387 may be threaded so that fastener 388 can be loosened or tightened either to allow movement of, or to secure in position, inertia generator mass element 385. The fastener may comprise a head with which a tool (not shown) may be used to tighten or loosen the fastener, and a body that may, e.g., be threaded to interact with corresponding threads on the fastener port 386 and aperture 387 to facilitate tightening or loosening the fastener 388.

The fastener port 386 can have any of a number of various configurations to receive and/or retain any of a number of fasteners, which may comprise simple threaded fasteners, such as described herein, or which may comprise removable weights or weight assemblies, such as described in U.S. Pat. Nos. 6,773,360, 7,166,040, 7,452,285, 7,628,707, 7,186,190, 7,591,738, 7,963,861, 7,621,823, 7,448,963, 7,568,985, 7,578,753, 7,717,804, 7,717,805, 7,530,904, 7,540,811, 7,407,447, 7,632,194, 7,846,041, 7,419,441, 7,713,142, 7,744,484, 7,223,180, 7,410,425 and 7,410,426, the entire contents of each of which are incorporated by reference herein.

Figure 17:
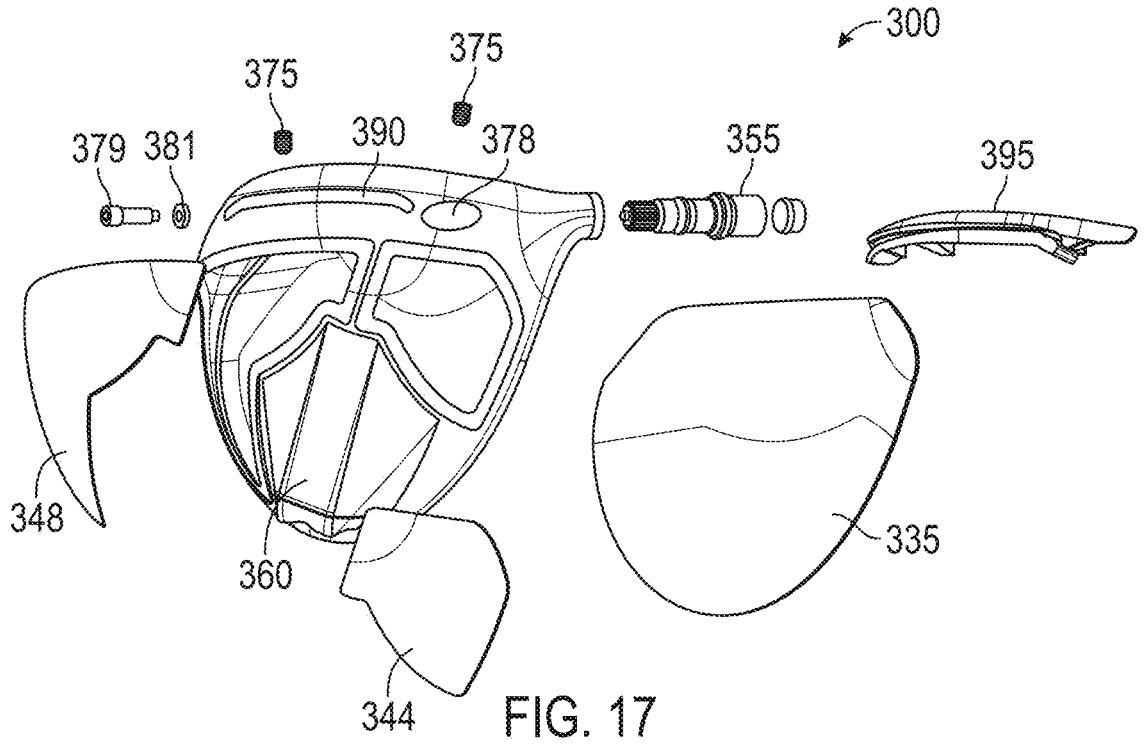
FIG. 17 is an exploded perspective view of a golf club head in accord with one embodiment of the current disclosure.
Figure 18:
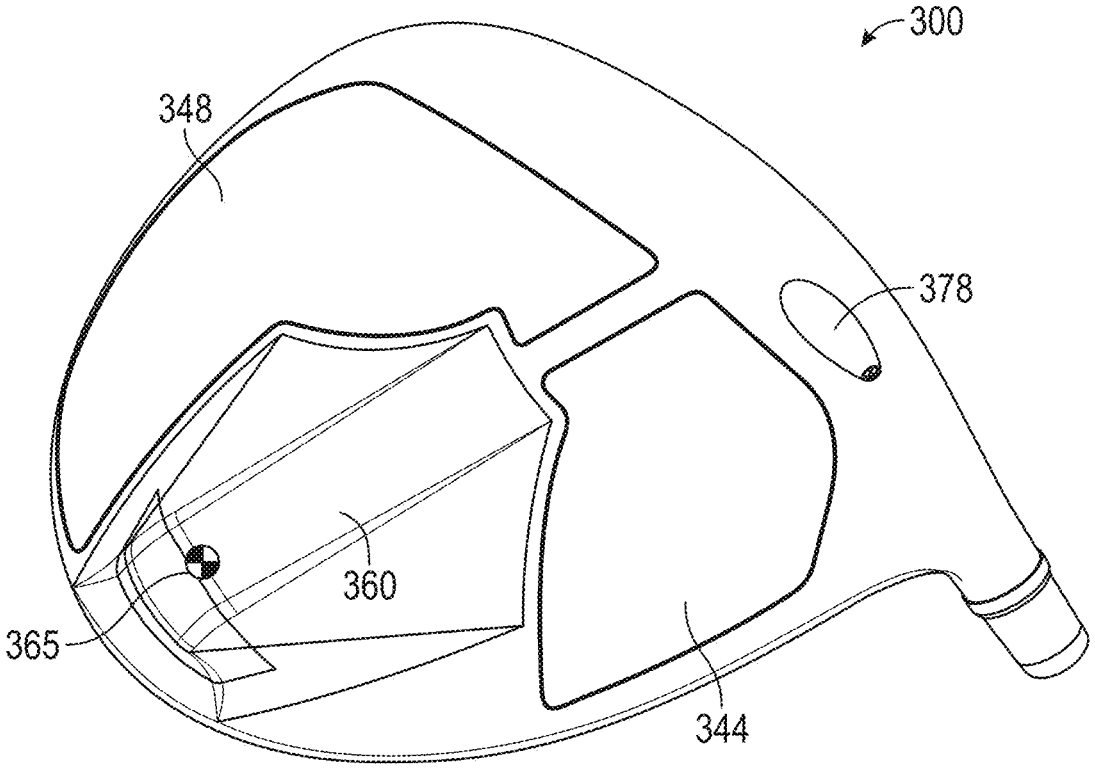
FIG. 18 is a bottom perspective view from a heel side of a golf club head in accord with one embodiment of the current disclosure.

As illustrated in FIG. 17, the golf club head's hosel 320 has a hosel bore 324 that may accommodate a shaft connection assembly 355 that allows the shaft to be easily disconnected from the golf club head, and that may provide the ability for the user to selectively adjust a and/or lie-angle of the golf club. The shaft connection assembly 355 may comprise a shaft sleeve that can be mounted on the lower end portion of a shaft (not pictured), as described in U.S. Pat. No. 8,303,431. A recessed port 378 is provided on the sole 314, and extends from the sole 314 toward the hosel 320, and in particular the hosel bore 324. The hosel bore 324 extends from the hosel 320 through the golf club head 310 and opens within the recessed port 378 at the sole 314 of the golf club head 300. The hosel bore may contain threads that are configured to interact with a fastener such as a screw. The golf club head is removably attached to the shaft by shaft connection assembly 355 (which is mounted to the lower end portion of a golf club shaft (not shown)) by inserting one end of the shaft connection assembly 355 into the hosel bore 324, and inserting a screw 379 (or other suitable fixation device) upwardly through the recessed port 378 in the sole 314 and, in the illustrated embodiment, tightening the screw 379 into a threaded opening of the shaft connection assembly 355, thereby securing the golf club head to the shaft sleeve 302. A screw capturing device, such as in the form of an O-ring or washer 381, can be placed on the shaft of the screw 379 to retain the screw in place within the golf club head when the screw is loosened to permit removal of the shaft from the golf club head.

Figure 19:
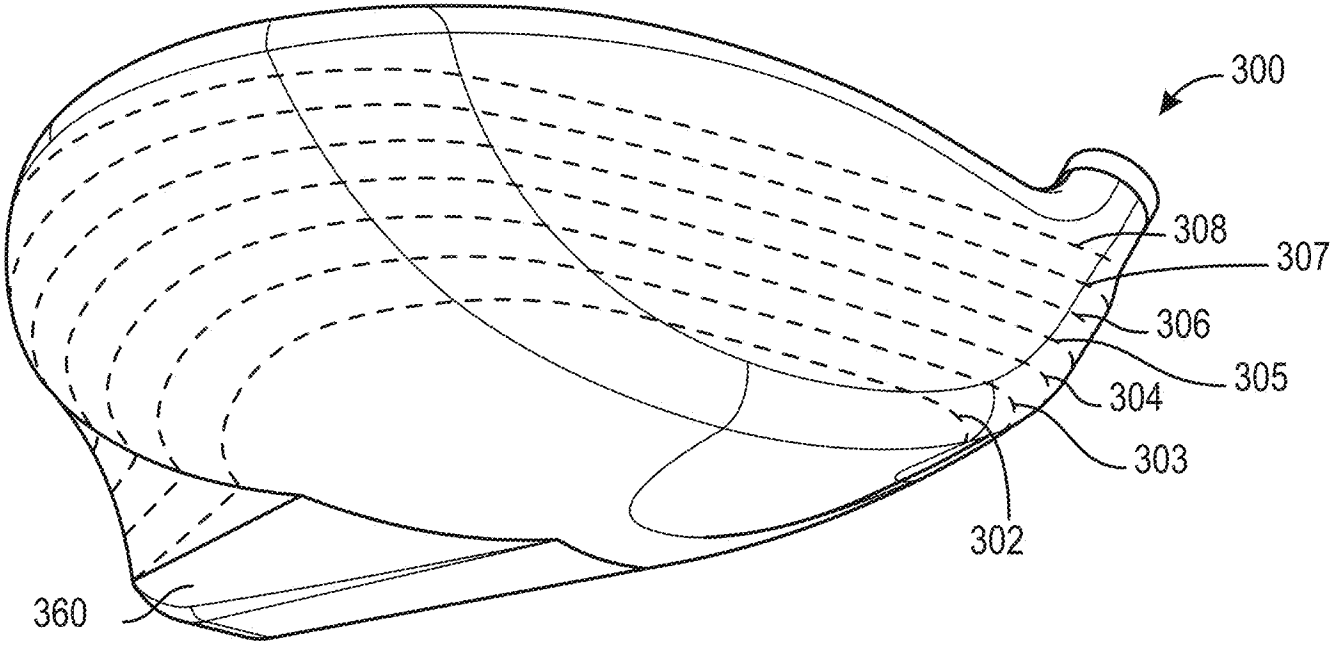
FIG. 19 is a perspective view from a toe side of a golf club head in accord with one embodiment of the current disclosure, providing elevation markers on the golf club head at various heights relative to a ground plane.

Illustrated in FIG. 19 are dashed lines surrounding golf club head 300. Each of these dashed lines represents a fixed distance above a ground plane when golf club head 300 is in normal address position, so that a cross-section of the golf club head taken at one of the respective lines would be positioned at a consistent height above the ground plane. For example, 10 mm cross-section line 302 represents the cross-section of golf club head 300 at a position 10 mm above the ground plane. In turn:

- 15 mm cross-section line 303 represents the cross-section of golf club head 300 at a position 15 mm above the ground plane;
- 20 mm cross-section line 304 represents the cross-section of golf club head 300 at a position 20 mm above the ground plane;
- 25 mm cross-section line 305 represents the cross-section of golf club head 300 at a position 25 mm above the ground plane;
- 30 mm cross-section line 306 represents the cross-section of golf club head 300 at a position 30 mm above the ground plane;
- 35 mm cross-section line 307 represents the cross-section of golf club head 300 at a position 35 mm above the ground plane; and
- 40 mm cross-section line 308 represents the cross-section of golf club head 300 at a position 40 mm above the ground plane.

As discussed above, the CGx orientation of the golf club head may be moved toeward (along the negative x-axis) or heelward (along the positive x-axis) to provide to generate specific properties of the golf club head, such as increasing MOI, increasing ball speed and reducing "gear effect." However, orientating the CGx toeward may result in the striking face of the golf club head remaining open at impact with the golf ball. In this example, when the CGx is oriented along the negative x-axis, it may be more difficult for the user to square (e.g., release) the club head in the downswing, resulting in users hitting the ball right (i.e., a "slice" or "blocked" shot). Conversely, when the orientating the CGx heelward may result in the striking face of the golf club head to be closed at impact with the golf ball. In this example, when the CGx is oriented along the positive x-axis, the club head may release early, making it more difficult for the user to keep the striking face from closing too quickly in the downswing, resulting in the user hitting the ball left (i.e., a "hook" or "pulled" shot). To overcome the missed shots resulting from the negative or positive CGx orientations, visual cues may be provided to offset the CGx orientation (i.e., altering the perceived angle of the face 110 for the user), allowing the user to hit the ball straighter with fewer misses.

As discussed above, in some embodiments, one or more features of the golf club head may be provided to alter the perceived angle of the face for the user. For example, referring back to FIG. 3, the golf club head 600 includes an alignment feature to alter the perceived angle of the face 110 for the user. In implementations with a negative CGx orientation, an alignment feature is provided to alter the perceived top line relative to striking face, with the perceived top line appearing to be square while the actual face angle is closed relative to the perceived top line. By closing the actual face angle relative to the perceived top line, the user counteracts the miss right by closing the club head in the downswing to square the striking face at impact with the golf ball. Conversely, in implementations with a positive CGx orientation, a different alignment feature is provided to alter the perceived top line relative to striking face, with the perceived top line appearing to be square while the actual face angle is open relative to the perceived top line. By opening the actual face angle relative to the perceived top line, the user counteracts the miss left by opening the club head in the downswing to square the striking face at impact with the golf ball.

For example, the alignment feature may be provided as a contrasting paint or shading of the crown 120 relative to the color or shading of the face 110. In this example, users tend to focus on the perceived top line produced by the contrasting paint, such as via white or another color paint contrasting with the metal striking face, even when the actual face angle is visible to the user. The user tends to ignore the actual face angle when contrasting paint of shading is provided. Further, the alignment feature may also provide for unconscious correction during the swing. Specifically, by perceiving the club to be square when the actual face angle is closed or open relative to the perceived top line, the user will naturally and unconsciously attempt to square the perceived top line at impact with the golf ball, correcting for the misses caused by the CGx orientation.

In some implementations, the alignment feature may alter the perceived top line from about 2 to about 4 degrees open or closed relative to the actual face angle. In some implementations, for each 5 percent change in negative or positive CGx orientation, the perceived top line is 1 degree open or closed, respectively, with respect to the actual face angle (i.e., opening or closing the perceived top line relative to the actual face angle), causing the user to close or open the actual face angle at the address position. Depending on the golf club, each degree of perceived top line change may affect lateral dispersion in a resultant shot by a set amount. For example, changing the perceived top line of a driver by one degree may reduce dispersion by approximately five yards. In another example, changing the perceived top line of a fairway wood by one degree may reduce dispersion by approximately three yards.

In some implementations, the alignment feature may be provided as a parabola defined relative to the striking face. For example, a point on parabola relative to the striking face is provided from about 2 to about 4 degrees open or closed relative to the angle of the striking face. Depending on the golf club, the radius of the alignment feature may affect lateral dispersion in a resultant shot by a set amount. For example, changing the radius of the parabola defining the topline of a driver by one degree may reduce dispersion by approximately five yards. In another example, changing the radius of the parabola defining the topline of a fairway wood by one degree may reduce dispersion by approximately three yards.

In some embodiments, grooves and/or score lines of the golf club head may be provided to alter the address position for the user, aligning the address position with the CG orientations. Referring back to FIG. 1B, grooves and/or score lines are located on the striking face 110, traditionally positioned at the center of face (CF) located at the origin 205 of the coordinate system 200. Orientating the CGx along the positive or negative x-axis, without moving scorelines from the CF, may cause the user to address the golf club head to the golf ball without aligning the CGx with the golf ball. If the user does not align the golf ball with the CGx, the user may strike the golf ball at a location on the striking face that does not correspond with the CGx location, decreasing ball speed and the accuracy of the golf shot. For example, for a positive CGx, striking the club at the CF does not correspond with the positive CGx orientation. Further, if the user strikes the ball at a location on the striking face corresponding to the positive CGx (i.e., toewardly of the score lines provided at CF), the user may believe that the shot was mishit, resulting in the user misaligning future shots. In some implementations, score lines and/or grooves are provided offset from CF at a location on the striking face corresponding the CGx, CGy and CGz orientations. The score lines and grooves also serve as an alignment aid at address. For example, in the example of a negative CGx, the score lines and/or grooves are positioned toewardly of CF to encourage the user to address and strike the ball more toewardly (i.e., aligned with the negative CGx). In this example, the score lines and/or grooves are positioned toeward of a geometric center of the face. Thus, the score lines and/or grooves are aligned for maximum performance (i.e., maximum ball speed, reducing gear effect, reducing dispersion, and the like).

Further, golf club designs are provided to counteract the left and right tendency that a player encounters when the ball impacts a high, low, heelward and/or toeward position on the club head striking face. One such golf club design incorporates a "twisted" bulge and roll contour, such as discussed in U.S. Pat. Nos. 9,814,944 and 10,265,586 and U.S. Patent Pub. No. 2019/0076705, which are incorporated herein by reference in their entireties.

Figure 20A:
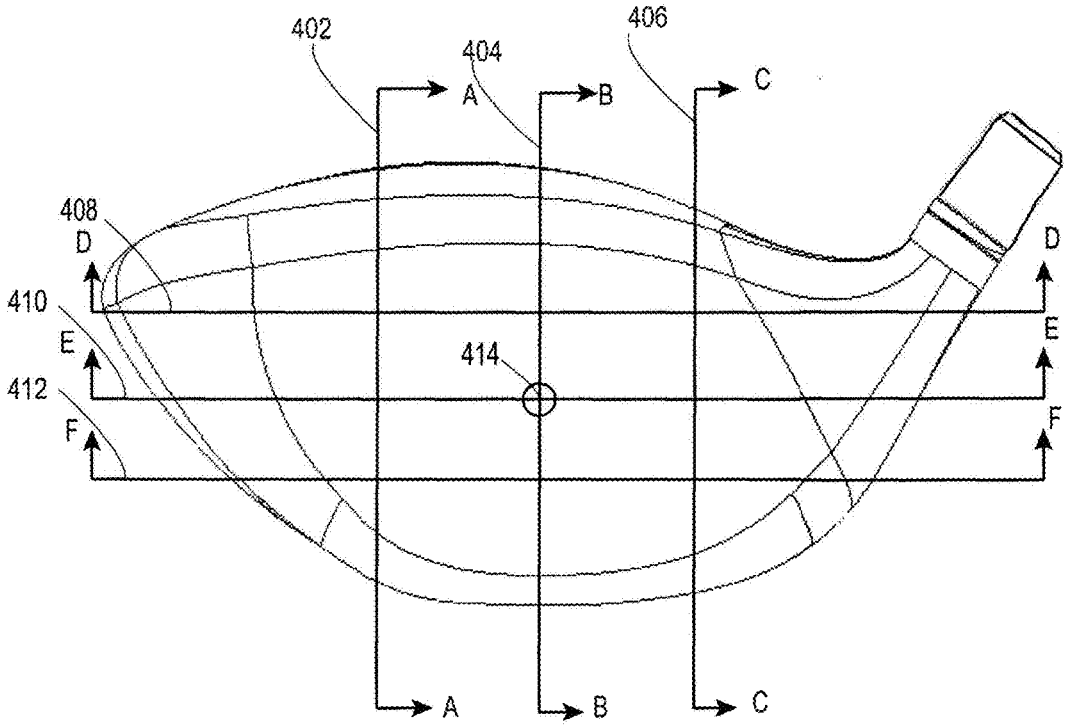
FIG. 20*a* is a front elevation view of a golf club according to an embodiment.

FIG. 20*a* illustrates a plurality of vertical planes 402,404, 406 and horizontal planes 408,410,412. More specifically, the toe side vertical plane 402, center vertical plane 404 (passing through center face), and heel vertical plane 406 are separated by a distance of 30 mm as measured from the center face location 414. The upper horizontal plane 408, the center horizontal plane 410 (passing through center face 414), and the lower horizontal plane 412 are spaced from each other by 15 mm as measured from the center face location 414.

Figure 20B:
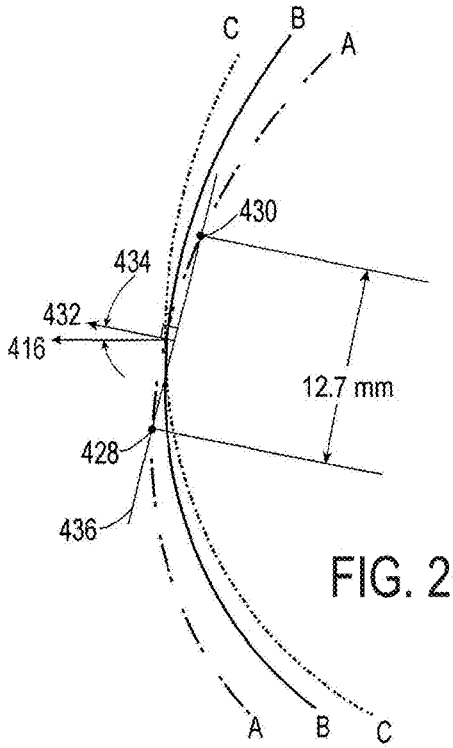
FIG. 20*b* is an exaggerated comparative view of face surface contours taken along section lines A-A, B-B, and C-C of FIG. 20*a*, as seen from a heel view.

FIG. 20*b* illustrates all three striking face surface roll contours A,B,C that are overlaid on top of one another as viewed from the heel side of the golf club. The three face surface contours are defined as face contours that intersect the three vertical planes 402,404, 406. Specifically, toe side contour A, represented by a dashed line, is defined by the intersection of the striking face surface and vertical plane 402 located on the toe side of the striking face. Center face vertical contour B, represented by a solid line, is defined by the intersection of the striking face surface and center face vertical plane 404 located at the center of the striking face. Heel side contour C, represented by a finely dashed line, is defined by the intersection of the striking face surface a vertical plane 406 located on the heel side of the striking face. Roll contours A,B,C are considered three different roll contours across the striking face taken at three different locations to show the variability of roll across the face. The toe side vertical contour A is more lofted (having positive LA° Δ) relative to the center face vertical contour B. The heel side vertical contour C is less lofted (having a negative LA° Δ) relative to the center face vertical contour B.

FIG. 20*b* shows a loft angle change 434 that is measured between a center face vector 416 located at the center face 414 and the toe side roll curvature A having a face angle vector 432. The vertical pin distance of 12.7 mm is measured along the toe side roll curvature A from a center location to a crown side and a sole side to locate a crown side measurement 430 point and sole side measurement points 428. A segment line 436 connects the two points of measurement. A loft angle vector 432 is perpendicular to the segment line 436. The loft angle vector 432 creates a loft angle 434 with the center face vector 416 located at the center face point 414. As described, a more lofted angle indicates that the loft angle change (LA° Δ) is positive relative to the center face vector 416 and points above or higher relative to the center face vector 416 as is the case for the roll curvature A.

Figure 20C:
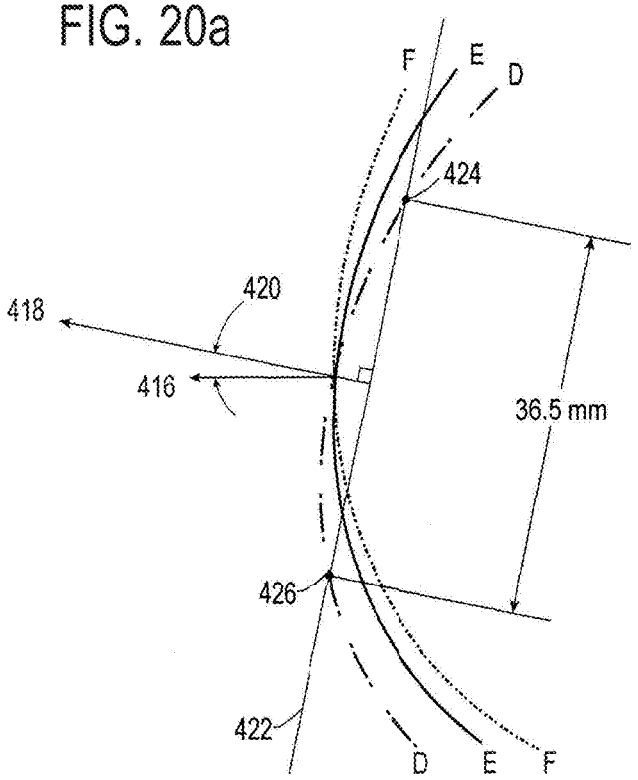
FIG. 20*c* is an exaggerated comparative view of face surface contours taken along section lines D-D, E-E, and F-F of FIG. 20*a*, as seen from a top view.

FIG. 20*c* further illustrates three striking face surface bulge contours D,E,F that are overlaid on top of one another as viewed from the crown side of the golf club. The three face surface contours are defined as face contours that intersect the three horizontal planes 408,410, 412. Specifically, crown side contour D, represented by a dashed line, is defined by the intersection of the striking face surface and upper horizontal plane 408 located on the upper side of the striking face toward the crown portion. Center face contour E, represented by a solid line, is defined by the intersection of the striking face surface and horizontal plane 408 located at the center of the striking face. Sole side contour F, represented by a finely dashed line, is defined by the intersection of the striking face surface a horizontal plane 412 located on the lower side of the striking face. Bulge contours D,E,F are considered three different bulge contours across the striking face taken at three different locations to show the variability of bulge across the face. The crown side bulge contour D is more open (having a positive FA° Δ, defined below) when compared to the center face bulge contour E. The sole side bulge contour F is more closed (having a negative FA° Δ when measured about the center vertical plane).

With the type of "twisted" bulge and roll contour defined above, a ball that is struck in the upper portion of the face will be influenced by horizontal contour D. A typical shot having an impact in the upper portion of a club face will influence the golf ball to land left of the intended target. However, when a ball impacts the "twisted" face contour described above, horizontal contour D provides a general curvature that points to the right to counter the left tendency of a typical upper face shot.

Likewise, a typical shot having an impact location on the lower portion of the club face will land typically land to the right of the intended target. However, when a ball impacts the "twisted" face contour described above, horizontal contour F provides a general curvature that points to the left to counter the right tendency of a typical lower face shot. It is understood that the contours illustrated in FIGS. 20*b* and 20*c* are severely distorted in order for explanation purposes.

In order to determine whether a 2-D contour, such as A, B, C, D, E, or F, is pointing left, right, up, or down, two measurement points along the contour can be located 18.25 mm from a center location or 36.5 mm from each other. A first imaginary line can be drawn between the two measurement points. Finally, a second imaginary line perpendicular to the first imaginary line can be drawn. The angle between the second imaginary line of a contour relative to a line perpendicular to the center face location provides an indication of how open or closed a contour is relative to a center face contour. Of course, the above method can be implemented in measuring the direction of a localized curvature provided in a CAD software platform in a 3D or 2D model, having a similar outcome. Alternatively, the striking surface of an actual golf club can be laser scanned or profiled to retrieve the 2D or 3D contour before implementing the above measurement method. Examples of laser scanning devices that may be used are the GOM Atos Core 185 or the Faro Edge Scan Arm HD. In the event that the laser scanning or CAD methods are not available or unreliable, the face angle and the loft of a specific point can be measured using a "black gauge" made by Golf Instruments Co. located in Oceanside, CA. An example of the type of gauge that can be used is the M-310 or the digital-manual combination C-510 which provides a block with four pins for centering about a desired measurement point. The horizontal distance between pins is 36.5 mm while the vertical distance between the pins is 12.7 mm.

When an operator is measuring a golf club with a black gauge for loft at a desired measurement point, two vertical pins (out of the four) are used to measure the loft about the desired point that is equidistant between the two vertical pins that locate two vertical points. When measuring a golf club with a black gauge for face angle at a desired measurement point, two horizontal pins (out of the four) are used to measure the face angle about the desired point. The desired point is equidistant between the two horizontal points located by the pins when measuring face angle.

FIG. 20*c* shows a face angle 420 that is measured between a center face vector 416 located at the center face 414 and the crown side bulge curvature D having a face angle vector 418. The horizontal pin distance of 18.25 mm is measured along the crown side bulge curvature D from a center location to a heel side and a toe side to locate a heel side measurement 426 point and toe side measurement points 424. A segment line 422 connects the two points of measurement. A face angle vector 418 is perpendicular to the segment line 422. The face angle vector 418 creates a face angle 420 with the center face vector 416 located at the center face point 414. As described, an open face angle indicates that the face angle change (FA° Δ) is positive relative to the center face vector 416 and points to the right as is the case for the bulge curvature D.

Figure 21:
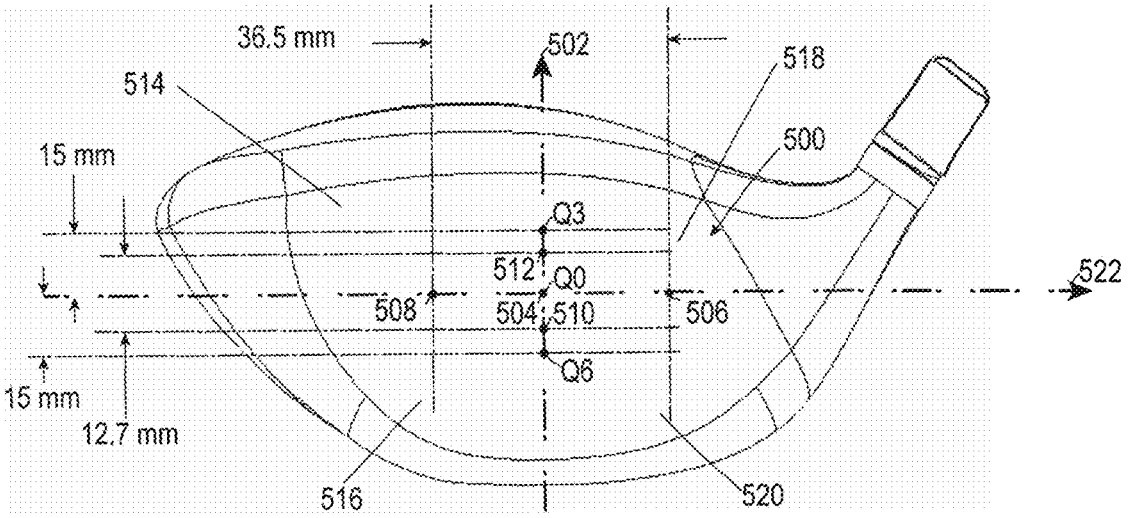
FIG. 21 is a front view of a golf club face with multiple measurement points and four quadrants.

FIG. 21 shows a desired measurement point Q0 located at the center of the striking face 500. A horizontal plane 522 and a vertical plane 502 intersect at the desired measurement point Q0 and divide the striking face 500 into four quadrants. The upper toe quadrant 514, the upper heel quadrant 518, the lower heel quadrant 520, and the lower toe quadrant 516 all form the striking face 500, collectively. In one embodiment, the upper toe quadrant 514 is more "open" than all the other quadrants. In other words, the upper toe quadrant 514 has a face angle pointing to the right, in the aggregate. In other words, if a plurality of evenly spaced points (for example a grid with measurement points being spaced from one another by 5 mm) covering the entire upper toe quadrant 514 were measured, it would have an average face angle that points right of the intended target more than any other quadrant.

The term "open" is defined as having a face angle generally pointing to the right of an intended target at address, while the term "closed" is defined as having a face angle generally pointing to the left of an intended target ad address. In one embodiment, the lower heel quadrant 520 is more "closed" than all the other quadrants, meaning it has a face angle, in the aggregate, that is pointing more left than any of the other quadrants.

If the edge of the striking surface 500 is not visually clear, the edge of the striking face 500 is defined as a point at which the striking surface radius becomes less than 127 mm. If the radius is not easily computed within a computer modeling program, three points that are 0.1 mm apart can be used as the three points used for determining the striking surface radius. A series of points will define the outer perimeter of the striking face 500. Alternatively, if a radius is not easily obtainable in a computer model, a 127 mm curvature gauge can be used to detect the edge of the face of an actual golf club head. The curvature gauge would be rotated about a center face point to determine the face edge.

In one illustrative example in FIG. 21, the face angle and loft are measured for a center face point Q0 when an easily measurable computer model method is not available, for example, when an actual golf club head is measured. A black gauge is utilized to measure the face angle by selecting two horizontal points 506,508 along the horizontal plane 522 that are 36.5 mm apart and centered about the center face point Q0 so that the horizontal points 506,508 are equidistant from the center face point Q0. The two pins from the black gauge engage these two points and provide a face angle measurement reading on the angle measurement readout provided. Furthermore, a loft is measured about the Q0 point by selecting two vertical points 512,510 that are spaced by a vertical distance of 12.7 mm apart from each other. The two vertical pins from the black gauge engage these two vertical points 512,510 and provide a loft angle measurement reading on the readout provided.

The positive x-axis 522 for face point measurements extends from the center face toward the heel side and is tangent to the center face. The positive z-axis 502 for face point measurements extends from the center face toward the crown of the club head and is tangent to the center face. The x-z coordinate system at center face, without a loft component, is utilized to locate the plurality of points P0-P36 and Q0-Q8, as described below. The positive y-axis 504 extends from the face center and is perpendicular to the face center point and away from the internal volume of the club head. The positive y-axis 504 and positive z-axis 502 will be utilized as a reference axis when the face angle and loft angle are measured at another y-z coordinate location, other than center face.

FIG. 21 further shows two critical points Q3 and Q6 located at coordinates (0 mm, 15 mm) and (0 mm, −15 mm), respectively. As used herein, the terms "1° twist" and "2° twist" are defined as the total face angle change between these two critical point locations at Q3 and Q6. For example, a "1° twist" would indicate that the Q3 point has a 0.5° twist relative to the center face, Q0, and the Q6 point has a −0.5° twist relative to the center face, Q0. Therefore, the total degree of twist as an absolute value between the critical points Q3,Q6 is 10, hence the nomenclature "1° twist".

Figure 22A:
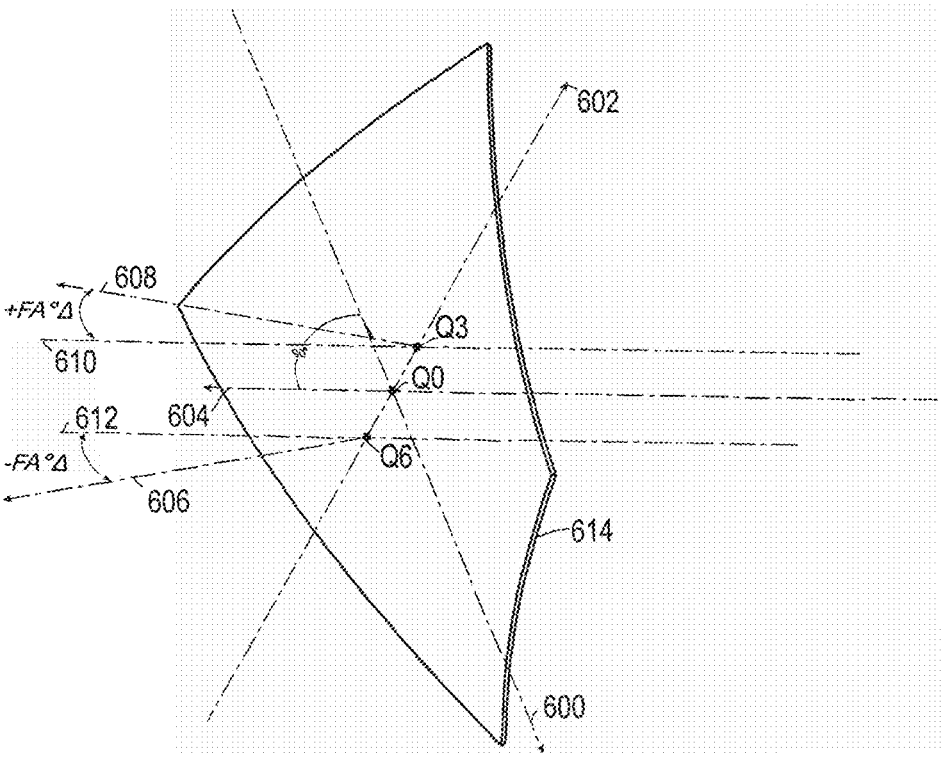
FIG. 22*a* is an isometric view of an exemplary twisted face surface plane.

To further the understanding of what is meant by a "twisted face", FIG. 22*a* provides an isometric view of an over-exaggerated twisted striking surface plane 614 of "10° twist" to illustrate the concept as applied to a golf club striking face. Each point located on the golf club face has an associated loft angle change (defined as "LA° Δ") and face angle change (defined as "FA° Δ"). Each point has an associated loft angle change (defined as "LA° Δ") and face angle change (defined as "FA° Δ").

FIG. 22*a* shows the center face point, Q0, and the two critical points Q3,Q6 described above, and a positive x-axis 600, positive z-axis 604, and positive y-axis 602 located on a twisted plane in an isometric view. The center face has a perpendicular axis 604 that passes through the center face point Q0 and is perpendicular to the twisted plane 614. Likewise, the critical points Q3 and Q6 also have a reference axis 610, 612 which is parallel to the center face perpendicular axis 604. The reference axes 610, 612 are utilized to measure a relative face angle change and loft angle change at these critical point locations. The critical points Q3, Q6 each have a perpendicular axis 608, 606 that is perpendicular to the face. Thus, the face angle change is defined at the critical points as the change in face angle between the reference axis 610,612 and the relative perpendicular axis 608, 606.

Figure 22B:
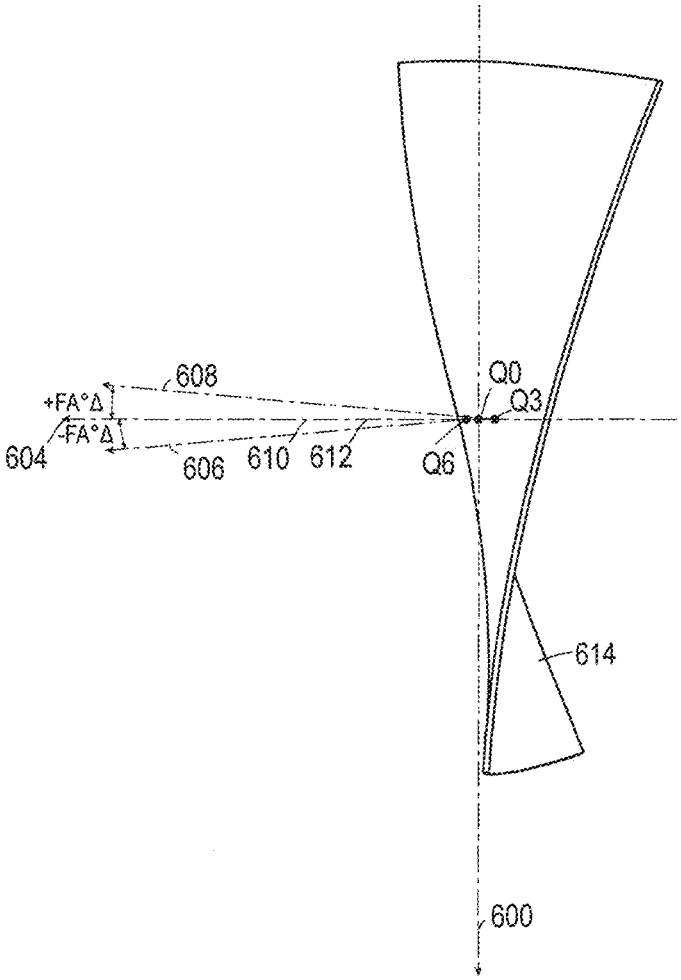
FIG. 22*b* is a top view of an exemplary twisted face surface plane.

FIG. 22*b* shows a top view of the twisted plane 614 and further illustrates how the face angle change is measured between the perpendicular axes 608, 606 at the critical points and the reference axes 610, 612 that are parallel with the center face perpendicular axis 604. A positive face angle change +FA° Δ indicates a perpendicular axis at a measured point that points to the right of the relative reference axis. A negative face angle change −FA° Δ indicates a perpendicular axis that points to the left of the relative reference axis. The face angle change is measured within the plane created by the positive x-axis 600 and positive z-axis 604.

Figure 22C:
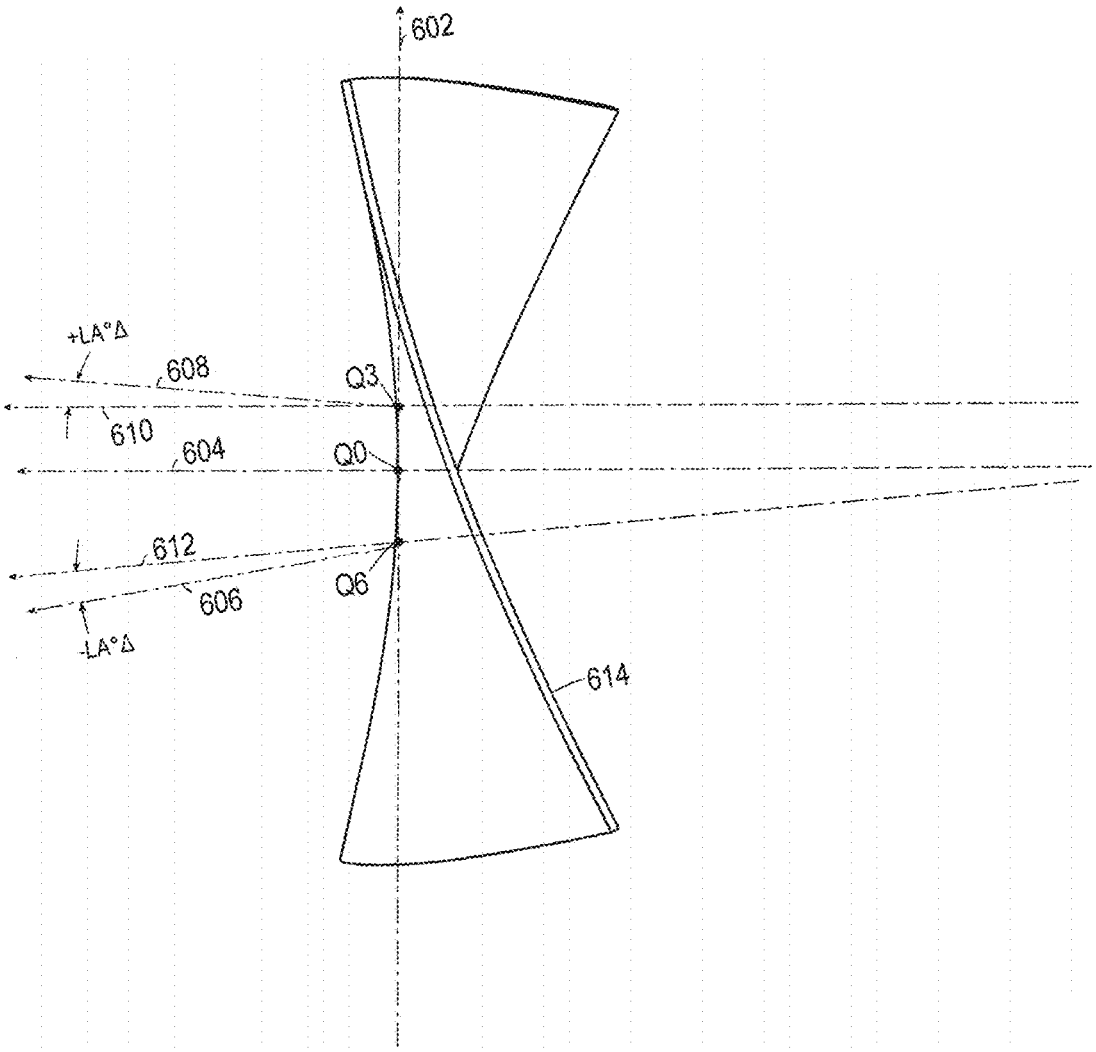
FIG. 22*c* is an elevated heel view of an exemplary twisted face surface plane.

FIG. 22*c* shows a heel side view of a twisted plane 614 and the loft angle change between the perpendicular axes 608,606 and the reference axes 610,612 at the critical point locations. A positive loft angle change +LA° Δ indicates a perpendicular axis at a measured point that points above the relative reference axis. A negative loft angle change −LA° Δ indicates a perpendicular axis that points below the relative reference axis. The loft angle is measured within the plane created by the positive z-axis 604 and positive y-axis 602 for a given measured point.

Figure 23:
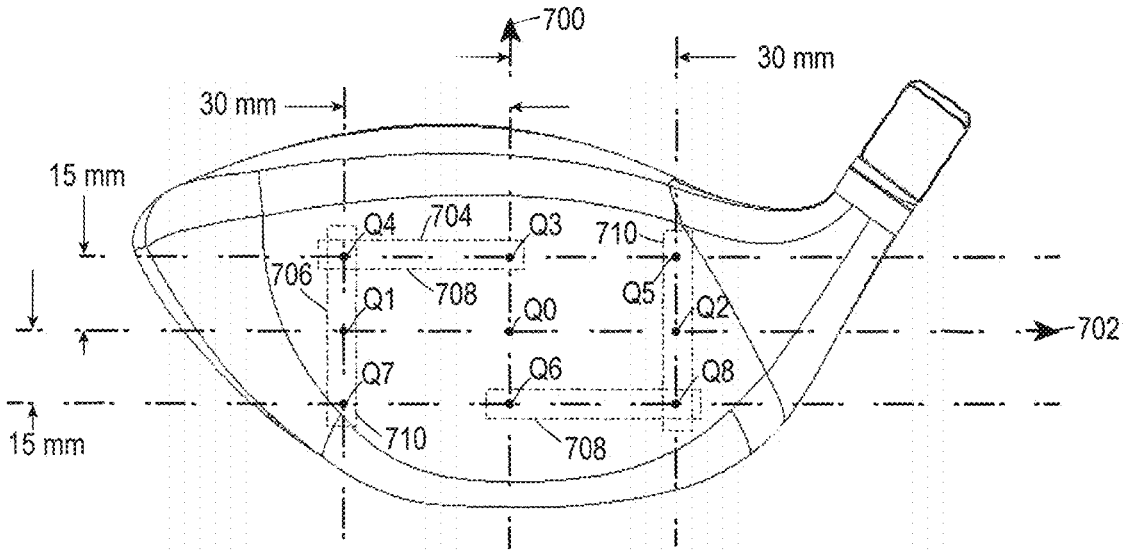
FIG. 23 illustrates a front view of a golf club with a predetermined set of measurement points.
Figure 24:
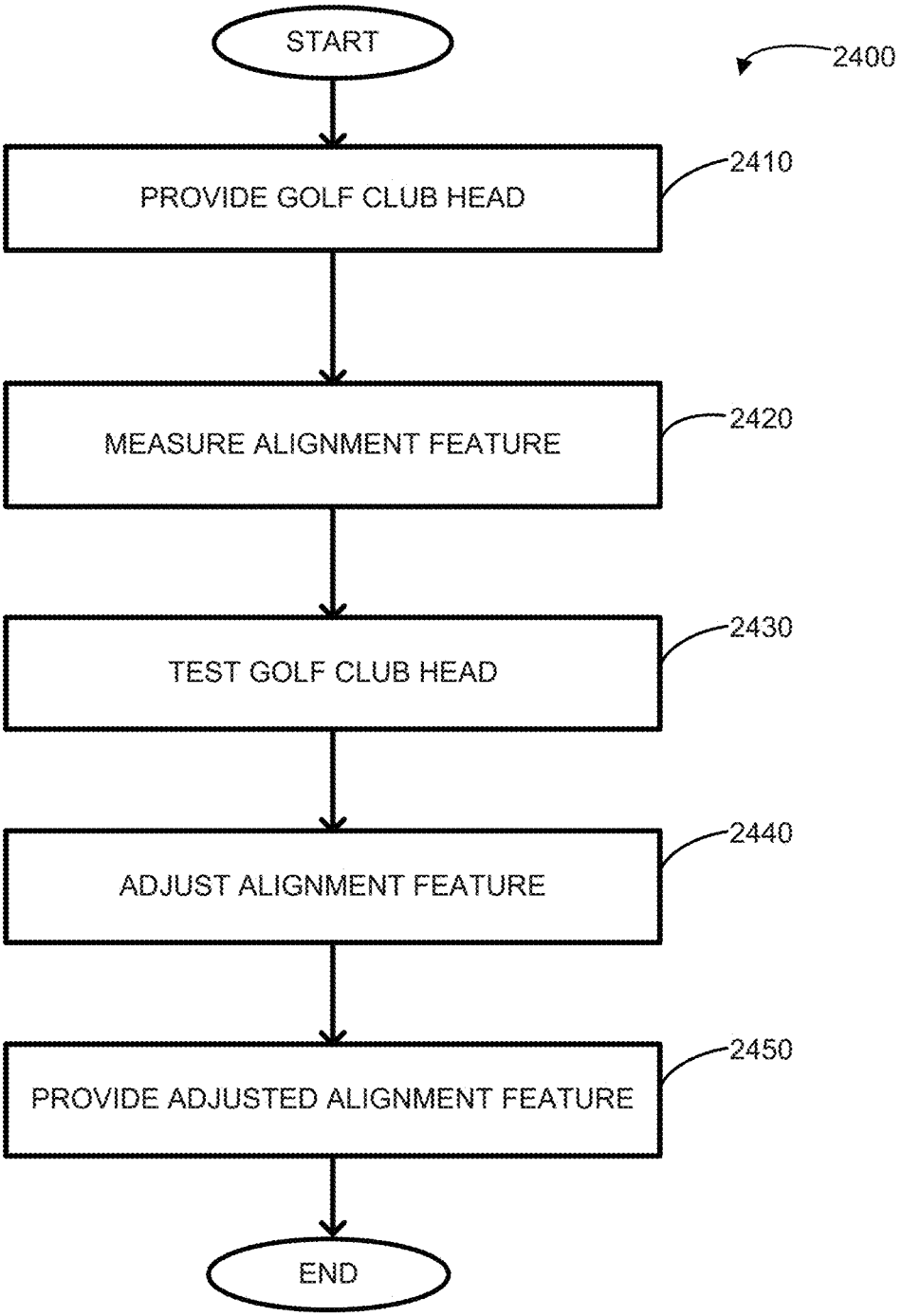
FIG. 24 is a flowchart of a method in accordance with one or more of the present embodiments.

FIG. 23 shows an additional plurality of points Q0-Q8 that are spaced apart across the striking face in a grid pattern. In addition to the critical points Q3,Q6 described above, heel side points Q5,Q2,Q8 are spaced 30 mm away from a vertical axis 700 passing through the center face. Toe side points Q4,Q1,Q7 are spaced 30 mm away from the vertical axis 700 passing through the center face. Crown side points Q3,Q4,Q5 are spaced 15 mm away from a horizontal axis 702 passing through the center face. Sole side points Q6,Q7, Q8 are spaced 15 mm away from the horizontal axis 702. Point Q5 is located in an upper heel quadrant at a coordinate location (30 mm, 15 mm) while point Q7 is located in a lower toe quadrant at a coordinate location (−30 mm, −15 mm). Point Q4 is located in an upper toe quadrant at a coordinate location (−30 mm, 15 mm) while point Q8 is located in a lower heel quadrant at a coordinate location (30 mm, −15 mm).

It is understood that many degrees of twist are contemplated and the embodiments described are not limiting. For example, a golf club having a "0.25° twist", "0.75° twist", "1.25° twist", "1.5° twist", 1.75° twist", "2.25° twist", "2.5° twist", "2.75° twist, "3° twist", "3.25° twist", "3.5° twist", "3.75° twist", "4.25° twist", "4.5° twist", "4.75° twist", "5° twist", "5.25° twist", "5.5° twist", "5.75° twist", "6° twist", "6.25° twist", "6.5° twist", "6.75° twist", "7° twist", "7.25° twist", "7.5° twist", "7.75° twist", "8° twist", "8.25° twist", "8.5° twist", "8.75° twist", "9° twist", "9.25° twist", "9.5° twist", "9.75° twist", and "10° twist" are considered other possible embodiments of the present invention. A golf club having a degree of twist greater than 0°, between 0.25° and 5°, between 0.1° and 5°, between 0° and 5°, between 0° and 10°, or between 0° and 20° are contemplated herein.

Utilizing the grid pattern of FIG. 23, a plurality of embodiments having a nominal center face loft angle of 9.5°, a bulge of 330.2 mm, and a roll of 279.4 mm were analyzed having a "0.5° twist", "1° twist", "2° twist", and "4° twist". A comparison club having "0° twist" is provided for reference in contrast to the embodiments described.

For example, if a head has a bulge radius (Bulge), and roll radius (Roll), it is possible to define two bounding surfaces for the desired twisted face surface by specifying two different twist amounts (DEG). In an embodiment, the striking face has a bulge radius between 228.6 mm and 355.6 mm. In another embodiment, the striking face has a bulge radius between 228.6 mm and 330.2 mm. Additional and different bulge radii may be used.

Table 1 shows the LA° Δ and FA° Δ relative to center face for points located along the vertical axis 700 and horizontal axis 702 (for example points Q1,Q2,Q3, and Q6). With regard to points located away from the vertical axis 700 and horizontal axis 702, the LA° Δ and FA° Δ are measured relative to a corresponding point located on the vertical axis 700 and horizontal axis 702, respectively.

For example, regarding point Q4, located in the upper toe quadrant of the golf club head at a coordinate of (−30 mm, 15 mm), the LA° Δ is measured relative to point Q3 having the same vertical axis 700 coordinate at (0 mm, 15 mm). In other words, both Q3 and Q4 have the same y-coordinate location of 15 mm. Referring to Table 1, the LA° Δ of point Q4 is 0.4° with respect to the loft angle at point Q3. The LA° Δ of point Q4 is measured with respect to point Q3 which is located in a corresponding upper toe horizontal band 704.

In addition, regarding point Q4, located in the upper toe quadrant of the golf club head at a coordinate of (−30 mm, 15 mm), the FA° Δ is measured relative to point Q1 having the same horizontal axis 702 coordinate at (−30 mm, 0 mm). In other words, both Q1 and Q4 have the same x-coordinate location of −30 mm. Referring to Table 1, the FA° Δ of point Q4 is 0.2° with respect to the face angle at point Q1. The FA° Δ of point Q4 is measured with respect to point Q1 which is located in a corresponding upper toe vertical band 706.

To further illustrate how LA° Δ and FA° Δ are calculated for points located within a quadrant that are away from a vertical or horizontal axis, the LA° Δ of point Q8 is measured relative to a loft angle located at point Q6 within a lower heel quadrant horizontal band 708. Likewise, the FA° Δ of point Q8 is measured relative to a face angle located at point Q2 within a lower heel quadrant vertical band 710.

In summary, the LA° Δ and FA° Δ for all points that are located along either a horizontal 702 or vertical axis 700 are measured relative to center face Q0. For points located within a quadrant (such as points Q4, Q5, Q7, and Q8) the LA° Δ is measured with respect to a corresponding point located in a corresponding horizontal band, and the FA° Δ of a given point is measured with respect to a corresponding point located in a corresponding vertical band. In FIG. 23, not all bands are shown in the drawing for the improved clarity of the drawing.

The reason that points located within a quadrant have a different procedure for measuring LA° Δ and FA° Δ is that this method eliminates any influence of the bulge and roll curvature on the LA° Δ and FA° Δ numbers within a quadrant. Otherwise, if a point located within a quadrant is measured with respect to center face, the LA° Δ and FA° Δ numbers will be dependent on the bulge and roll curvature. Therefore utilizing the horizontal and vertical band method of measuring LA° Δ and FA° Δ within a quadrant eliminates any undue influence of a specific bulge and roll curvature. Thus the LA° Δ and FA° Δ numbers within a quadrant should be applicable across any range of bulge and roll curvatures in any given head. The above described method of measuring LA° Δ and FA° Δ within a quadrant has been applied to all examples herein.

The relative LA° Δ and FA° Δ can be applied to any lofted driver, such as a 9.5°, 10.5°, 120 lofted clubs or other commonly used loft angles such as for drivers, fairway woods, hybrids, irons, or putters.

TABLE 1

| Relative to Center Face and Bands | | | | | | | | | | | | |
|---|---|---|---|---|---|---|---|---|---|---|---|---|
| | X-axis | Y-Axis | Example 1 0.5° twist | | Example 2 1° twist | | Example 3 2° twist | | Example 4 4° twist | | 0° twist | |
| Point | (mm) | (mm) | LA ° Δ | FA ° Δ | LA ° Δ | FA ° Δ | LA ° Δ | FA ° Δ | LA ° Δ | FA ° Δ | LA ° Δ | FA ° Δ |
| Q0 | 0 | 0 | 0 | 0 | 0 | 0 | 0 | 0 | 0 | 0 | 0 | 0 |
| Q1 | −30 | 0 | 0.5 | 5.7 | 1 | 5.7 | 2 | 5.6 | 4 | 5.6 | 0 | 5.7 |
| Q2 | 30 | 0 | −0.5 | −5.7 | −1 | −5.7 | −2 | −5.6 | −4 | −5.6 | 0 | −5.7 |
| Q3 | 0 | 15 | 3.4 | 0.25 | 3.4 | 0.5 | 3.4 | 1 | 3.4 | 2 | 3.4 | 0 |
| Q4 | −30 | 15 | 0.4 | 0.2 | 0.9 | 0.4 | 1.9 | 1 | 3.9 | 2 | 0 | 0 |
| Q5 | 30 | 15 | −0.5 | 0.3 | −1 | 0.5 | −2 | 0.9 | −4 | 1.9 | 0 | 0 |
| Q6 | 0 | −15 | −3.4 | −0.25 | −3.4 | −0.5 | −3.4 | −1 | −3.4 | −2 | −3.4 | 0 |
| Q7 | −30 | −15 | 0.5 | −0.3 | 1 | −0.5 | 2 | −0.9 | 4 | −2 | 0 | 0 |
| Q8 | 30 | −15 | −0.5 | −0.2 | −1 | −0.4 | −2 | −1 | −4.1 | −2 | 0 | 0 |

In some implementations, a "twisted" bulge and roll contour of the striking face of the golf club head may alter the perceived angle of the face for the user. For example, referring back to FIG. 21, the upper toe quadrant 514 is more "open" than all the other quadrants of the striking face, resulting in the perceived angle of the face to appear open to the user at address. The perceived angle of the face resulting from the "twisted" bulge and roll contour of the striking face may cause misalignment by the user at addresses, such as setting up the actual face angle of the club closed with respect to the intended target line, resulting in the user hitting the ball left (i.e., a "hook" or "pulled" shot). Further, the perceived angle of the face resulting from the "twisted" bulge and roll contour may be aesthetically unpleasing to the user, with a square striking face appearing open at address. To correct for the perceived angle of the face resulting from the "twisted" bulge and roll contour, an alignment feature is provided to alter the perceived top line relative to striking face.

In some embodiments, an alignment feature is provided to alter the perceived angle of the face for the user to appear closed with respect to the upper toe quadrant 514 of the striking face. In other embodiments, an alignment feature is provided to alter the perceived angle of the face for the user to appear closed with respect to the actual face angle. In the aforementioned embodiments, the alignment feature counteracts the open appearance of "twisted" bulge and roll contour. In some embodiments, the alignment feature may be provided as a contrasting paint or shading of the crown 120 relative to the color or shading of the face 110. In some embodiments, the contrasting paint or shading extends from the crown 120 onto the face 110. In some implementations, a negative CGx is provided along with a "twisted" bulge and roll contour on the striking face. In some implementations, the negative CGx counteracts some of the alignment issues caused by the "twisted" bulge contour, and vice versa. For example, the "twisted" bulge and roll contour on the striking face may be combined with one or more adjustable weights and/or a discretionary mass strategically positioned at an angle with respect to the striking face. Other combinations of the present embodiments may be provided.

In an embodiment, an alignment feature is provided to alter the perceived angle of the face of a golf club head with a "twisted" bulge and roll contour on the striking face. In this embodiment, the performance of the golf club had can be improved by decreasing lateral dispersion of the golf club head. For example, in the case of a right-handed golfer, lateral dispersion is measured indicating that the golf club has a dispersion tendency for a right miss. The right miss may be the result of the "twisted" bulge and roll contour causing the perceived angle of the face of the golf club head to appear open. The alignment feature may be altered to counteract for the right miss, such as by altering the perceived face angle to appear closed with respect to the closed with respect to the actual face angle. The amount that the alignment feature may be altered may be based on the amount of the lateral dispersion, such as by altering the alignment feature about 1 degree with respect to the intended target line for about every 3-5 yards of lateral dispersion from the intended target line. In the case of a left-handed golfer, if the lateral dispersion is measured indicating that the golf club has a dispersion tendency for a left miss, the alignment feature may be altered to counteract for the left miss by altering the perceived face angle to appear closed with respect to the closed with respect to the actual face angle.

In another embodiment, a different alignment feature is provided to alter the perceived angle of the face of a golf club head with a "twisted" bulge and roll contour on the striking face. In this embodiment, the performance of the golf club had can also be improved by decreasing lateral dispersion of the golf club head. For example, in the case of a right-handed golfer, lateral dispersion is measured indicating that the golf club has a dispersion tendency for a left miss. The left miss may be the result of the "twisted" bulge and roll contour causing the perceived angle of the face of the golf club head to appear closed. The alignment feature may be altered to counteract for the left miss, such as by altering the perceived face angle to appear open with respect to the closed with respect to the actual face angle. The amount that the alignment feature may be altered may be based on the amount of the lateral dispersion, such as by altering the alignment feature about 1 degree with respect to the intended target line for about every 3-5 yards of lateral dispersion from the intended target line. In the case of a left-handed golfer, if the lateral dispersion is measured indicating that the golf club has a dispersion tendency for a right miss, the alignment feature may be altered to counteract for the right miss by altering the perceived face angle to appear closed with respect to the closed with respect to the actual face angle.

In an embodiment, a method 2400 is provided for determining an alignment feature for a golf club head, such as in a head with a negative CGx, a "twisted" bulge and roll, or another design. This method may be performed using one or more of the golf club head embodiments discussed above.

At 2410, a golf club head is provided with an alignment feature. In an embodiment, the golf club head is a new design to be tested prior to large scale manufacturing. In this embodiment, the golf club head may have one or more alignment features. The one or more alignment features may be based on previous designs, such as retained topline properties from a previous design, or may a new alignment feature, such as based on a computer aided design (CAD) model or another club head design. For example, the golf club head may have undergone a complete remodel, such as incorporating a substantial golf club head shape change, or may have been slightly redesigned based on a previous golf club head design. In another embodiment, The golf club head may have only minor differences from another golf club head design, such as a different loft that may result in differences between golf club head designs.

At 2420, the alignment feature is measured. For example, in an embodiment using a top line as an alignment feature, a top line radius is measured. Other alignment features may be measured. Additionally or alternatively, a Sight Adjusted Perceived Face Angle (SAPFA) or other metric of the golf club head may also be measured.

At 2430, the golf club head is tested. For example, a prototype of the new golf club head design are provided for player testing. In this example, one or more players may test the golf club head. Based on the testing, a lateral dispersion of the golf club head may be measured. Other performance metrics may also be measured. Lateral dispersion may be indicative that a different alignment feature may provide better performance, such as less lateral dispersion. In another example, an impression of the alignment feature on the user may also be measured. In this example, if the golf club head face appears too open or too closed during the test, a different alignment feature may improve appeal or confidence in the golf club head to the testers.

At 2440, the alignment feature is adjusted. For example, based on the testing, the one or more alignment features may be adjusted to increase performance and/or appeal of the golf club head. In this example, a top line radius may be adjusted. Based on the lateral dispersion measured during testing, a top line radius may be adjusted one degree for every five yards of lateral dispersion with a driver and adjusted one degree for every three yards of lateral dispersion with a fairway wood. Other adjustment amounts may be provided. Further, additional and different adjustments to the one or more alignment features may be provided.

After the alignment feature is adjusted, one or more of acts 2430 and 2440 may be repeated for additional testing and/or adjustment. In some embodiments, individual player testing may also be performed, such as for individual tour players. At 2450, the adjusted alignment feature is provided for manufacturing. For example, after testing and adjusting one or more alignment features, the golf club head design is manufactured.

Discretionary mass generally refers to the mass of material that can be removed from various structures providing mass that can be distributed elsewhere for tuning one or more mass moments of inertia and/or locating the golf club head center-of-gravity. Golf club head walls provide one source of discretionary mass. In other words, a reduction in wall thickness reduces the wall mass and provides mass that can be distributed elsewhere. Thin walls, particularly a thin crown, provide significant discretionary mass compared to conventional golf club heads.

For example, a golf club head made from an alloy of steel can achieve about 4 grams of discretionary mass for each 0.1 mm reduction in average crown thickness. Similarly, a golf club head made from an alloy of titanium can achieve about 2.5 grams of discretionary mass for each 0.1 mm reduction in average crown thickness. Discretionary mass achieved using a thin crown, e.g., less than about 0.65 mm, can be used to tune one or more mass moments of inertia and/or center-of-gravity location.

To achieve a thin wall on a golf club head body, such as a thin crown, a golf club head body can be formed from an alloy of steel or an alloy of titanium.

Some examples of titanium alloys that can be used to form any of the striking faces and/or club heads described herein can comprise titanium, aluminum, molybdenum, chromium, vanadium, and/or iron. For example, in one representative embodiment the alloy may be an alpha-beta titanium alloy comprising 6.5% to 10% Al by weight, 0.5% to 3.25% Mo by weight, 1.0% to 3.0% Cr by weight, 0.25% to 1.75% V by weight, and/or 0.25% to 1% Fe by weight, with the balance comprising Ti (one example is sometimes referred to as "1300" titanium alloy).

In another representative embodiment, the alloy may comprise 6.75% to 9.75% Al by weight, 0.75% to 3.25% or 2.75% Mo by weight, 1.0% to 3.0% Cr by weight, 0.25% to 1.75% V by weight, and/or 0.25% to 1% Fe by weight, with the balance comprising Ti.

In another representative embodiment, the alloy may comprise 7% to 9% Al by weight, 1.75% to 3.25% Mo by weight, 1.25% to 2.75% Cr by weight, 0.5% to 1.5% V by weight, and/or 0.25% to 0.75% Fe by weight, with the balance comprising Ti.

In another representative embodiment, the alloy may comprise 7.5% to 8.5% Al by weight, 2.0% to 3.0% Mo by weight, 1.5% to 2.5% Cr by weight, 0.75% to 1.25% V by weight, and/or 0.375% to 0.625% Fe by weight, with the balance comprising Ti.

In another representative embodiment, the alloy may comprise 8% Al by weight, 2.5% Mo by weight, 2% Cr by weight, 1% V by weight, and/or 0.5% Fe by weight, with the balance comprising Ti. Such titanium alloys can have the formula Ti-8Al-2.5Mo-2Cr-1V-0.5Fe. As used herein, reference to "Ti-8Al-2.5Mo-2Cr-1V-0.5Fe" refers to a titanium alloy including the referenced elements in any of the proportions given above. Certain embodiments may also comprise trace quantities of K, Mn, and/or Zr, and/or various impurities.

Ti-8Al-2.5Mo-2Cr-1V-0.5Fe can have minimum mechanical properties of 1150 MPa yield strength, 1180 MPa ultimate tensile strength, and 8% elongation. These minimum properties can be significantly superior to other cast titanium alloys, including 6-4 Ti and 9-1-1 Ti, which can have the minimum mechanical properties noted above. In some embodiments, Ti-8Al-2.5Mo-2Cr-1V-0.5Fe can have a tensile strength of from about 1180 MPa to about 1460 MPa, a yield strength of from about 1150 MPa to about 1415 MPa, an elongation of from about 8% to about 12%, a modulus of elasticity of about 110 GPa, a density of about 4.45 g/cm$^3$, and a hardness of about 43 on the Rockwell C scale (43 HRC). In particular embodiments, the Ti-8Al-2.5Mo-2Cr-1V-0.5Fe alloy can have a tensile strength of about 1320 MPa, a yield strength of about 1284 MPa, and an elongation of about 10%.

In some embodiments, striking faces and/or club head bodies can be cast from Ti-8Al-2.5Mo-2Cr-1V-0.5Fe. In some embodiments, striking surfaces and club head bodies can be integrally formed or cast together from Ti-8Al-2.5Mo-2Cr-1V-0.5Fe, depending upon the particular characteristics desired.

The mechanical parameters of Ti-8Al-2.5Mo-2Cr-1V-0.5Fe given above can provide surprisingly superior performance compared to other existing titanium alloys. For example, due to the relatively high tensile strength of Ti-8Al-2.5Mo-2Cr-1V-0.5Fe, cast striking faces comprising this alloy can exhibit less deflection per unit thickness compared to other alloys when striking a golf ball. This can be especially beneficial for metalwood-type clubs configured for striking a ball at high speed, as the higher tensile strength of Ti-8Al-2.5Mo-2Cr-1V-0.5Fe results in less deflection of the striking face, and reduces the tendency of the striking face to flatten with repeated use. This allows the striking face to retain its original bulge, roll, and "twist" dimensions over prolonged use, including by advanced and/or professional golfers who tend to strike the ball at particularly high club velocities.

For further details concerning titanium casting, please refer to U.S. Pat. No. 7,513,296, incorporated herein by reference.

Additionally, the thickness of a club hosel may be varied to provide for additional discretionary mass, as described in U.S. Pat. No. 9,731,176, the entire contents of which are hereby incorporated by reference.

As discussed above, the location and characteristics of golf club head alignment features, such as a golf club head topline, may be important to the golf club's performance and aesthetics. For example, a 1-degree change in perceived face angle of the golf club head may cause a lateral dispersion of up to about 5 yards. Likewise, providing an alignment feature changing the perceived face angle of the golf club head may correct for lateral dispersion caused by other characteristics of the golf club.

One or more of the present embodiments provide for hard tooling the location and characteristics of one or more alignment features into the golf club head. For example, instead of masking and painting a topline onto the golf club head, a topline is hard tooled at the intersection between the casted club head body and a face insert. The club head body, such as a casted club head body, may be painted separately from the face insert, requiring no special masking to provide for an alignment feature. In some embodiments, a transition zone between the face and the crown may be painted the same color as other portions of the casted club head body, eliminating the need to use a masking line between the transition zone and other portions of the casted club head body. After painting the casted club head body, the face may be bonded or otherwise attached to the casting. A contrast in color, difference in finishes, and/or difference in texture between the casted club head body and the face defines the necessary visual cue. For example, the face insert may be a single color, or multicolored. Likewise, the club head body and/or the crown may also be a single color, or multicolored, providing for one or more alignment features by contrasting with the one or more color of the face insert. In another example, the club head body and/or the crown may have one finish, such as gloss, and the face insert may be a different finish, such as matte. In yet another example, the club head body and/or the crown may have one texture, such a visible composite weave, and the face insert may be a different texture, such as a texture that appears uniform or smooth. Additionally or alternatively, a crown insert may be bonded or otherwise attached to the casted club head body to provide for a visual cue. Accordingly, the topline may not be subject to the manufacturing variability resulting from user error and the manufactured golf club heads may be more consistent from part to part.

In some embodiments, the face insert is made of a composite that includes multiple plies or layers of a fibrous material (e.g., graphite, or carbon, fiber) embedded in a cured resin (e.g., epoxy), such as those described in U.S. Pat. No. 10,016,662, the entire contents of which are hereby incorporated by reference. Composite face plates for use in the metalwood golf clubs may be fabricated using the procedures described in U.S. patent application Ser. No. 10/442,348 (now U.S. Pat. No. 7,267,620), Ser. No. 10/831,496 (now U.S. Pat. No. 7,140,974), Ser. Nos. 11/642,310, 11/825,138, 11/998,436, 11/895,195, 11/823,638, 12/004,386, 12,004,387, 11/960,609, 11/960,610, and Ser. No. 12/156,947, which are all incorporated herein by reference in their entirety. The composite material can be manufactured according to the methods described at least in U.S. patent application Ser. No. 11/825,138, the entire contents of which is herein incorporated by reference in its entirety. In some embodiments, the face insert has a variable thickness, such as those described in U.S. Pat. No. 7,874,938, the entire contents of which are hereby incorporated by reference.

In some embodiments, the face is tunable (e.g., for CT, COR, or another characteristic), such as described in U.S. patent application Ser. No. 15/857,407, filed Dec. 28, 2017, the entire contents of which are hereby incorporated by reference.

Figure 25:
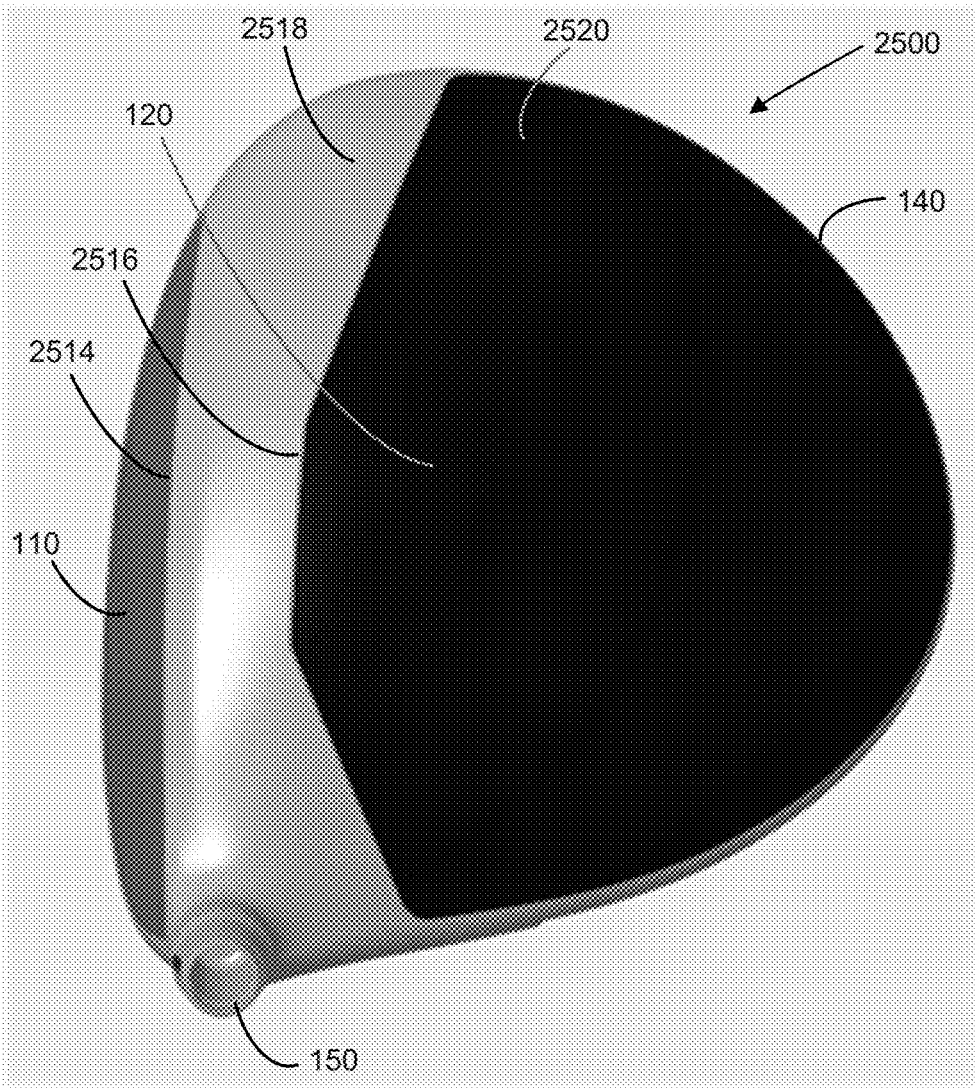
FIG. 25 is a top view of a golf club head in accord with one embodiment of the current disclosure having tooled alignment feature.

FIG. 25 is a top view of a golf club head having at least one tooled alignment feature. The golf club head 2500 includes a face 110, a crown 120, a sole 130 (not depicted), a skirt 140, and a hosel 150. As depicted in FIG. 25, a primary alignment feature 2514 is provided on the golf club head. The primary alignment feature 2514 may be provided as a topline that is hard tooled at the intersection of the face 110 and the casting of the golf club head 2500. The topline may delineate the transition between at least a portion of the crown 120 having a shade, color, finish, and/or texture that contrasts and/or is different from the shade, color, finish, and/or texture of the face 110. The topline may also delineate a transition between the face 110 with another portion of the golf club body. In some embodiments, the casting of the golf club head 2500, including a portion of the crown 120, are painted in a shade or color prior to attaching the face 110. The face 110 may define the characteristics of the primary alignment feature 2514. For example, the size and shape of the face 110 may change the location of the topline, curvature of the topline, Sight Adjusted Perceived Face Angle (SAPFA) of the golf club head 2500, and other characteristics of the golf club head 2500 and/or primary alignment feature 2514.

In some embodiments, the face 110 is provided at least in part as a composite material. Other materials may also be used. The face 110 may be bonded to the golf club head 2500. Any bonding methods known in the art may be utilized, including but not limited to adhesive bonding, including gluing, welding (preferable welding processes are ultrasonic welding, hot element welding, vibration welding, rotary friction welding or high frequency welding (Plastics Handbook, Vol. 3/4, pages 106-107, Carl Hanser Verlag Munich & Vienna 1998)) or calendaring or mechanical fastening including riveting, or threaded interactions. Alternatively, the face 110 may be attached to the golf club head in another manner, such as with screws, fasteners, epoxy, welding, or with another attaching or bonding means. In some embodiments, the face may be welded from the back of the face (i.e., from inside the cavity of a golf club head). The welding may not fully penetrate the face (e.g., less than 100% weld penetration). Past club head designs have provided for an intersection location of the face 110 and golf club body casting at a location that is undesirable for a primary alignment feature 2514. For example, past intersection locations do not provide for aesthetic and visual cue performance due to durability constraints. One or more of the present embodiments provide for a bonded face design allowing for a tooled topline location with aesthetic and performance characteristics while maintaining durability of the golf club head. For example, the tooled topline location may follow the shape of the face insert. If testing the club head shows a lateral dispersion that goes right and/or appears closed, the shape of the face insert may be changed to minimize the lateral dispersion and to make the club head appear more open. Likewise, if testing the club head shows a lateral dispersion that goes left and/or appears open, the shape of the face insert may be changed to minimize the lateral dispersion and to make the club head appear more closed. To maximize performance, the face insert may not be a uniform shape (e.g., not an elliptical face insert). For example, in some embodiments, a portion of the face insert extends upward and heelward toward the hosel. A portion of the face insert may also extend upward and toeward.

In some embodiments, the golf club head includes a secondary alignment feature. Referring back to FIG. 25, the secondary alignment feature 2516 may delineate a transition between the first portion of the crown 2518 and a second portion of the crown 2520. In an example, the first portion of the crown 2518 may have a contrasting shade or color with the shade or color of the face 110 and the second portion of the crown 2520 may have a contrasting shade or color with the shade or color of the first portion of the crown 2520. Secondary alignment 2516 feature may also be hard tooled into the club head, such as with a crown insert. In some embodiments, the crown insert may be as a composite material. Examples of some of these composite materials for use in the metalwood golf clubs and their fabrication procedures are discussed herein and described in U.S. patent application Ser. No. 10/442,348 (now U.S. Pat. No. 7,267,620), Ser. No. 10/831,496 (now U.S. Pat. No. 7,140,974), Ser. Nos. 11/642,310, 11/825,138, 11/998,436, 11/895,195, 11/823,638, 12/004,386, 12,004,387, 11/960,609, 11/960,610, and Ser. No. 12/156,947, which are incorporated herein by reference.

Figure 26:
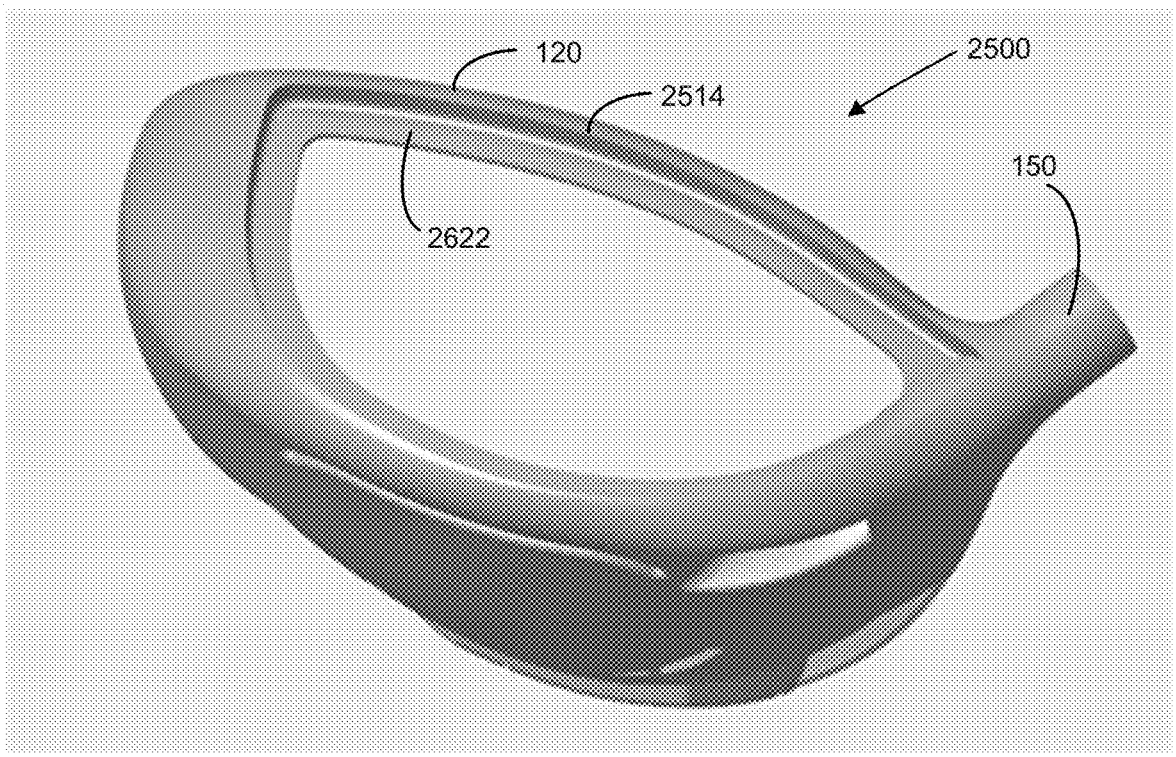
FIG. 26 is a perspective view of a golf club head in accord with one embodiment of the current disclosure, without a face insert installed.

FIG. 26 is a perspective view of a golf club head having at least one tooled alignment feature, without a face insert installed. In this embodiment, the golf club head 2500 is casted with a ledge 2622 for receiving a face insert 110 (not depicted). The face insert 110 may be provided as a composite material or as another material. For example, the face insert 110 may be a molded composite to be bonded to the ledge 2622 of golf club head. By bonding the face insert 110 to the ledge 2622, the transition between the face 110 and the crown 120 provide for a noticeable topline as the primary alignment feature 2514. In some embodiments, the face 110 is bonded to the ledge 2622 with a seamless transition between the face 110 and crown 120, such to promote desired aerodynamic and aesthetic characteristics.

The characteristics of the primary alignment feature 2514 may be defined by the face insert 110. For example, a larger face insert 110 may position the alignment feature 2514 higher on the golf club head 2500. Likewise, a smaller face insert 110 may position the alignment feature 2514 lower on the golf club head 2500. The shape of the face insert 110 may also provide for a desired curvature and/or radius of the topline. Once the desired characteristics of the primary alignment feature 2514 are established, the alignment feature 2514 is hard tooled into the golf club head 2500. Hard tooling the alignment feature allows for the alignment feature to be permanent, non-deformable, and not prone to manufacturing errors associated with painted alignment features that use stickers or other maskings during manufacturing. As such, the primary alignment feature is determined by the club head casting and integrated in the golf club head using the face insert.

Figure 27:
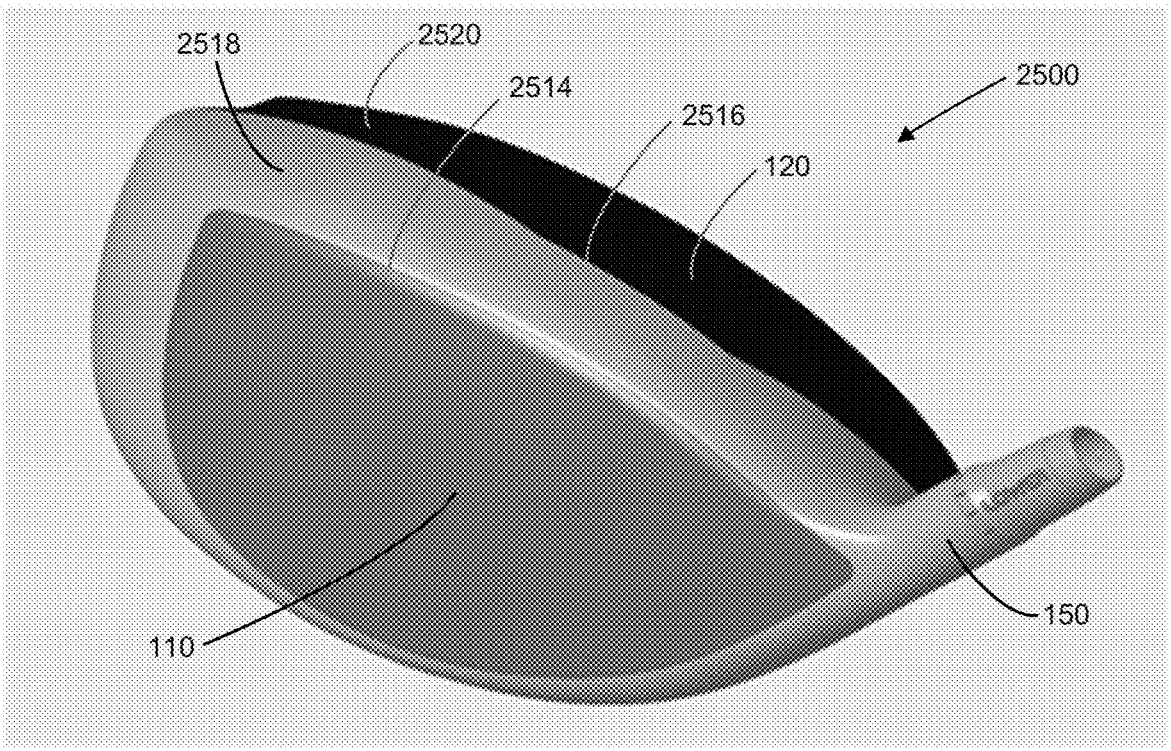
FIG. 27 is a perspective view of a golf club head in accord with one embodiment of the current disclosure, with a face insert installed.

FIG. 27 is a perspective view of a golf club head having at least one tooled alignment feature, with a face insert installed. In this embodiment, the golf club head 2500 is provided with the face insert 110 bonded to the ledge 2622 (not depicted). As depicted in FIG. 27, the primary alignment feature 2514 is a hard tooled topline at the intersection of the face 110 with the casting body, such as a first portion of the crown 2518. In the case of a bonded face, the joint between the face 110 and the crown 120 determines the topline 2514. Other ways of installing the face insert may be used, such as with screws, fasteners, or another method of installation.

Additional features of the golf club head 2500 may be facilitated by using a face insert 110. For example, including a notch in the back of the face insert 110 allows for the golf club head 2500 to utilize flight control technology (FCT) in the hosel 150 to include a loft and lie connection sleeve to adjust, inter alia, face angle. Other characteristics of the face insert may provide for performance benefits. In an embodiment, the face insert 110 may provide for more accurate and uniform face thicknesses between manufactured golf club heads and provide for the precise face thickness variabilities incorporated in the golf club head design. In an embodiment, a molded composite face insert allows for variable thickness across locations of the face. In an embodiment, the center of gravity about the x-axis (CGx) may be more accurately positioned using the face insert, such as by using a variable thickness face. Further, characteristic time (CT) and coefficient of restitution (COR) requirements may be attained precisely by molding the composite face and bonding the face to the golf club head. The composite face may also be tunable after installation. In an embodiment, the face insert may provide for a CT above about 255 and a COR of about 835. In an embodiment, different bulge and roll characteristics may be prescribed for a user and provided using the face insert. For example, the different bulge and roll characteristics, including twisted bulge and roll characteristics, may be provided by selecting from different face inserts. One of the different face inserts may be selected prior to bonding the face to the golf club head, or alternatively the face inserts may be interchangeable by a user or club fitter. In yet another embodiment, changing the face characteristics requires the club head casting to change to accommodate the new face insert.

In some embodiments, the face insert may be provided as a dark face insert surface area having a CIELab brightness (L) of less than about 40 and a bright surface area of the casted club head body and/or the crown of the club head has a CIELab brightness of between about 50 and about 100. In some embodiments, the difference in brightness (ΔL) between the face insert and the casted club head body and/or the crown is about 20, about 40, about 50, about 60, about 70, or another difference greater than about 20.

In some embodiments, the face insert may be provided with a dark face insert surface area having a CIELab brightness (L) of less than about 40 and the casted club head body and/or the crown of the club head is provided with a dark surface area having a CIELab brightness of less than about 40. For example, the difference in brightness (ΔL) between the face insert and the casted club head body and/or the crown is about 5, about 10, about 15, about 20, or another difference less than about 20.

In some embodiments, the face insert may be provided as a matte, semigloss, or low gloss face insert surface area having a gloss value of less than about 60, about 50, or about 40 gloss units and a semigloss surface area of the casted club head body and/or the crown of the club head has a CIELab gloss value of greater than about 40, about 50, about 60, and about 70 gloss units. For example, a matte or low gloss face insert may have gloss values of less than 10, 8, 5, 4, or 2 gloss units.

Any difference in appearance between the face insert and the casted club head body and/or the crown may be used as an alignment feature. The club head body and/or the crown may be different in appearance with the face insert by color, brightness, texture, finish, or another visual difference. For example, different finishes may be used, such gloss, semigloss, low gloss, matte, or another finish. Different textures may also be used, such textures manufactured into the club head components, ridges, valleys, patterns of material, composite weaves, and other textures.

Figure 28:
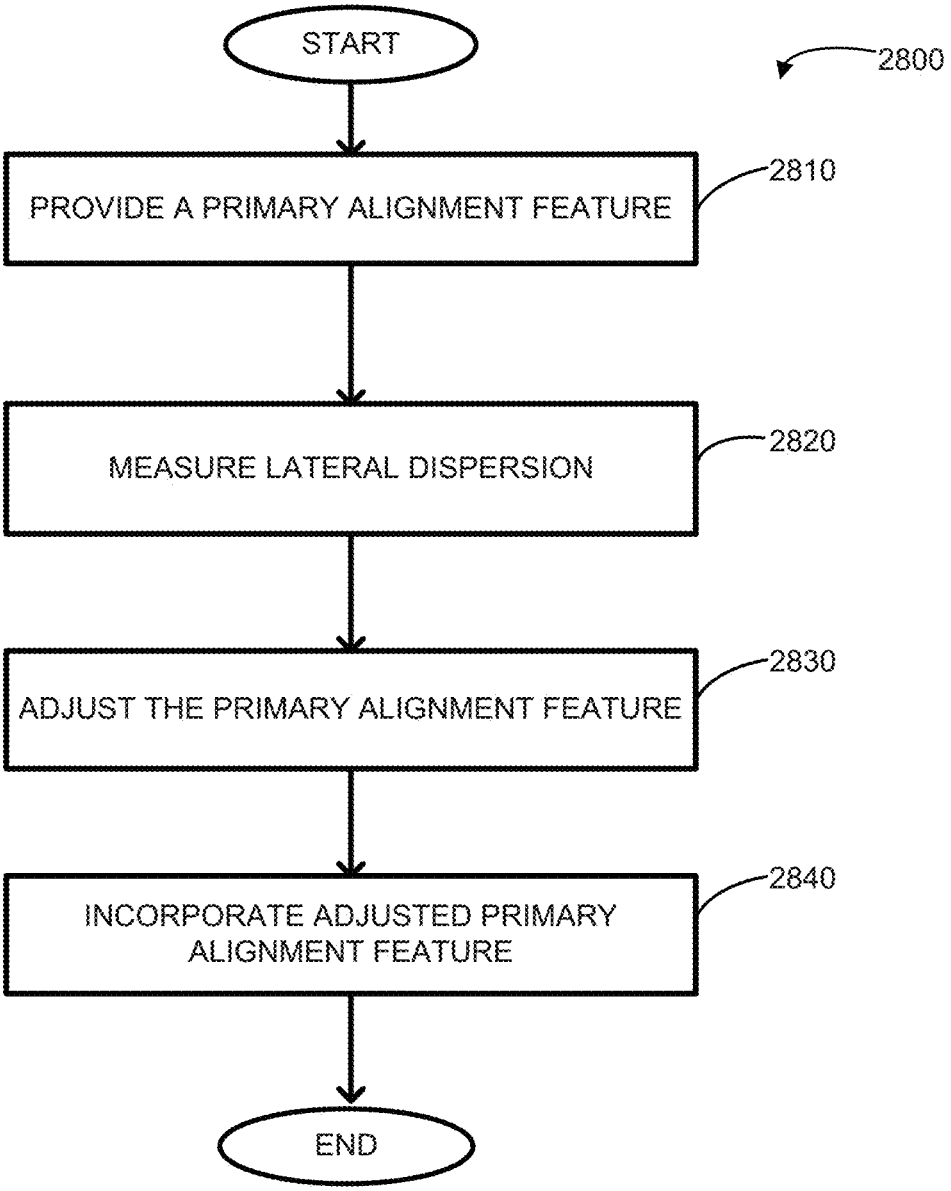
FIG. 28 is a flowchart of a method in accordance with one or more of the present embodiments.

FIG. 28 is a flowchart of a method 2800 for counteracting a lateral dispersion tendency of a golf club head. For example, the method may be used to determine an alignment feature for a golf club head. This method may be performed using one or more of the golf club head embodiments discussed herein or with another golf club head having a face, a crown and a sole.

At 2810, a primary alignment feature is provided. For example, the primary alignment feature may include a line delineating a transition between a portion of the crown and the face. The portion of the crown may have an area with a shade or color that contrasts the shade or color of the face. The primary alignment feature may be hard tooled into the golf club head using the face of the golf club body. For example, the face may be bonded or otherwise attached to a painted golf club body. The face may be painted or provided with a different shade or color from the crown, or may be unpainted. In an embodiment, the face is provided in a composite material of a shade or color that contrasts with the crown.

At 2820, the lateral dispersion tendency of the golf club head is measured. The lateral dispersion tendency indicates an average dispersion from a center target line. For example, a positive lateral dispersion tendency is the average dispersion right of the center target line and a negative lateral dispersion tendency is the average dispersion left of the center target line. For example, a prototype of the new golf club head design is provided for player testing. In this example, one or more players may test the golf club head. Based on the testing, a lateral dispersion of the golf club head may be measured. Other performance metrics may also be measured. Lateral dispersion may be indicative that a different alignment feature may provide better performance, such as less lateral dispersion. In another example, an impression of the alignment feature on the user may also be measured. In this example, if the golf club head face appears too open or too closed during the test, a different alignment feature may improve appeal or confidence in the golf club head to the testers.

At 2830, the primary alignment feature is adjusted to provide an adjusted primary alignment feature, such as to counteract the lateral dispersion tendency of the golf club head. The primary alignment feature may also be adjusted in conjunction with changing face characteristics of the golf club head, such as when providing for different bulge and roll characteristics, tuning CT, and prescribing other face characteristics. In an embodiment, based on the testing, the primary alignment feature may be adjusted to increase performance and/or appeal of the golf club head. In this example, a top line radius may be adjusted. Based on the lateral dispersion measured during testing, a top line radius may be adjusted one degree for every five yards of lateral dispersion with a driver and adjusted one degree for every three yards of lateral dispersion with a fairway wood. Other adjustment amounts may be provided. Furthermore, additional and different adjustments to the one or more alignment features may be provided.

After the alignment feature is adjusted, one or more of acts 2820 and 2830 may be repeated for additional testing and/or adjustment. In some embodiments, individual player testing may also be performed, such as for individual tour players. In some embodiments, a secondary alignment feature is tested and adjusted.

At 2840, the adjusted primary alignment feature is incorporated into the golf club head. In an embodiment, the adjusted primary alignment feature is incorporated into the golf club head by retooling the golf club head. The adjusted alignment feature may also be provided for manufacturing the golf club heads. For example, after testing and adjusting one or more alignment features, the golf club head design is manufactured. Therefore, as-cast with the golf club head, the one or more alignment features are integrally formed into the golf club head, such as with an integrally formed topline alignment feature.

Figure 29:
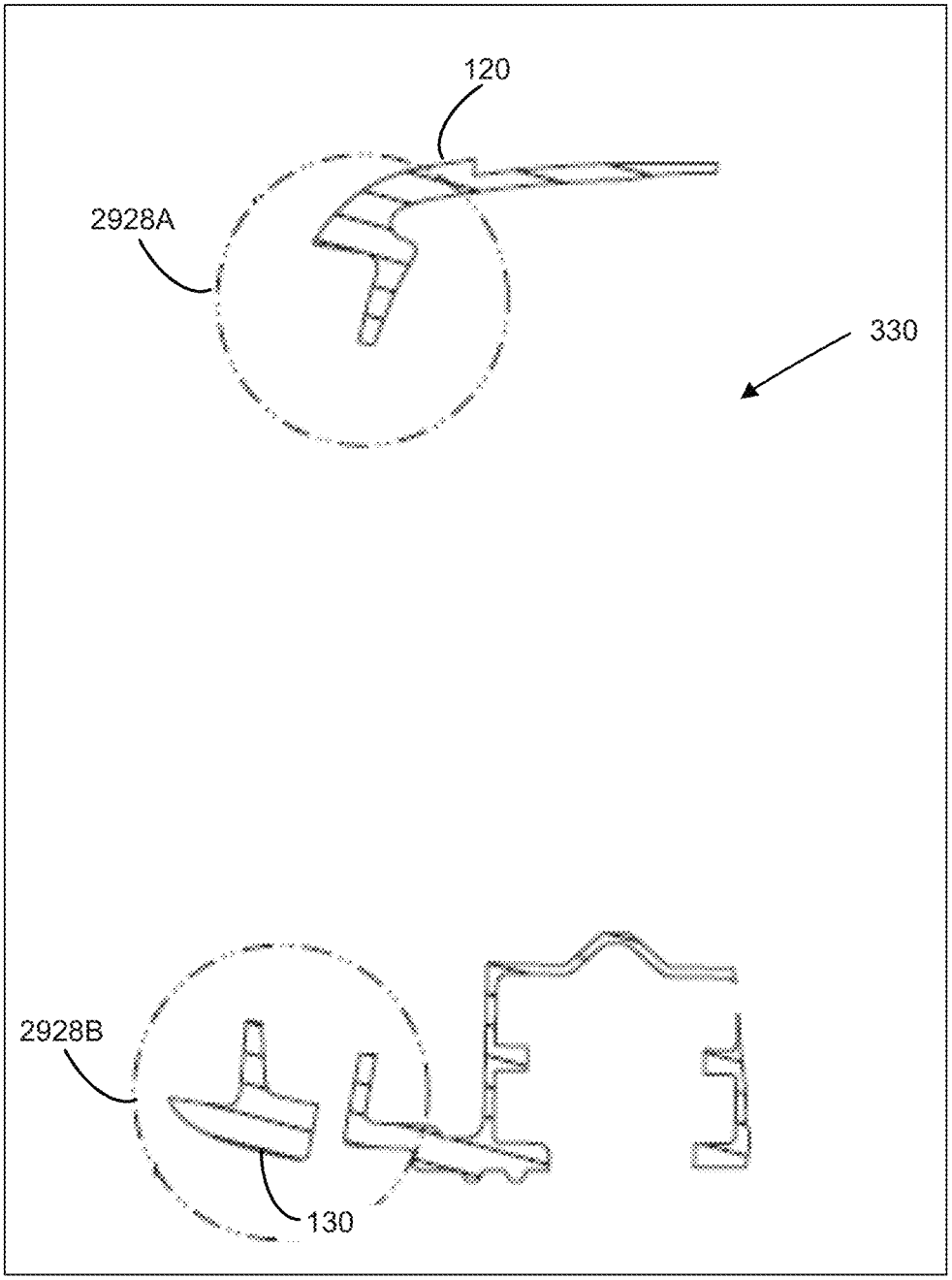
FIG. 29 is a section view of a golf club head in accord with one embodiment of the current disclosure, without a face insert installed.

FIG. 29 is a section view of a golf club head in accord with one embodiment of the current disclosure, without a face insert installed. In some embodiments, the transition from a portion of the crown 120 to the face insert (not depicted in FIG. 29) provides for a primary alignment feature. For example, FIG. 29 shows a front portion 330 of a golf club head, such as golf club head 2500 or another golf club head. The front portion 330 is configured to receive a face insert (not depicted in FIG. 29), such as face insert 110 or another face insert. The front portion 330 includes a face insert support structures 2928A, 2928B. An upper face insert support structure 2928A is adjacent or immediately next to the crown 120. A lower face insert support structure 2928B is adjacent or immediately next to the sole 130.

In some embodiments, when installed to the face insert support structures 2928A, 2928B, the face insert forms a part of the transition region from the face to the crown 120 and/or the sole 130. For example, at least a portion of the transition region may be painted the same color or shade as at least a portion of the crown prior to installing the face insert, which when installed provides a contrasting color or shade of the face insert with respect to the painted portion of the transition region and/or crown. In other embodiments, the face insert eliminates the need for a transition region from the face to the crown 120 and/or the sole 130. In some embodiments, the face insert includes at least a portion of the radius of the transition from the face insert to the crown. By forming part of the radius of the transition from the face to the crown, aerodynamics of the club head may be improved by decreasing turbulence of the air passing from the face to the crown and increasing annular flow.

Figure 30A:
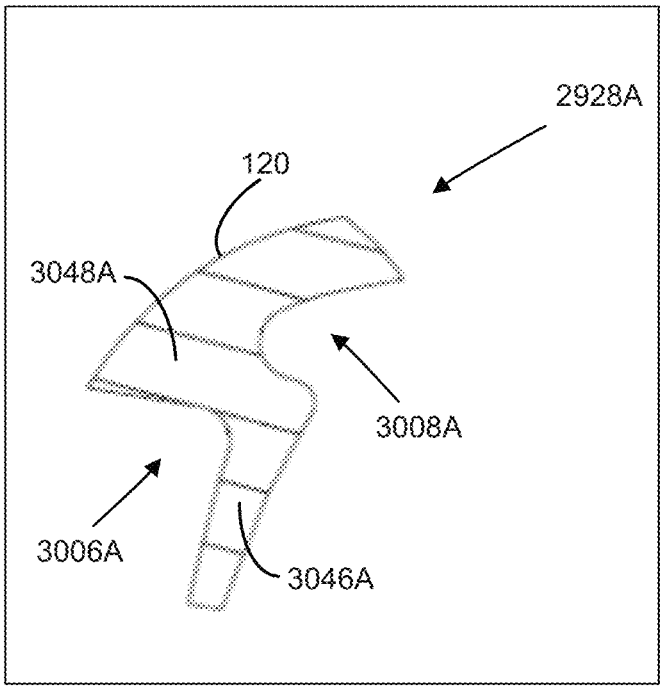
FIG. 30A is a section view of an upper lip of a golf club head in accord with one embodiment of the current disclosure, without a face insert installed.

FIG. 30A is a section view of an upper lip of a golf club head in accord with one embodiment of the current disclosure, without a face insert installed. FIG. 30A depicts an upper face insert support structure 2928A that is adjacent or immediately next to the crown 120. The upper face insert support structure 2928A includes an upper rear support member 3046A and an upper peripheral member 3048A. The upper rear support member 3046A and the upper peripheral member 3048A create an upper undercut recess 3006A forming a lip for receiving the face insert and connecting a portion of the crown 120 to the upper face insert support structure 2928A.

In some embodiments, the upper face insert support structure 2928A is provided in a shape that flexes in a similar manner as the face insert when the golf club head strikes a golf ball. For example, in some golf club head designs, the face insert material, such as a composite material, is more flexible or compliant than the golf club body material, such as an aluminum or titanium alloy. In this example, a slot or recess 3008A may be provided within the upper peripheral member 3048A to increase flexibility or compliance of the upper face insert support structure 2928A, allowing the face to flex more uniformly. Additional and different shapes may be provided to increase or decrease flexibility and compliance of one or more components of the golf club body. By flexing in a similar manner, the golf club head may be more durable, substantially preventing the face insert from decoupling, or de-bonding, from the golf club body.

Figure 30B:
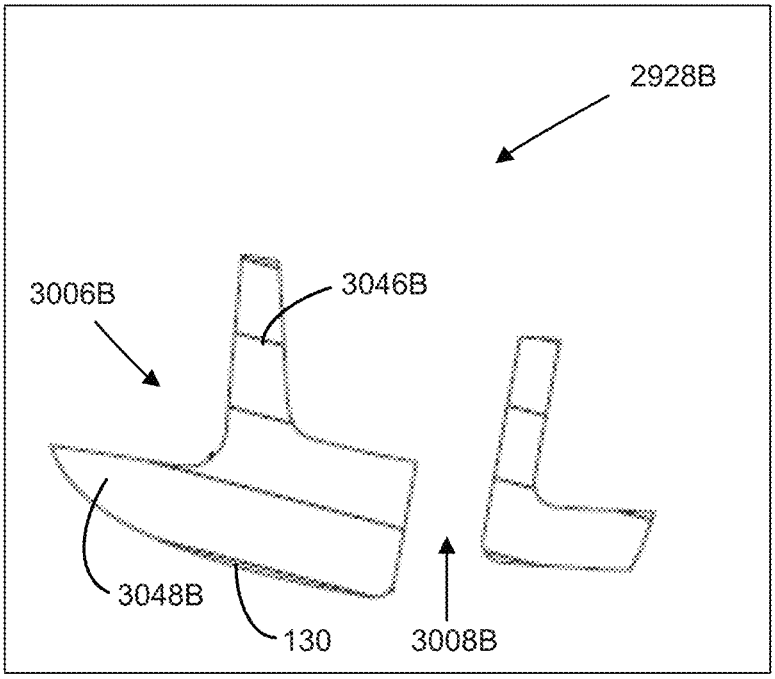
FIG. 30B is a section view of a lower lip of a golf club head in accord with one embodiment of the current disclosure, without a face insert installed.

FIG. 30B is a section view of a lower lip of a golf club head in accord with one embodiment of the current disclosure, without a face insert installed. FIG. 30B depicts a lower face insert support structure 2928B that is adjacent or immediately next to the sole 130. The lower face insert support structure 2928B includes a lower rear support member 3046B and a lower peripheral member 3048B. The lower rear support member 3046B and the lower peripheral member 3048B create a lower undercut recess 3006B forming a lip for receiving the face insert and connecting a portion of the sole 130 to the lower face insert support structure 2928B.

In some embodiments, the lower face insert support structure 2928B is provided in a shape that flexes in a similar manner as the face insert when the golf club head strikes a golf ball. In the example discussed above, the face insert material is more flexible or compliant than the golf club body material. In this example, a slot or recess 3008B may be provided within the lower peripheral member 3048B to increase flexibility or compliance of the upper face insert support structure 2928B, allowing the face to flex more uniformly. Additional and different shapes may be provided to increase or decrease flexibility and compliance of one or more components of the golf club body. By flexing in a similar manner, the golf club head may be more durable, substantially preventing the face insert from decoupling, or de-bonding, from the golf club body.

Figure 31:
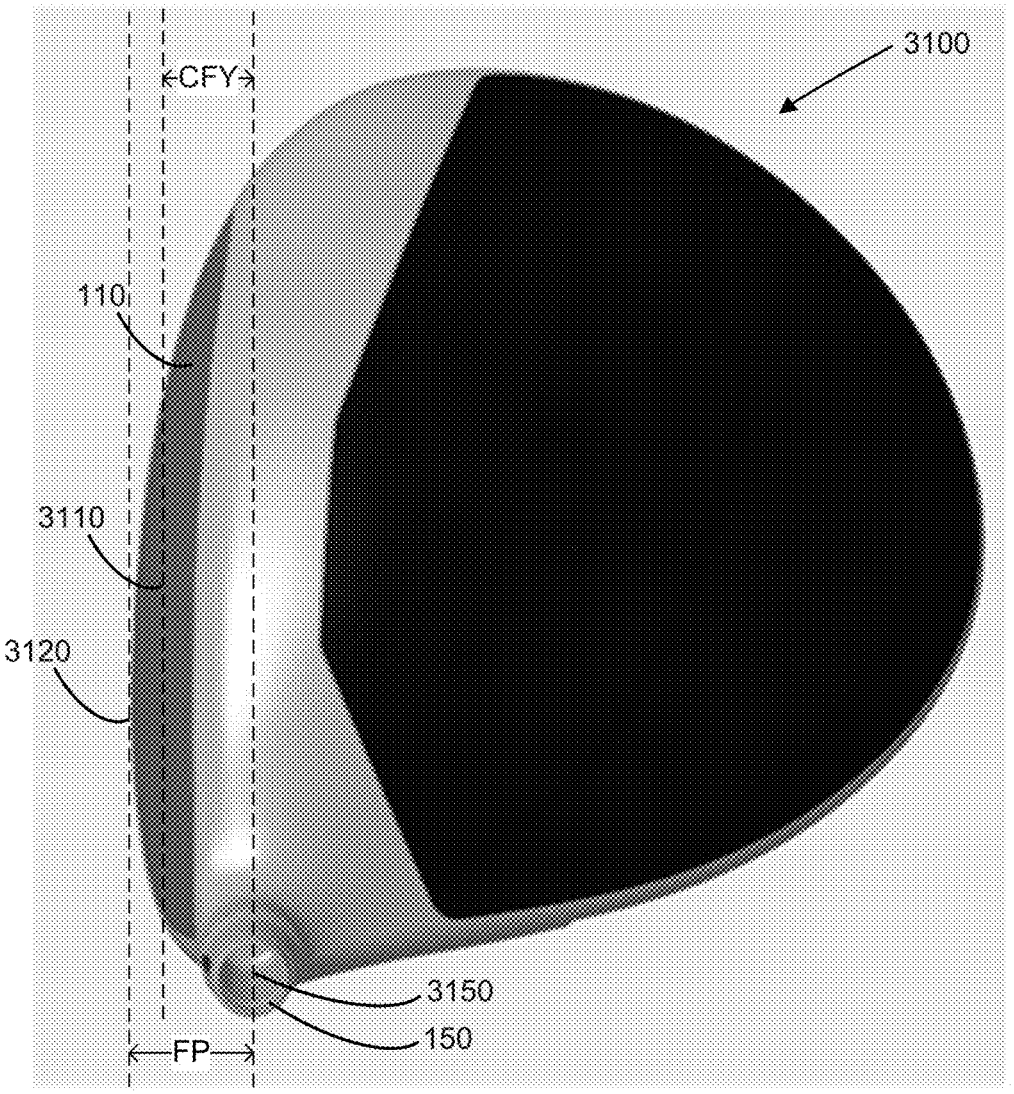
FIG. 31 is a top view of a golf club head in accord with one embodiment of the current disclosure.

FIG. 31 is a top view of a golf club head in accord with one embodiment of the current disclosure. FIG. 31 depicts club head 3100 with hosel 150, face 110 and a center-face location 3110. A center-face y-axis location (CFY) is defined using the center-face location 3110 of face 110 and a center point location 3150 of the hosel 150. A positive CFY produces onset of the golf club head and extends from center point location 3150 of hosel 150 toward the front portion of the golf club head to the center-face location 3110. For example, onset may cause lateral dispersion and the face to appear too far forward of the hosel. A negative CFY produces offset of the golf club head and extends from center point location 3150 of hosel 150 toward the rear portion of the golf club head to the center-face location 3110. A face progression (FP) is defined using the leading-edge location 3120 of face 110 and a center point location 3150 of the hosel 150. Face progression is related to face location, loft and face height. CFY, face progression, and alignment features all influence performance of a golf club head, such as lateral dispersion. For example, if the CFY and/or face progression of the golf club head is changed, one or more alignment features may be provided to counteract the lateral dispersion created or reduced by the CFY and/or face progression.

In some embodiments, a high CFY (e.g., greater than about 15 mm, 14 mm, 13 mm, or another CFY) may produce lateral dispersion right of the intended target line. In other embodiments, a low CFY (e.g., less than about 15 mm, 14 mm, 13 mm, or another CFY) may produce lateral dispersion left of the intended target line. In some embodiments, CFY is between about 13 mm and about 15 mm.

In some embodiments, a high face progression (e.g., greater than about 20 mm, 19 mm, 18 mm, or another face progression) may produce lateral dispersion right of the intended target line. In other embodiments, a low face progression (e.g., less than about 19 mm, 18 mm, 17 mm, or another face progression) may produce lateral dispersion left of the intended target line. In some embodiments, face progression is between about 15 mm and about 20 mm.

In some embodiments, a golf club head is provided with at least one of: CFY no more than 15.5 mm; CFY no more than 15 mm; CFY no more than 14.5 mm; CFY no more than 14 mm; CFY no more than 13.5; CFY no more than 13 mm; face progression no more than 20 mm; face progression no more than 19 mm; face progression no more than 18 mm; face progression no more than 17 mm; and face progression no more than 16 mm. In some embodiments, a golf club head is provided with a CFY no more than 17.5 mm.

Figure 32:
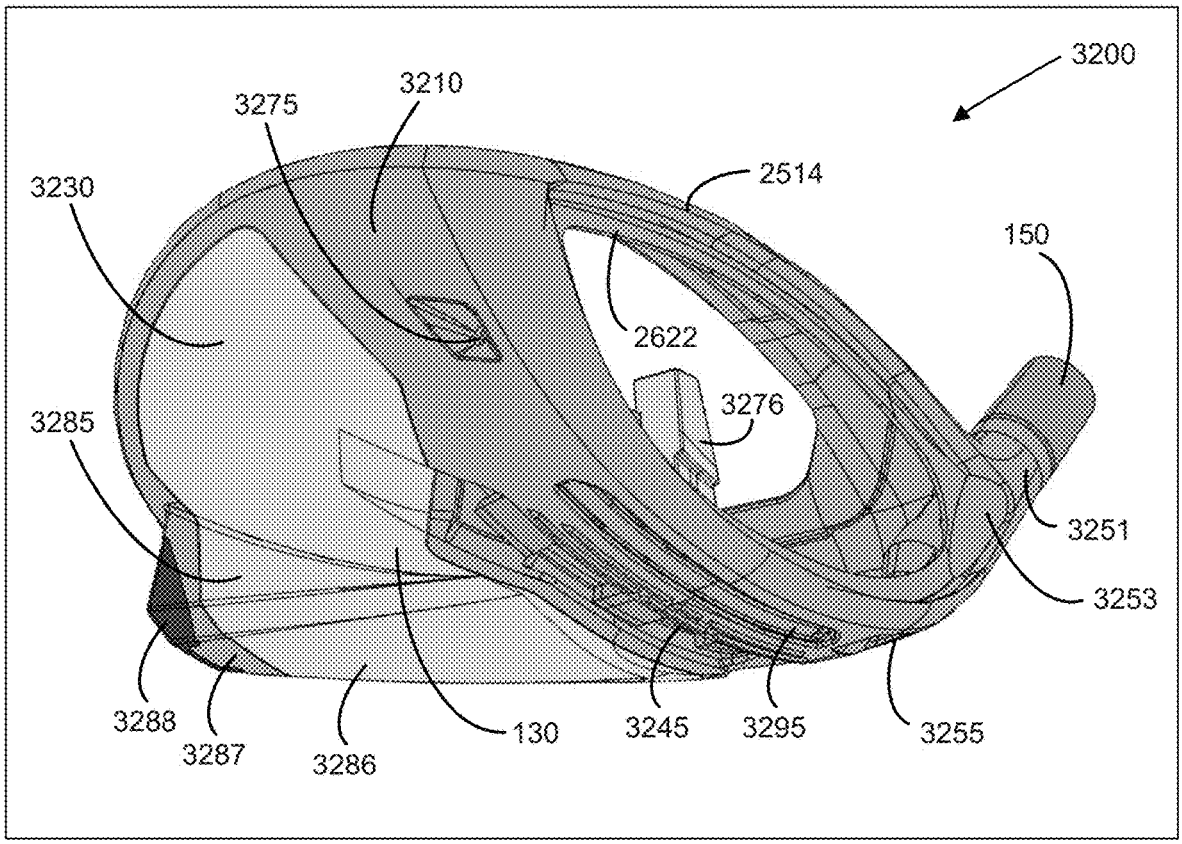
FIG. 32 is a perspective view from a toe side of a golf club head in accord with one embodiment of the current disclosure, without a face insert installed.

FIG. 32 is a perspective view from a toe side of a golf club head 3200. In this embodiment, the golf club head 3200 includes a hollow body 3210. The hollow body 3210 includes a hosel 150, a crown 120 (not depicted), and a sole 130. In some embodiments, the hollow body 3210 has openings to receive the face insert 110 (not depicted), a crown insert 3220, and/or a sole insert 3230. In some embodiments, the hollow body is a metal or composite material frame, and the face insert 110 (not depicted), a crown insert 3220, and/or a sole insert 3230 are at least in part composite materials. The hollow body 3210 is cast with a ledge 2622 for receiving a face insert 110 (not depicted). By bonding the face insert 110 to the ledge 2622, the transition between the face 110 and the crown 120 provide for a primary alignment feature 2514, such as a topline or another alignment feature. For example, the hollow body 3210 may be cast from a titanium alloy, an aluminum alloy, another alloy, or a combination thereof. The hollow body 3210 is painted prior to bonding a face insert 110 (not depicted), a crown insert 3220 (not depicted), and/or a sole insert 3230. By bonding the face insert and/or the crown insert, one or more alignment features are hard tooled into the golf club head 3200. The face insert 110, a crown insert 3220, and/or a sole insert 3230 may be bonded to the hollow body 3210 after the hollow body 3210 is painted, such as by bonding the face insert 110 first, then boding the crown insert 3220. Alternatively, the crown insert 3220 is bonded first, followed by the face insert 110. By bonding the inserts after the hollow body 3210 is painted, the one or more alignment features are hard tooled into the golf club head during casting and bonding. In some embodiments, at least a portion of the crown and sole inserts 3220, 3230 are manufactured from a composite material.

In other embodiments, one or more alignment features are hard tooled into the golf club head by casting one or more witness lines into the golf club head. For example, one or more positive witness lines may be cast into the hollow body 3210, such as by casting a protrusion, ridge, or other raised feature in the hollow body 3210. In another example, one or more negative witness lines may be cast into the hollow body 3210, such as an indentation, valley, or other depressed feature into the hollow body 3210. In some embodiments, a combination of positive and negative witness lines may be provided. The one or more witness line may be painted with the hollow body 3210 to provide one or more alignment features. Alternatively or additionally, the witness lines may be used as a guide for painting one or more alignment features on the golf club head. By casting the witness lines in the golf club head during manufacturing, the subsequent painting of the one or more alignment features may be more accurate from part to part.

Referring back to FIG. 32, in some embodiments, the hosel 150 may be adjustable, such as using flight control technology (FCT) in the hosel 150. For example, FCT may include a loft and lie connection sleeve to adjust, inter alia, face angle. The FCT may be adjustable with a screw 3255 or another connector. The hosel 150 also includes an external hosel surface 3251 and an internal hosel surface 3253. The internal hosel surface 3253 may occupy at least a portion of the face opening or region for receiving the face insert 110 (not depicted). To accommodate the internal hosel surface 3253, a notch or other feature is provided in face insert 110 for accepting at least a portion of the hosel within the face insert 110. As discussed herein, the notch may reduce CFY and accommodates at least a portion of the hosel within the face insert. Further, by accommodating for a portion of the hosel within the face insert, a portion of the face insert may extend high on the heel and follow the natural shape of the crown and/or other features of the club head. In some embodiments, the face insert 110 ties directly into the hosel 150. By accommodating at least a portion of the internal hosel surface 3253 within the face insert 110, a center-face location 3110 (not depicted) of the face insert 110 may be located closer to a center point location 3150 (not depicted) of the hosel 150, reducing CFY and increasing performance of the golf club head.

In some embodiments, the golf club head 3200 includes a slot 3295 and a weight track 3245. For example, the slot 3295 and/or the weight track 3245 may be cast into the hollow body 3210. As will be discussed below, the slot 3295 may increase the durability of the golf club head by allowing at least a portion of the hollow body 3210 to flex similarly to the face insert 110, increasing performance of the golf club head and increasing the durability of the golf club head by preventing the face insert 110 from decoupling from the hollow body 3210. In some embodiments, the golf club head 3200 includes one or more characteristic time (CT) tuning ports. Referring to FIG. 32, a CT tuning port 3275 is provided in the toe portion of the hollow body 3210. Another CT tuning port (not depicted) may be provided in the heel portion of the hollow body 3210. The one or more CT tuning ports may be provided in additional and different locations on the golf club head 3200, such in the face insert 110 or in another location. Using the CT tuning port(s), an adhesive or another material may be injected into the golf club head 3200 to reduce or increase the CT of the golf club head. For example, the golf club head 3200 may be manufactured with a CT that does not conform to the United States Golf Association (USGA) regulations that constrain CT of golf club heads. By injecting an adhesive into the CT tuning port 3275, the CT of the golf club head is detuned to conform to the USGA regulations.

In some embodiments, the golf club head includes one or more foam inserts. For example, a foam insert 3276 is positioned within the hollow body 3210. An additional foam insert is also provided proximate to the toe portion (not depicted). The one or more foam inserts aid in CT tuning the golf club head by restraining the adhesive or other material to locations within the golf club head while the material solidifies. Additionally, a rear wall may also be provided to further restrain the material while it solidifies. Accordingly, the foam inserts and the rear wall prevent the adhesive injected into the tuning port 3275 from moving too far toeward, heelward, and backward, allowing the golf club head to be CT tuned more precisely. Additional and different structures may be provided to restrain the injected materials during CT tuning.

In some embodiments, the golf club head includes a multi-material inertia generator. An inertia generator, as discussed herein, may also be referred to as an aft winglet and a center of gravity (CG) lowering platform. The inertia generator 3285 moves discretionary mass rearward to increase inertia and to move the CG projection lower on the face of the golf club head. For example, the golf club head 3200 includes an inertia generator 3285 extending rearwardly and angled toewardly from the front portion of the golf club head 3200 to the rear portion of the golf club head 3200. A multi-material inertia generator may include two or more materials of different densities. For example, the inertia generator 3285 includes one or more of a low density portion 3286, a medium density portion 3287, and a high density portion 3288.

The low density portion 3286 may be a composite or another material, such as a portion of the composite sole panel 3230 or as another component. The low density portion 3286 has a density of less than about 2 g/cc, such as between about 1 g/cc and about 2 g/cc. The medium density portion 3287 may be an aluminum alloy, a titanium alloy, another alloy, another material, or a combination of multiple alloys or materials, such as a portion of the hollow body 3210 or as another component. The medium density portion 3287 has a density greater than about 2.7 g/cc, such as between about 1 g/cc and about 5 g/cc, between about 2.0 g/cc and about 5.0 g/cc, and between about 2.5 g/cc and about 4.5 g/cc. The high density portion 3288 may be a steel alloy, a tungsten alloy, another alloy, another material, or a combination of multiple alloys or materials, such as a rear weight affixed to the inertia generator 3285 or as another component. The high density portion 3288 has a density greater than about 7 g/cc. For example, an aluminum alloy is often about 2.7 g/cc, a titanium alloy is often about 4.5 g/cc, a steel alloy is often about 7.8 g/cc, and tungsten alloy a tungsten alloy is often about 19 g/cc.

Figure 33:
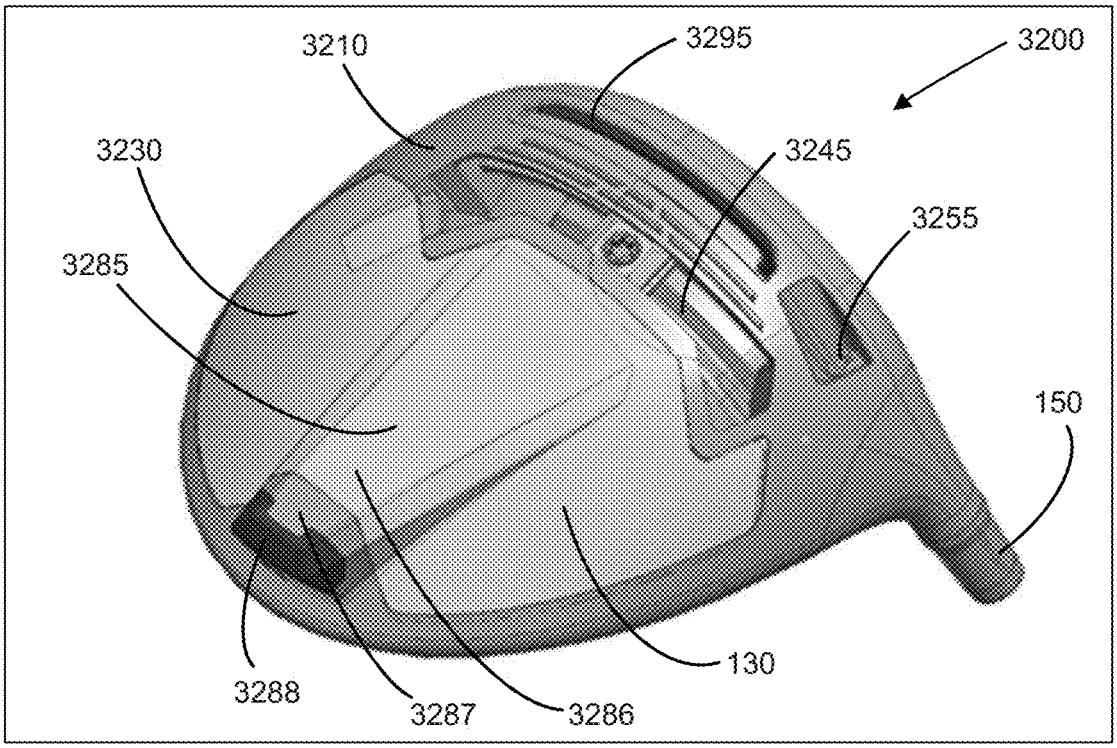
FIG. 33 is a perspective view from heel side of a golf club head in accord with one embodiment of the current disclosure.

FIG. 33 is a perspective view from a toe side of a golf club head 3200. FIG. 33 provides another view of the sole 130 with the insert 3230, the inertia generator 3285, the slot 3295, the weight track 3245 and the screw 3255. The inertia generator 3285 is provided as a multi-material inertia generator, with a low density portion 3286, medium density portion 3287, and high density portion 3288.

Figure 34:
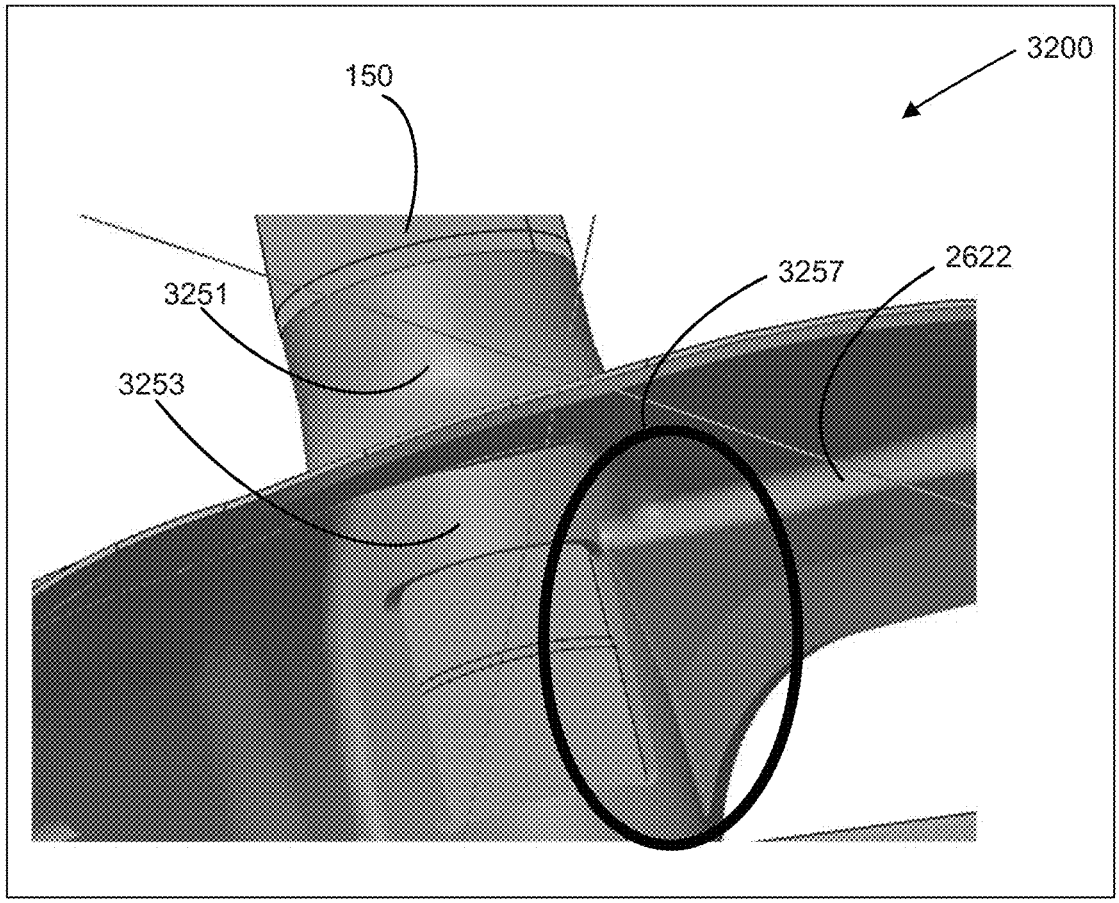
FIG. 34 is a perspective view of a portion of a golf club head in accord with one embodiment of the current disclosure.

FIG. 34 is a perspective view of a portion of a golf club head 3200. FIG. 34 shows the hosel 150 with the external hosel surface 3251 and the internal hosel surface 3253. As depicted in FIG. 34, the ledge 2622 for receiving a face insert 110 (not depicted) is joined to the internal hosel surface 3253 within an intersection region 3257. The face support, such as including ledge 2622, intersects and joins with the internal hosel surface 3253 allowing the internal hosel surface 3253 to interact with and/or be at least partially within the face insert 110. The face support may intersect and/or join the internal hosel surface 3253 proximate to the crown, proximate to the sole, or proximate to the crown and the sole.

Figure 35:
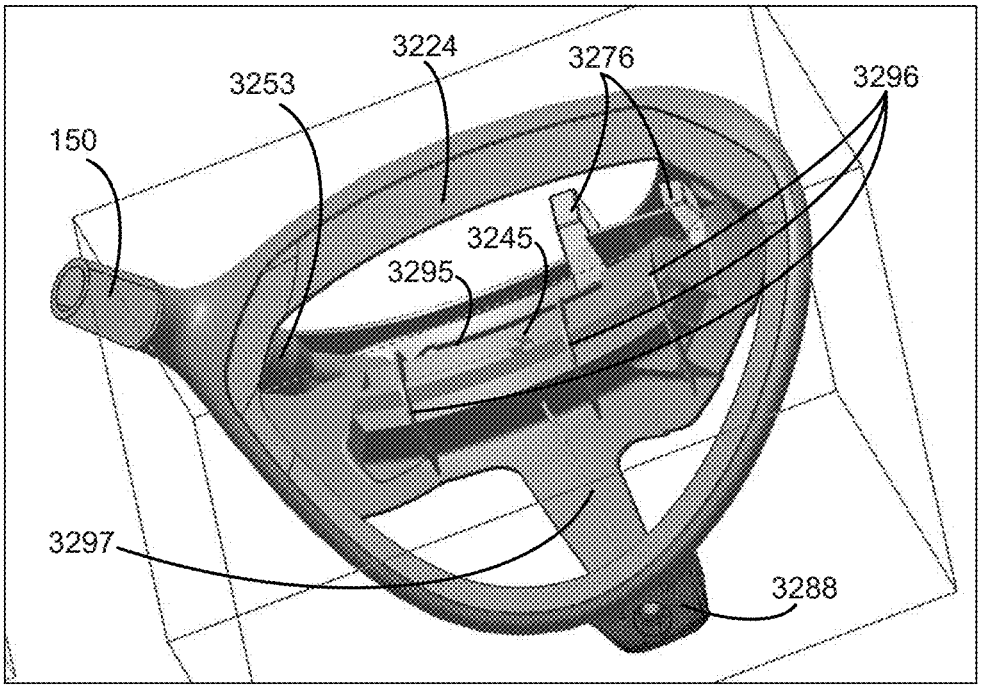
FIG. 35 is a perspective view from the rear portion of a golf club head in accord with one embodiment of the current disclosure, without a crown insert installed.

FIG. 35 is a perspective view from the rear portion of a golf club head 3200, without a crown insert 3220 installed. FIG. 35 shows a club head 3200 with hosel 150, internal hosel surface 3253, foam inserts 3276, and high density portion 3288. A ledge 3224 is provided for bonding a crown insert 3220 (not depicted). The ledge 3224 is wider proximate to the front portion and the face of the club head to provide for additional CT tuning. For example, in addition to supporting the crown insert 3220, a width of the ledge 3224 is increased to decrease the CT of the club head. In an embodiment, the ledge 3224 width is increased from about 10 mm to about 15 mm proximate the face. During or after manufacture, material can be removed from the ledge 3224 to increase the CT of the club head, such as increasing the CT by about 8 to about 10 points. As discussed above, CT tuning is typically used to reduce CT of a club head to meet the USGA constraints. If the CT of a club head is determined to be too far under the USGA constraints, the club head can tuned using the ledge 3224 to increase CT to approach or exceed the USGA constraints.

In some embodiments, the golf club head 3200 includes support ribs 3296, 3297. For example, support ribs 3296 provide for additional support for the hollow body 3210, the weight track 3245 and/or slot 3295. The support ribs 3296 may be provided over the weight track 3245 and in other areas within the hollow body 3210. Support rib 3297 may be provided to support supports the hollow body 3210 and inertia generator 3285. As depicted in FIG. 35, the hollow body 3210 includes a platform of material extending in the direction of the inertia generator 3285 that includes the support rib 3297. Additional and different support ribs may be provided.

Figure 36:
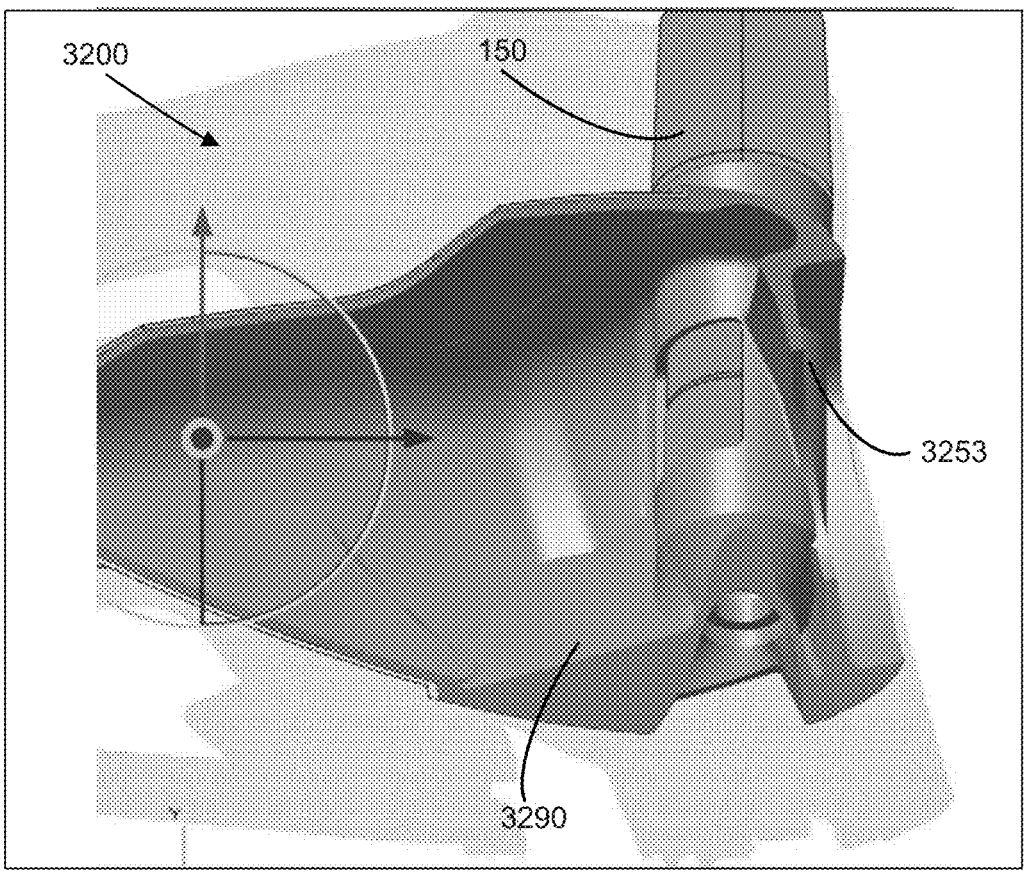
FIG. 36 is a view of a portion of a golf club head in accord with one embodiment of the current disclosure.
Figure 37:
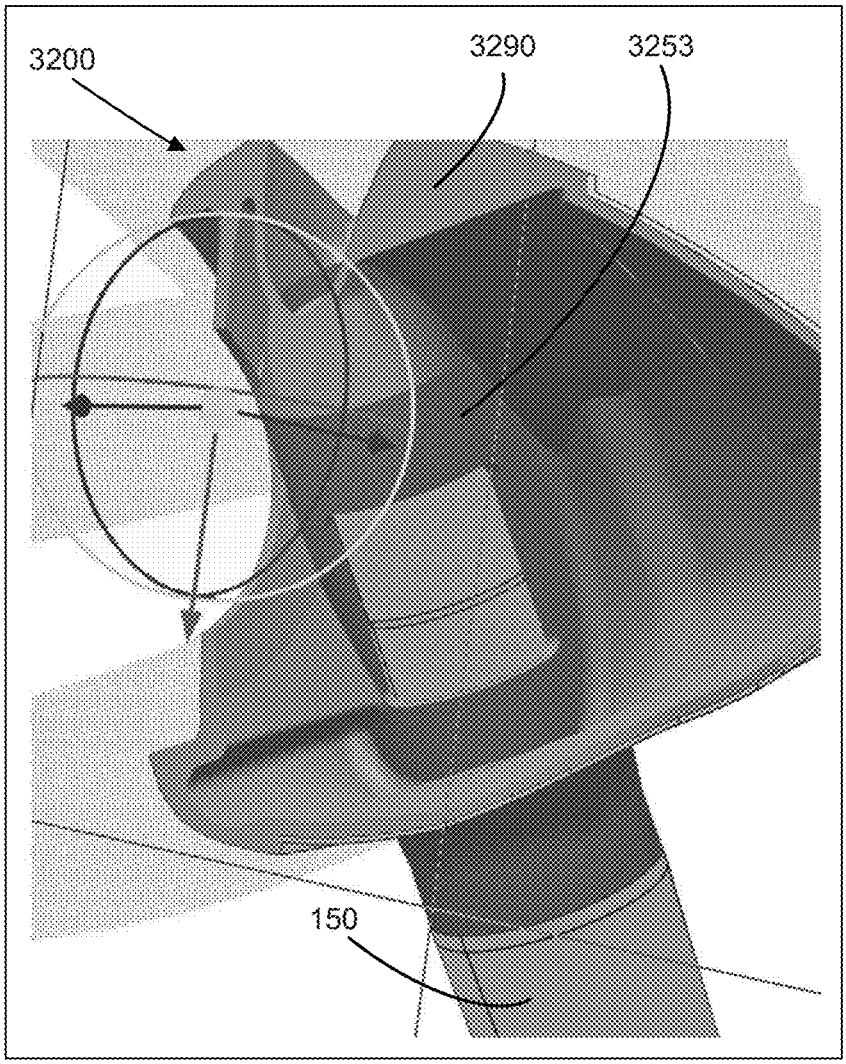
FIG. 37 is a view of a portion of a golf club head in accord with one embodiment of the current disclosure.

FIGS. 36-37 are views of portions of a golf club head 3200. FIG. 36 shows internal hosel surface 3253 occupying at least a portion of the face opening or region for receiving the face insert 110 (not depicted). By occupying at least a portion of the face opening or region for receiving the face insert 110, face progression and onset may be reduced, increasing performance of the golf club head 3200.

In some embodiments, the golf club head 3200 includes a mass pad 3290 in the heel portion of the golf club head. Mass pad 3290 positions discretionary mass of the golf club head 3200 heelward, and may lower the CG and move CG forward to modify the CG projection onto the face. In some embodiments, a removable and/or adjustable weight may be provided in the heel portion in lieu of or in addition to the mass pad 3290.

Figure 38:
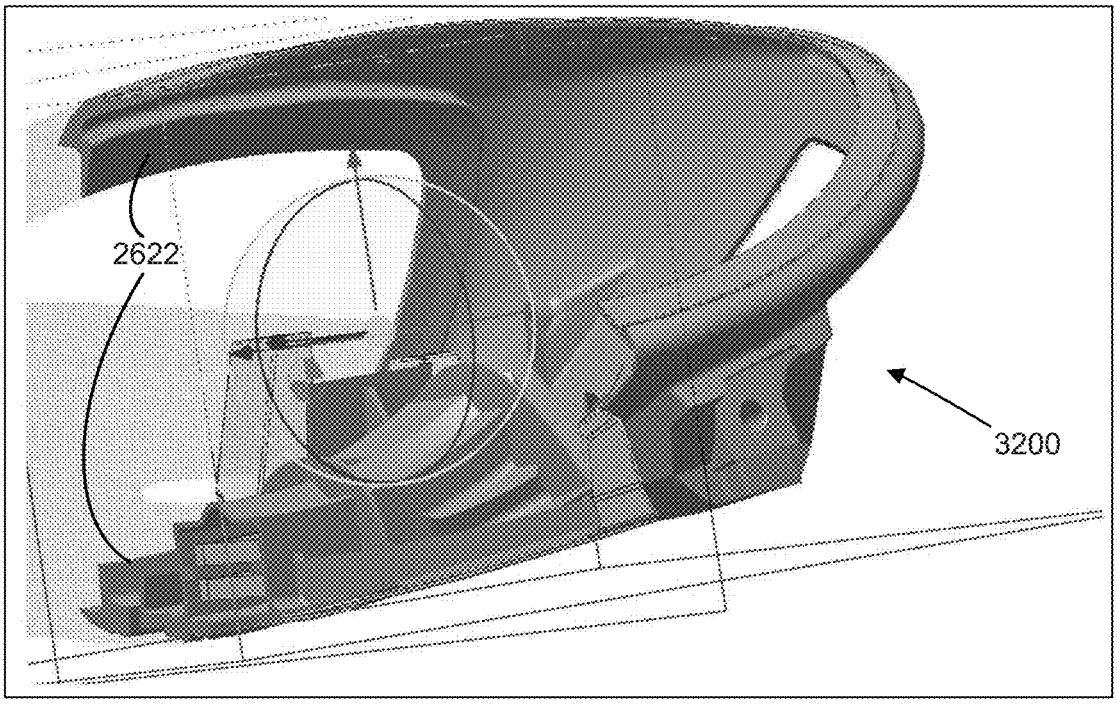
FIG. 38 is a view of a portion of a golf club head in accord with one embodiment of the current disclosure.
Figure 39:
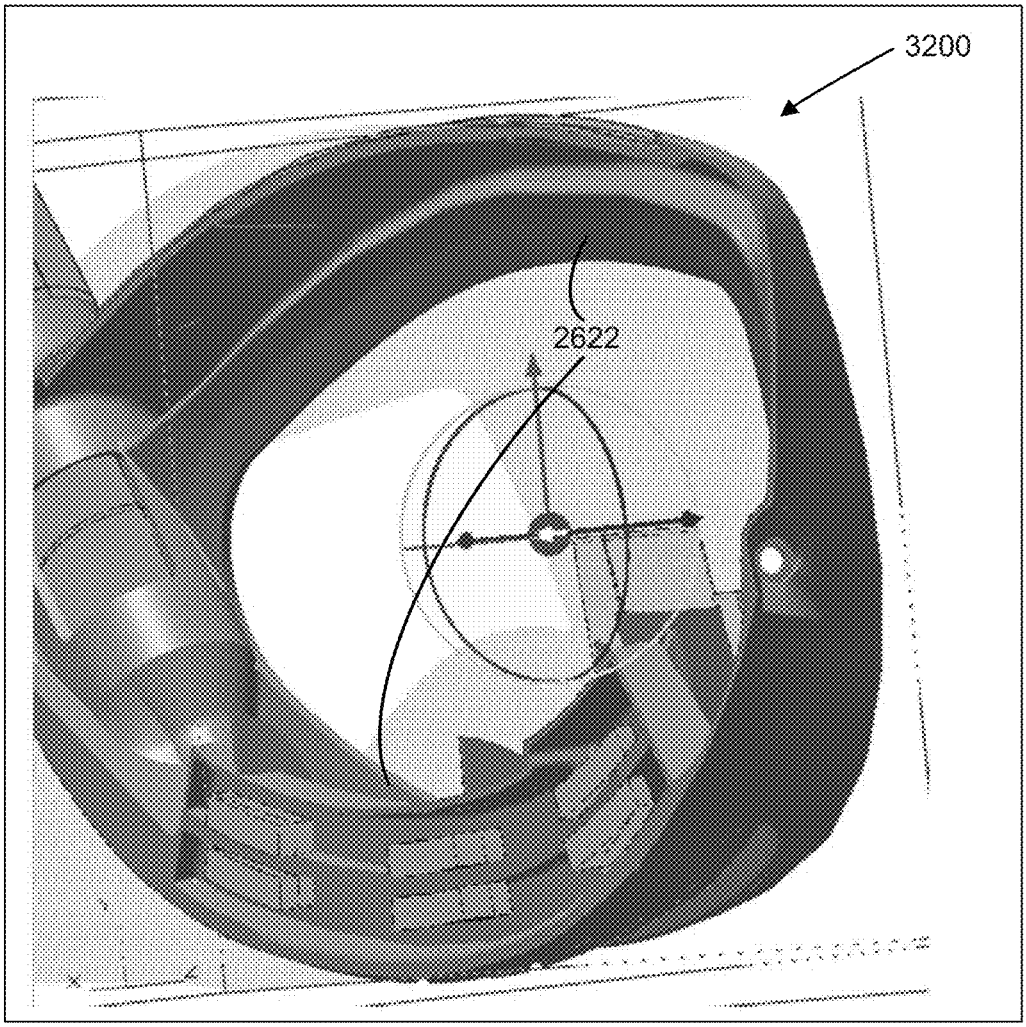
FIG. 39 is a view of a portion of a golf club head in accord with one embodiment of the current disclosure.

FIGS. 38-39 are views of portions of a golf club head 3200. As depicted in FIGS. 38-39, the ledge 2622 extends around the entire periphery of the face opening to support the face insert 110 (not depicted). By extending around the entire periphery, the ledge 2622 supports the entire face insert 110. In other embodiments, the ledge 3224 supports the face insert 110 in the heel portion, toe portion, crown portion and sole portion. For example, the ledge 2622 supports the face insert 110 in a region defined by about a 10 mm band about the geometric center of the face insert 110. Other bands about the geometric center of the face insert may be used, such as about 15 mm and about 20 mm. (prior art only had support in the heel and toe regions). Additional and different structures may be used to support the face around the entire periphery of the face or in regions about the geometric center of the face.

Figure 40:
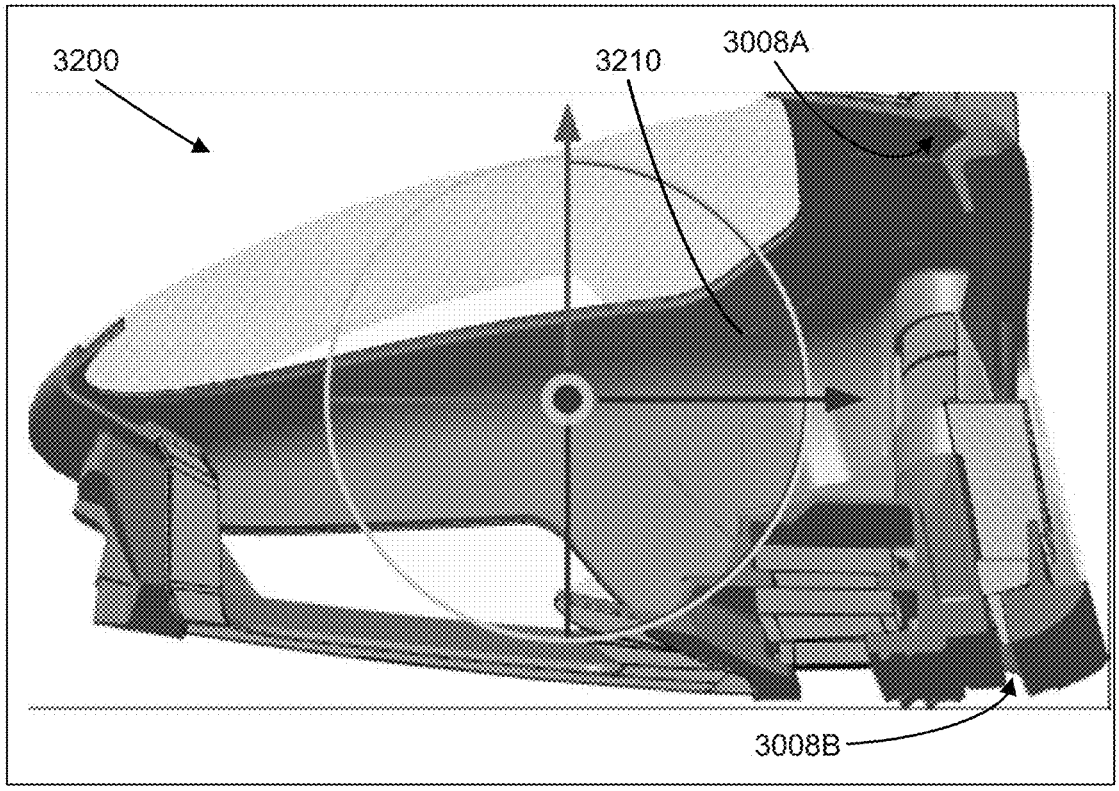
FIG. 40 is a view of a portion of a golf club head in accord with one embodiment of the current disclosure.

FIG. 40 is a view of a portion of a golf club head 3200. FIG. 40 shows the upper face insert support structure 2928A and the lower face insert support structure 2928B provided so that at least a portion of the hollow body 3210 flexes in a similar manner as the face insert 110 (not depicted) when the golf club head strikes a golf ball. Different materials (e.g., metal alloys and composites) have different flex characteristics and typically flex differently from each other. For example, the slot or recess 3008A and the slot or recess 3008B allow a composite face to flex more uniformly with the cast hollow body 3210. Additional and different geometries within the hollow body 3210 may be provided. By flexing in a similar manner, the golf club head may be more durable, substantially preventing the face insert from decoupling, or de-bonding, from the golf club body.

Figure 41:
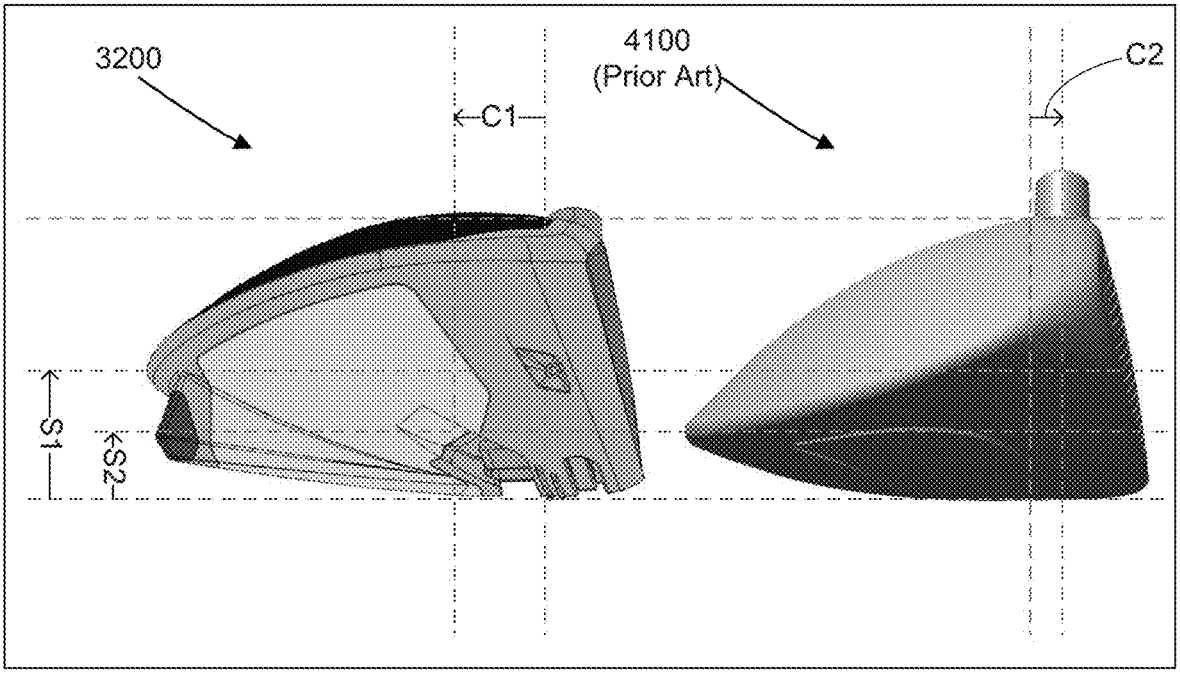
FIG. 41 is a perspective view from a toe side of two golf club heads, one golf club head in accord with one embodiment of the current disclosure and one golf club head in accord with a prior art club head.

FIG. 41 is a perspective view from a toe side of two golf club heads 3200, 4100. The golf club head 3200 is an embodiment of the present disclosures and golf club head 4100 is an embodiment of a prior art club head design. The golf club head 3200 includes features that improve the aerodynamic features of the club head. For example, the prior art club head 4100 has a peak crown height that is located approximately in line with a center shaft axis of the hosel, referred to as an acute crown. To promote better aerodynamic properties of the golf club head 3200, the peak crown height is located rearward of the hosel, referred to as an obtuse crown. Referring to FIG. 41, the peak crown height of the golf club head 4100 is located a distance C2 forward of the rear-most edge of the hosel. To promote better aerodynamics, the peak crown height of the golf club head 3200 is located a distance C1 rearward of the rear-most edge of the hosel. In an embodiment, the peak crown height of the golf club head 3200 is located at least about 15 mm rearward of the rear-most edge of the hosel. Moving the peak crown height rearward allows aero flow to be attached to the club head longer, promoting better aerodynamic properties.

The skirt height of golf club 3200 may also improve aerodynamic features of the golf club head. Golf club head 3200 has a skirt height S1, which may measure the lowest point above the ground plane at which the skirt meets the crown. Golf club head 4100 has a skirt height S2. In some embodiments, the skirt height S1 is at least 20 mm, and in some embodiments may be between about 25 mm and about 40 mm, such as between 30 mm and 40 mm, or between 30 mm and 35 mm. Increasing the skirt height S1 of golf club head 3200 likewise improves the aerodynamic properties of the golf club head. The golf club body has a total body height from defined from a bottom most portion of the golf club body, or the ground plane, to a top most portion of the crown, or the peak crown height, such as vertically or along a z-axis. In some embodiments, the total body height is no less than 48 mm, no less than 42 mm, or no less than 53 mm. The golf club body also has a body length defined from a leading edge of the golf club body, or the leading-edge location, to a rearward most portion of golf club head, or the rearward most portion of the skirt, such as horizontally or along a y-axis. In some embodiments, the body length is no less than 98 mm, no less than 93 mm, or no less than 103 mm.

Figure 42:
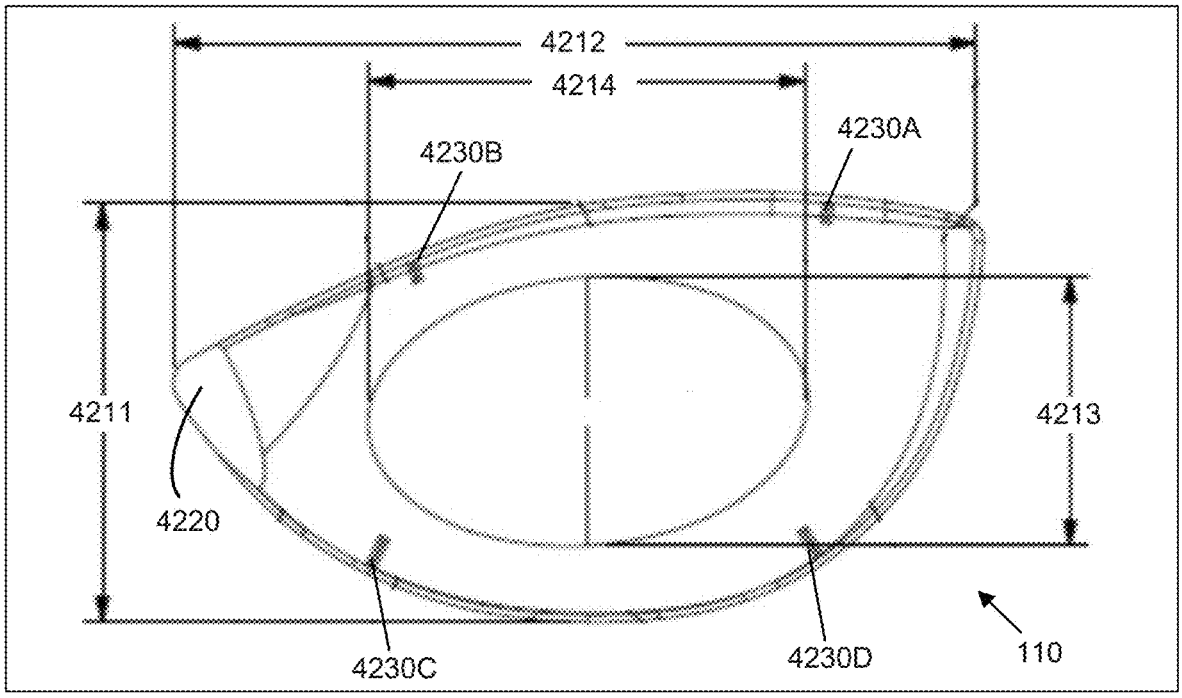
FIG. 42 is a is a front elevation view of a face insert according to an embodiment.

FIG. 42 is a front elevation view of a face insert 110. Further details concerning the construction and manufacturing processes for the composite face plate are described in U.S. Pat. No. 7,871,340 and U.S. Published Patent Application Nos. 2011/0275451, 2012/0083361, and 2012/0199282. The composite face plate is attached to an insert support structure located at the opening at the front portion of the club head. Further details concerning the insert support structure are described in U.S. Pat. No. RE43,801.

In some embodiments, the face insert 110 can be machined from a composite plaque. In an example, the composite plaque can be substantially rectangular with a length between about 90 mm and about 130 mm or between about 100 mm and about 120 mm, preferably about 110 mm±1.0 mm, and a width between about 50 mm and about 90 mm or between about 6 mm and about 80 mm, preferably about 70 mm±1.0 mm plaque size and dimensions. The face insert 110 is then machined from the plaque to create a desired face profile. For example, the face profile length 4212 can be between about 80 mm and about 120 mm or between about 90 mm and about 110 mm, preferably about 102 mm. The face profile width 4211 can be between about 40 mm and about 65 mm or between about 45 mm and about 60 mm, preferably about 53 mm. The ideal striking location width 4213 can be between about 25 mm and about 50 mm or between about 30 mm and about 40 mm, preferably about 34 mm. The ideal striking location length 4214 can be between about 40 mm and about 70 mm or between about 45 mm and about 65 mm, preferably about 55.5 mm. Alternatively, the face insert 110 can be molded to provide the desired face dimensions and profile.

In embodiments where the face insert 110 is machined from a composite plaque, the face insert 110 can be machined in one or more operations, such as computer numerical control (CNC) or other operations. For example, starting with the composite plaque, a notch 4220 can be first machined from the plaque. Next, a perimeter chamfer can be machined around the perimeter of the face insert 110. Finally, a face profile can be machined from the plaque. In some embodiments, each of the notch 4220, perimeter chamfer, and face profile can be machined in a single operation, such as a single CNC operation without removing the plaque from the CNC fixture. In other embodiments, multiple operations can be performed, such as machining one or more of the notch 4220, perimeter chamfer, or face profile being machined separately from the other features of the face. Other orders of machining features can be provided, such as machining the notch after the face profile and chamfer, as well as machining additional features into the face insert 110, such as bond gap bumps and other features.

Additional features can be machined or molded into face the insert 110 to create the desired face profile. For example, a notch 4220 can be machined or molded into the backside of a heel portion of the face insert 110. For example, the notch 4220 in the back of the face insert 110 allows for the golf club head 2500 to utilize flight control technology (FCT) in the hosel 150. The notch 4220 can be configured to accept at least a portion of the hosel within the face insert 110. Alternatively or additionally, the notch 4220 can be configured to accept at least a portion of the club head body within the face insert 110.

In some embodiments, the notch 4220, or another relief portion, defines a transition region on the face insert. For example, the notch 4220 or relief portion is proximate to a heel portion of the face and can have an area of at least about 50 $mm^2$ and no more than about 300 $mm^2$, preferably less than about 200 $mm^2$, more preferably between about 75 $mm^2$ and about 150 $mm^2$. Preferably, the notch area is about 1.5% to about 6% of the external area of the face insert (e.g., the outward facing portion of the face configured for striking the golf ball), more preferably the notch area is about 2% to about 3% of the external face insert.

The notch may allow for the reduction of CFY by accommodating at least a portion of the hosel and/or at least a portion of the club body within the face insert, allowing the ideal striking location of the face insert to be closer to a plane passing through a center point location of the hosel. The face insert 110 can be configured to provide a CFY no more than about 18 mm and no less than about 9 mm, preferably between about 11.0 mm and about 16.0 mm, and more preferably no more than about 15.5 mm and no less than about 11.5 mm. The face insert 110 can be configured to provide face progression no more than about 21 mm and no less than about 12 mm, preferably no more than about 19.5 mm and no less than about 13 mm and more preferably no more than about 18 mm and no less than about 14.5 mm. In some embodiments, a difference between CFY and face progression is at least 2 mm and no more than 12 mm, preferably between at least 3 mm and 8 mm. In other embodiments, a difference between CFY and face progression is at least 2 mm and no more than 4 mm.

In another example, backside bumps 4230A, 4230B, 4230C, 4230D may be machined or molded into the backside of the face insert. The backside bumps 4230A, 4230B, 4230C, 4230D can be configured to provide for a bond gap. A bond gap is an empty space between the club head body and the face insert that is filled with adhesive during manufacturing. The backside bumps 4230A, 4230B, 4230C, 4230D protrude to separate the face from the club head body when bonding the face insert to the club head body during manufacturing. In some instances, too large or too small of a bond gap may lead to durability issues of the club head, the face insert, or both. Further, too large of a bond gap can allow too much adhesive to be used during manufacturing, adding unwanted additional mass to the club head. The backside bumps 4230A, 4230B, 4230C, 4230D can protrude between about 0.1 mm and 0.5 mm, preferably about 0.25 mm. In some embodiments, the backside bumps are configured to provide for a minimum bond gap, such as a minimum bond gap of about 0.25 mm and a maximum bond gap of about 0.45 mm.

Further, one or more of the edges of the face insert 110 can be machined or molded with a chamfer. In an example, the face insert 110 includes a chamfer substantially around the inside perimeter edge of the face insert, such as a chamfer between about 0.5 mm and about 1.1 mm, preferably 0.8 mm. In some embodiments, the perimeter chamfer is provided to avoid the face insert 110 bottoming out on an internal radius of the recessed face opening of the golf club head configured to receive the face insert 110. By providing the perimeter chamfer, the face insert 110 can fit properly within recessed face opening despite manufacturing variances and other characteristics of the golf club head created during the casting process.

Figure 43:
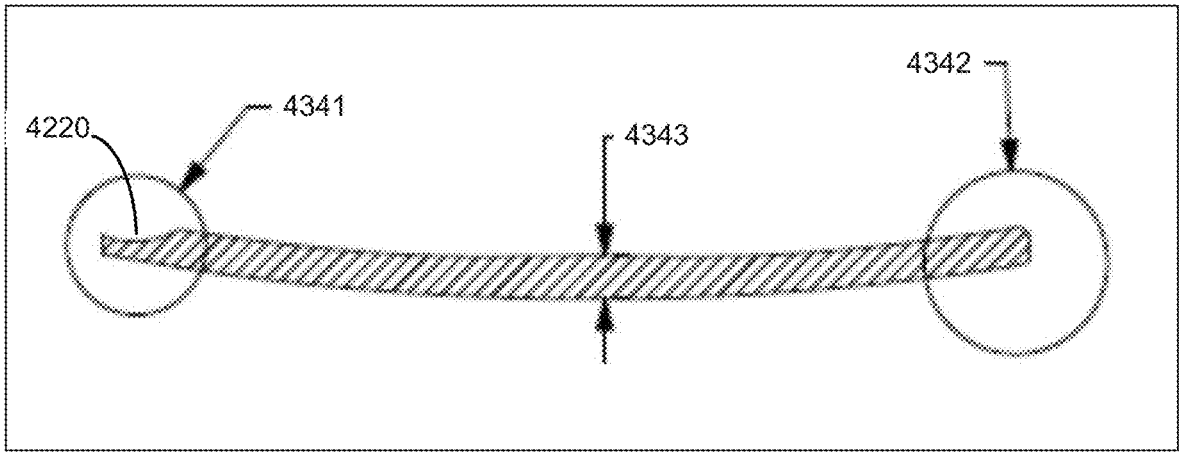
FIG. 43 is a is a bottom perspective view of a face insert according to an embodiment.

FIG. 43 is a is a bottom perspective view of a face insert 110. The face insert has a heel portion 4341 and a toe portion 4342. The notch 4220 is machined or molded into the heel portion 4341. In this example, the face insert 110 has a variable thickness, such as with a peak thickness 4343. The peak thickness 4343 can be between about 2 mm and about 7.5 mm or between about 3.8 mm and about 4.8 mm, preferably 4.1 mm±0.1 mm, 4.25 mm±0.1 mm, or 4.5 mm±0.1 mm.

In some embodiments, the face insert 110 is manufactured from multiple layers of composite materials. Exemplary composite materials and methods for making the same are described in U.S. patent application Ser. No. 13/452,370 (published as U.S. Pat. App. Pub. No. 2012/0199282), which is incorporated by reference. In some embodiments, an inner and outer surface of the composite face can include a scrim layer, such as to reinforce the face insert 110 with glass fibers making up a scrim weave. Multiple quasi-isotropic panels (Q's) can also be included, with each Q panel using multiple plies of unidirectional composite panels offset from each other. In an exemplary four-ply Q panel, the unidirectional composite panels are oriented at 90°, −45°, 0°, and 45°, which provide for structural stability in each direction. Clusters of unidirectional strips (C's) can also be included, with each C using multiple unidirectional composite strips. In an exemplary four-strip C, four 27 mm strips are oriented at 0°, 125°, 90°, and 55°. C's can be provided to increase thickness of the face insert 110 in a localized area, such as in the center face at the ideal striking location. Some Q's and C's can have additional or fewer plies (e.g., three-ply rather than four-ply), such as to fine tune the thickness, mass, localized thickness, and provide for other properties of the face insert 110, such as to increase or decrease COR of the face insert 110.

Additional composite materials and methods for making the same are described in U.S. Pat. Nos. 8,163,119 and 10,046,212, which is incorporated by reference. For example, the usual number of layers for a striking plate is substantial, e.g., fifty or more. However, improvements have been made in the art such that the layers may be decreased to between 30 and 50 layers.

The tables below provide examples of possible layups. These layups show possible unidirectional plies unless noted as woven plies. The construction shown is for a quasi-isotropic layup. A single layer ply has a thickness of ranging from about 0.065 mm to about 0.080 mm for a standard FAW of 70 gsm with about 36% to about 40% resin content. The thickness of each individual ply may be altered by adjusting either the FAW or the resin content, and therefore the thickness of the entire layup may be altered by adjusting these parameters.

In addition to the unidirectional composite panels oriented at 90°, −45°, 0°, and 45°, additional Q panels can be provided according to table 1.

TABLE 1

| ply 1 | ply 2 | ply 3 | ply 4 | ply 5 | ply 6 | ply 7 | ply 8 | AW g/$m^2$ |
|---|---|---|---|---|---|---|---|---|
| 0 | −60 | +60 | | | | | | 290-360 |
| 0 | −45 | +45 | 90 | | | | | 390-480 |
| 0 | +60 | 90 | −60 | 0 | | | | 490-600 |
| 0 | +45 | 90 | −45 | 0 | | | | 490-600 |
| 90 | +45 | 0 | −45 | 90 | | | | 490-600 |
| +45 | 90 | 0 | 90 | −45 | | | | 490-600 |
| +45 | 0 | 90 | 0 | −45 | | | | 490-600 |
| −60 | −30 | 0 | +30 | 60 | 90 | | | 590-720 |
| 0 | 90 | +45 | −45 | 90 | 0 | | | 590-720 |
| 90 | 0 | +45 | −45 | 0 | 90 | | | 590-720 |
| 0 | 90 | 45 | −45 | −45 | 45 | 0/90 woven | | 680-840 |
| 90 | 0 | 45 | −45 | −45 | 45 | 90/0 woven | | 680-840 |
| +45 | −45 | 90 | 0 | 0 | 90 | −45/+45 woven | | 680-840 |
| 0 | 90 | 45 | −45 | −45 | 45 | 90 UD | | 680-840 |

TABLE 1-continued

| ply 1 | ply 2 | ply 3 | ply 4 | ply 5 | ply 6 | ply 7 | ply 8 | AW g/m$^2$ |
|---|---|---|---|---|---|---|---|---|
| 0 | 90 | 45 | −45 | 0 | −45 | 45 | 0/90 woven | 780-960 |
| 90 | 0 | 45 | −45 | 0 | −45 | 45 | 90/0 woven | 780-960 |

The Area Weight (AW) is calculated by multiplying the density times the thickness. For the plies shown above made from composite material the density is about 1.5 g/cm$^3$ and for titanium the density is about 4.5 g/cm$^3$.

In an example, a first face insert can have a peak thickness of 4.1 mm and an edge thickness of 3.65 mm, including 12 Q's and 2 C's, resulting in a mass of 24.7 g. In another example, a second face insert can have a peak thickness of 4.25 mm and an edge thickness of 3.8 mm, including 12 Q's and 2 C's, resulting in a mass of 25.6 g. The additional thickness and mass is provided by including additional plies in one or more of the Q's or C's, such as by using two 4-ply Q's instead of two 3-ply Q's. In yet another example, a third face insert can have a peak thickness of 4.5 mm and an edge thickness of 3.9 mm, including 12 Q's and 3 C's, resulting in a mass of 26.2 g. Additional and different combinations of Q's and C's can be provided for a face insert 110 with a mass between about 20 g and about 30 g, or between about 15 g and about 35 g.

Figure 44A:
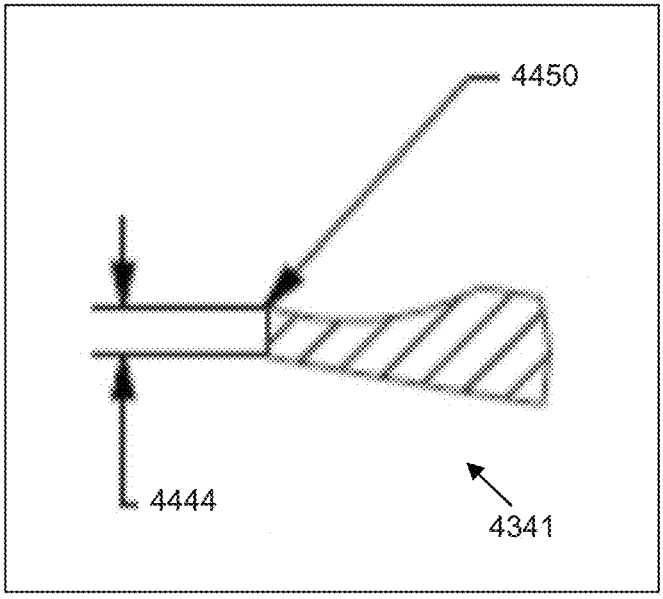
FIG. 44A is a section view of a heel portion of a face insert according to an embodiment.

FIG. 44A is a section view of a heel portion 4341 of a face insert 110. The heel portion 4341 can include a notch 4220. In embodiments with a chamfer on an inside edge of the face insert 110, no chamfer 4450 can be provided on the notch 4220. The notch 4420 can have a notch edge thickness 4444 less than the edge thickness 4345 of the face insert 110. For example, the notch edge thickness 4444 can be between 1.5 mm and 2.1 mm, preferably 1.8 mm.

Figure 44B:
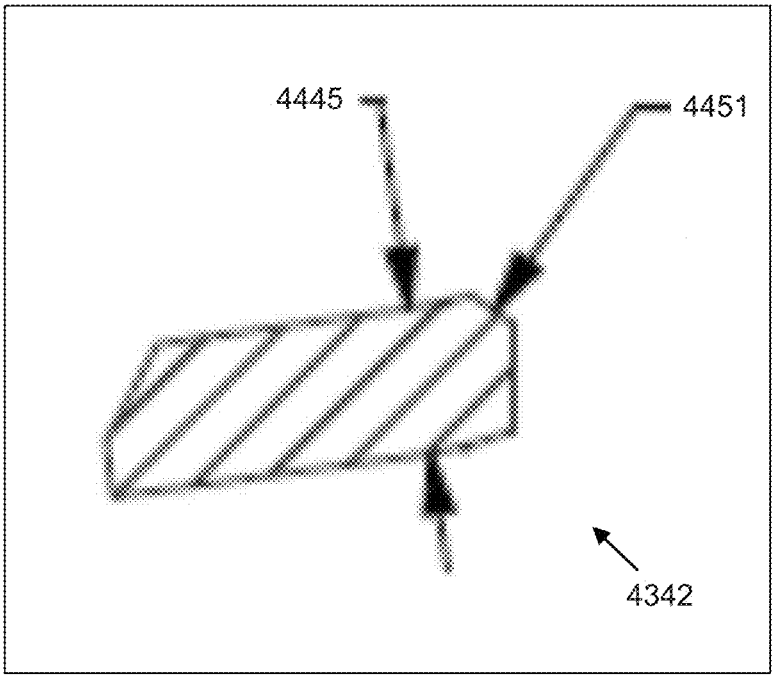
FIG. 44B is a section view of a toe portion of a face insert according to an embodiment.

FIG. 44B is a section view of a toe portion 4342 of a face insert 110. The toe portion 4342 includes a chamfer 4451 on the inside edge of the face insert 110. In some embodiments, the edge thickness 4345 can be between about 3.35 mm and about 4.2 mm, preferably 3.65 mm±0.1 mm, 3.8 mm±0.1 mm, or 3.9 mm±0.1 mm.

Figure 45:
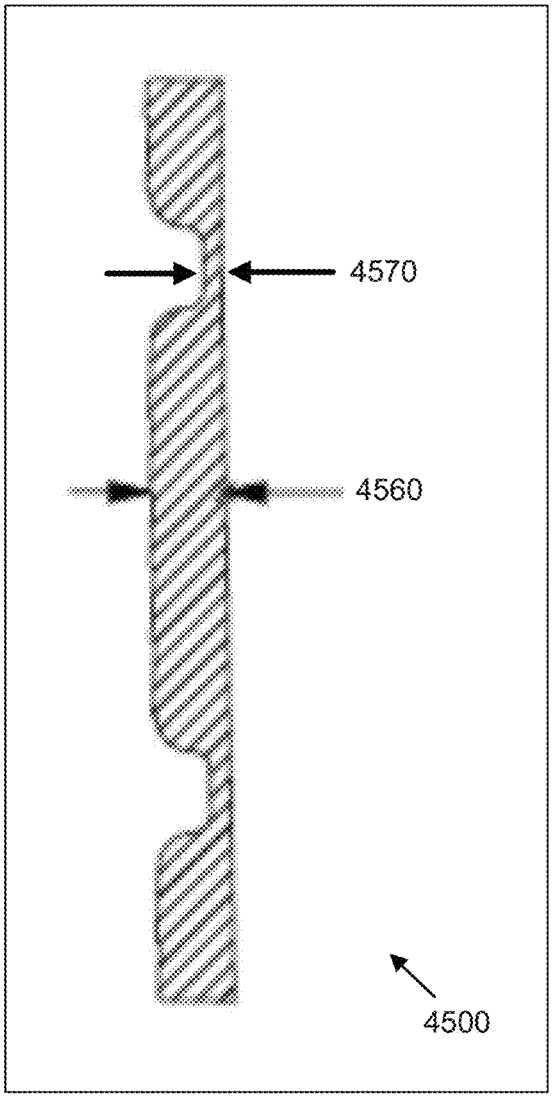
FIG. 45 is a section view of a polymer layer of a face insert according to an embodiment.

FIG. 45 is a section view of a polymer layer 4500 of a face insert 110. The polymer layer 4500 can be provided on the outer surface of the face insert 110 to provide for better performance of the face insert 110, such as in wet conditions. Exemplary polymer layers are described in U.S. patent application Ser. No. 13/330,486 (patented as U.S. Pat. No. 8,979,669), which is incorporated by reference. The polymer layer 4500 may include polyurethane and/or other polymer materials. The polymer layer may have a polymer maximum thickness 4560 between about 0.2 mm and 0.7 mm or about 0.3 mm and about 0.5 mm, preferably 0.40 mm±0.05 mm. The polymer layer may have a polymer minimum thickness 4570 between about 0.05 mm and 0.15 mm, preferably 0.09 mm±0.02 mm. The polymer layer can be configured with alternating maximum thicknesses 4560 and minimum thicknesses 4570 to create score lines on the face insert 100. Further, in some embodiments, teeth and/or another texture may be provided on the thicker areas of the polymer layer 4500 between the score lines.

In some embodiments, a method of assembling a golf club is provided. For example, the method includes providing a golf club head having a face opening with an internal hosel surface intruding into the face opening (e.g., forming a portion of the face opening). The golf club head can also include at least one of a crown opening and/or a sole opening. The method also includes attaching a composite face insert to the golf club body, where the face insert is machined from a composite plaque with a larger area than the finished face insert. For example, the composite face insert includes a machined perimeter chamfer and a machined in notch. The method further includes enclosing the face opening with the face insert, such as by attaching the face insert to the club head. In some embodiments, the internal hosel surface is received by the notch in the face insert. The method also includes enclosing one or more of the crown opening and/or sole opening with a crown insert and/or a sole insert. The method may further include attaching a golf club shaft having a shaft sleeve, and tightening a screw to attach the golf club shaft to the golf club head to form a golf club assembly. In some examples, the golf club head has a face progression less between 10 and 20 mm and a CFY between 9 and 18 mm, preferably less than 16 mm.

In some embodiments, the x-axis of the golf club head is tangential to the face and parallel to a ground plane, negative locations on the x-axis extend from the center face to the toe portion, and positive locations on the x-axis extend from the center face to the heel portion. In these embodiments, a center of gravity of the golf club body with respect to the x-axis ($CG_x$) can be oriented from about 0 mm to about −10 mm.

In some embodiments, a method of counteracting a lateral dispersion tendency of a golf club head is provided. For example, the golf club head can have a face, a crown and a sole together defining an interior cavity, a body of the golf club head including a heel and a toe portion and having x, y and z axes which are orthogonal to each other and have their origin at USGA center face. The method can include providing a primary alignment feature comprising a line delineating a transition between at least a first portion of the crown having an area of contrasting shade or color with a shade or color of the face. The primary alignment feature can be hard tooled into the golf club head with the face of the golf club body, and the golf club head can have a first Sight Adjusted Perceived Face Angle (SAPFA) with respect to the primary alignment feature. The method also includes measuring the lateral dispersion tendency of the golf club head. The lateral dispersion tendency indicates an average dispersion from a center target line, where a positive lateral dispersion tendency is the average dispersion right of the center target line and a negative lateral dispersion tendency is the average dispersion left of the center target line. The method further includes adjusting the primary alignment feature to provide an adjusted primary alignment feature to counteract the lateral dispersion tendency of the golf club head and incorporating the adjusted primary alignment feature into the golf club head. The adjusted primary alignment feature can have a second Sight Adjusted Perceived Face Angle (SAPFA) of from about −2 to about 10 degrees and a second Radius of Curvature (circle fit) of from about 300 to about 1000 mm.

In some embodiments, the method can also include incorporating the adjusted primary alignment feature into the golf club head comprises retooling the golf club head. In some embodiments, adjusting the primary alignment feature counteracts the lateral dispersion tendency of the golf club head by providing for a positive lateral dispersion tendency for the golf club head. In some embodiments, adjusting the primary alignment feature counteracts the lateral dispersion tendency of the golf club head by providing for a negative lateral dispersion tendency for the golf club head. In some embodiments, adjusting the primary alignment feature counteracts the lateral dispersion tendency of the golf club head by reducing average dispersion from the center target line. In some embodiments, the primary alignment feature is hard tooled into the golf club head by bonding the face to the golf club body. In some embodiments, the golf club body is painted prior to bonding the face to the golf club body. In some embodiments, the adjusted primary alignment feature includes: a second Sight Adjusted Perceived Face Angle 25 mm Heelward ($SAPFA_{25H}$) of from about −5 to about 2 degrees; a second Sight Adjusted Perceived Face Angle 25 mm Toeward ($SAPFA_{25T}$) of from 0 to about 9 degrees; and a second Sight Adjusted Perceived Face Angle 50 mm Toeward ($SAPFA_{50T}$) of from about 2 to about 9 degrees.

In addition to the alignment features described herein, the golf club heads of the present invention may also incorporate additional, such features including but not limited to:

1. movable weight features including those described in more detail in U.S. Pat. Nos. 6,773,360, 7,166,040, 7,452,285, 7,628,707, 7,186,190, 7,591,738, 7,963,861, 7,621,823, 7,448,963, 7,568,985, 7,578,753, 7,717,804, 7,717,805, 7,530,904, 7,540,811, 7,407,447, 7,632,194, 7,846,041, 7,419,441, 7,713,142, 7,744,484, 7,223,180, 7,410,425 and 7,410,426, the entire contents of each of which are incorporated by reference in their entirety herein;
2. slidable weight features including those described in more detail in U.S. Pat. Nos. 7,775,905 and 8,444,505, U.S. patent application Ser. No. 13/898,313 filed on May 20, 2013, U.S. patent application Ser. No. 14/047,880 filed on Oct. 7, 2013, the entire contents of each of which are hereby incorporated by reference herein in their entirety;
3. aerodynamic shape features including those described in more detail in U.S. Patent Publication No. 2013/0123040A1, the entire contents of which are incorporated by reference herein in their entirety;
4. removable shaft features including those described in more detail in U.S. Pat. No. 8,303,431, the contents of which are incorporated by reference herein in in their entirety;
5. adjustable loft/lie features including those described in more detail in U.S. Pat. Nos. 8,025,587, 8,235,831, 8,337,319, U.S. Patent Publication No. 2011/0312437A1, U.S. Patent Publication No. 2012/0258818A1, U.S. Patent Publication No. 2012/0122601A1, U.S. Patent Publication No. 2012/0071264A1, U.S. patent application Ser. No. 13/686,677, the entire contents of which are incorporated by reference herein in their entirety; and
6. adjustable sole features including those described in more detail in U.S. Pat. No. 8,337,319, U.S. Patent Publication Nos. US2011/0152000A1, US2011/0312437, US2012/0122601A1, and U.S. patent application Ser. No. 13/686,677, the entire contents of each of which are incorporated by reference herein in their entirety.

The designs, embodiments and features described herein may also be combined with other features and technologies in the club-head including:

1. variable thickness face features described in more detail in U.S. patent application Ser. No. 12/006,060, U.S. Pat. Nos. 6,997,820, 6,800,038, and 6,824,475, which are incorporated herein by reference in their entirety;
2. composite face plate features described in more detail in U.S. patent application Ser. Nos. 11/998,435, 11/642,310, 11/825,138, 11/823,638, 12/004,386, 12/004,387, 11/960,609, 11/960,610 and U.S. Pat. No. 7,267,620, which are herein incorporated by reference in their entirety;

The above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

The invention claimed is:

1. A golf club head comprising:

a body defining an interior cavity of the golf club head and comprising:

a sole positioned at a bottom portion of the golf club head;

a crown positioned at a top portion of the golf club head;

a heel portion;

a toe portion;

a face positioned at a forward portion of the golf club head and including a striking surface having a geometric center, the geometric center of the striking surface defining a golf club head origin, the golf club head origin defining a coordinate plane having multiple orthogonal axes, including:

an origin x-axis extending tangential to the face and generally parallel to a ground plane when the golf club head is at an address position, an origin y-axis extending generally perpendicular to the origin x-axis and generally parallel to the ground plane when the golf club head is at the address position, and an origin z-axis extending generally perpendicular to both the origin x-axis and the origin y-axis; and a primary alignment feature comprising a line delineating a transition between at least a portion of the crown having an area of contrasting shade or color with a shade or color of the face;

wherein the primary alignment feature:

is hard tooled into the golf club head with the face of the body, has a Sight Adjusted Perceived Face Angle (SAPFA) of from about −2 to about 10 degrees relative to an actual face angle of the face of the golf club head, and has a Radius of Curvature (circle fit) of from about 300 to about 1000 mm;

an adjustable shaft connection sleeve; and a rear weight attached below the top portion of the golf club head and proximate a rear portion of the golf club head;

wherein the golf club head:

has a center of gravity (CG) defining a coordinate plane having multiple orthogonal axes, including:

a CGz axis extending through the CG in a generally vertical direction relative to the ground plane when the club head is at the address position, a CGx axis extending through the CG in a heel-to-toe direction generally parallel to the face, generally perpendicular to the CGz axis, and extending in a generally horizontal direction relative to the ground plane when the club head is at the address position, and a CGy axis extending through the CG in a front-to-back direction and generally perpendicular to the CGx axis and the CGz axis, and extending in a generally horizontal direction relative to the ground plane when the club head is at the address position;

has a Zup less than 30 mm;

has a CGy between 20 mm and 50 mm;

has a moment of inertia about the CGz axis ($I_{zz}$) between 400 kg·mm$^2$ and 600 kg·mm$^2$;

has a moment of inertia about the CGx axis ($I_{xx}$) of between 280 kg·mm$^2$ and 420 kg·mm$^2$; and has a center-face y-axis location (CFY) of less than about 18 mm; and further wherein:

at least one of the sole or the crown is at least in part a non-metal material;

the face is at least in part a composite material;

the face is bonded to the body and the body is painted prior to bonding the face to the body; and the body has a volume between about 350 cm$^3$ and about 500 cm$^3$.

2. The golf club head of claim 1, wherein the primary alignment feature is hard tooled into the golf club head at the transition from the face to the crown.

3. The golf club head of claim 1, wherein the face comprises a composite face insert and the body comprises a recessed face opening configured to receive the composite face insert, wherein a portion of an internal hosel surface intrudes into the recessed face opening, wherein the composite face insert comprises a corresponding geometry to receive the internal hosel surface, and wherein the corresponding geometry of the composite face insert comprises a notch proximate to a heel portion of the composite face.

4. The golf club head of claim 3, wherein at least a portion of the crown of the golf club head comprises an electronic display.

5. The golf club head of claim 4, wherein the electronic display comprises a flexible e-ink display.

6. The golf club head of claim 4, further comprising a layer covering at least a portion of the crown of the golf club head and the layer comprises an electronic display.

7. The golf club head of claim 1, wherein at least a portion of the bottom portion of the golf club head is formed of a fiber reinforced composite material.

8. The golf club head of claim 1, wherein:

a rear region of the golf club head proximate the rear portion of the golf club head comprises a low density portion, a medium density portion, and a high density portion, wherein:

the rear region transitions from the low density portion to the medium density portion to the high density portion;

at least a portion of the high density portion is positioned rearward of the medium density portion;

at least a portion of the medium density portion is positioned rearward of the low density portion;

the high density portion has a density between 7 g/cc and 19 g/cc;

the medium density portion has a density between 1 g/cc and 5 g/cc; and the low density portion has a density between 1 g/cc and 2 g/cc.

9. The golf club head of claim 8, wherein the low density portion and the medium density portion are different materials.

10. A golf club head comprising:

a body defining an interior cavity of the golf club head and comprising:

a sole positioned at a bottom portion of the golf club head;

a crown positioned at a top portion of the golf club head;

a heel portion;

a toe portion;

an adjustable shaft connection sleeve;

a face positioned at a forward portion of the golf club head, the face comprising a composite face insert, and including a striking surface having a geometric center, the geometric center of the striking surface defining a golf club head origin, the golf club head origin defining a coordinate plane having multiple orthogonal axes, including:

an origin x-axis extending tangential to the face and generally parallel to a ground plane when the golf club head is at an address position, an origin y-axis extending generally perpendicular to the origin x-axis and generally parallel to the ground plane when the golf club head is at the address position, and an origin z-axis perpendicular to both the origin x-axis and the origin y-axis;

a primary alignment feature comprising a line delineating a transition between at least a portion of the crown having an area of contrasting shade or color with a shade or color of the face, wherein the primary alignment feature is hard tooled into the golf club head with the face of the body; and a recessed face opening configured to receive the composite face insert;

wherein the golf club head:

has a center of gravity (CG) defining a coordinate plane having multiple orthogonal axes, including:

a CGz axis extending through the CG in a generally vertical direction relative to the ground plane when the club head is at the address position, a CGx axis extending through the CG in a heel-to-toe direction generally parallel to the face, generally perpendicular to the CGz axis, and extending in a generally horizontal direction relative to the ground plane when the club head is at the address position, and a CGy axis extending through the CG in a front-to-back direction and generally perpendicular to the CGx axis and the CGz axis, and extending in a generally horizontal direction relative to the ground plane when the club head is at the address position;

has a moment of inertia about the CGz axis ($I_{zz}$) between 400 kg·mm$^2$ and 600 kg·mm$^2$; and has a moment of inertia about the CGx axis ($I_{xx}$) of between 280 kg·mm$^2$ and 420 kg·mm$^2$; and wherein:

a portion of an internal hosel surface intrudes into the recessed face opening;

the composite face insert comprises a corresponding geometry to receive the internal hosel surface;

the corresponding geometry of the composite face insert comprises a thinned portion proximate to a heel portion of the composite face; and the body has a volume between about 370 cm$^3$ and about 500 cm$^3$.

11. A golf club head comprising:

a body defining an interior cavity of the golf club head and comprising:

a sole positioned at a bottom portion of the golf club head;

a crown positioned at a top portion of the golf club head;

a heel portion;

a toe portion;

a face positioned at a forward portion of the golf club head and including a striking surface having a geometric center, the geometric center of the striking surface defining a golf club head origin, the golf club head origin defining a coordinate plane having multiple orthogonal axes, including:

an origin x-axis extending tangential to the face and generally parallel to a ground plane when the golf club head is at an address position, an origin y-axis extending generally perpendicular to the origin x-axis and generally parallel to the ground plane when the golf club head is at the address position, and an origin z-axis perpendicular to both the origin x-axis and the origin y-axis; and a primary alignment feature comprising a line delineating a transition between at least a portion of the crown and at least a portion of the face;

a hosel; and an adjustable shaft connection sleeve;

wherein:

the face and the crown are at least in part formed of a composite material;

the body has:

a volume between about 370 cm$^3$ and about 500 cm$^3$, a body height defined from a bottom-most portion of the body to a top-most portion of the crown of no less than 48 mm, and a body length defined from a leading edge of the body to a rearward-most portion of the golf club head of no less than 98 mm; and the golf club head has:

a center of gravity (CG) defining a coordinate plane having multiple orthogonal axes, including:

a CGz axis extending through the CG in a generally vertical direction relative to the ground plane when the club head is at the address position, a CGx axis extending through the CG in a heel-to-toe direction generally parallel to the face, generally perpendicular to the CGz axis, and extending in a generally horizontal direction relative to the ground plane when the club head is at the address position, and a CGy axis extending through the CG in a front-to-back direction and generally perpendicular to the CGx axis and the CGz axis, and extending in a generally horizontal direction relative to the ground plane when the club head is at the address position;

a moment of inertia about the CGz axis ($I_{zz}$) between 400 kg·mm$^2$ and 600 kg·mm$^2$;

a moment of inertia about the CGx axis ($I_{xx}$) of between 280 kg·mm$^2$ and 420 kg·mm$^2$;

a center face y-axis location (CFY) measured along the origin y-axis from a center point of the hosel to the geometric center of the striking surface, wherein the CFY is no more than 18 mm;

a face progression (FP) of a leading edge of the face measured along the origin y-axis from the center point of the hosel to the leading edge of the face, wherein the FP is no more than 20 mm; and a loft no more than 16 degrees.

12. The golf club head of claim 11, wherein the line delineating the transition between at least the portion of the crown and at least the portion of the face is on the face.

13. The golf club head of claim 11, wherein a portion of the hosel of the golf club head extends into a notch of the face.

14. The golf club head of claim 13, wherein at least a portion of the crown of the golf club head comprises a flexible electronic display.

15. The golf club head of claim 14, wherein the flexible electronic display comprises an e-ink display.

16. The golf club head of claim 14, further comprising a layer covering at least a portion of the crown of the golf club head and the layer comprises an electronic display.

17. The golf club head of claim 11, wherein:

the face comprises a composite face insert and the body comprises a recessed face opening configured to receive the composite face insert;

a portion of an internal hosel surface intrudes into the recessed face opening;

the composite face insert comprises a corresponding geometry to receive the internal hosel surface; and the corresponding geometry of the composite face insert comprises a notch proximate to a heel portion of the composite face.

18. The golf club head of claim 17, wherein:

the composite face insert has:

a face insert width of 40-65 mm, a face insert length of 80-120 mm, a peak face thickness of at least 3.8 mm, and an insert perimeter having a perimeter thickness, wherein the perimeter thickness adjacent the notch is a notch edge thickness that is no more than 2.1 mm.

19. The golf club head of claim 18, wherein:
the volume is at least 430 $cm^3$,
the body height is at least 53 mm,
the body length is at least 103 mm,
the CFY is 11-16 mm,
the face has a peak face thickness of at least 3.8 mm,
the face progression (FP) is at least 10 mm, and
the moment of inertia about the CGz axis ($I_{zz}$) is at least 480 kg·$mm^2$.

20. The golf club head of claim 19, wherein:
the CFY is no more than 15 mm,
the face progression (FP) is less than 19 mm,
the moment of inertia about the CGz axis ($I_{zz}$) is at least 490 kg·$mm^2$, and
the moment of inertia about the CGx axis ($I_{xx}$) is at least 300 kg·$mm^2$.

21. The golf club head of claim 20, wherein:
the CFY is no more than 14.5 mm,
the face progression (FP) is less than 18 mm, and
a portion of the recessed face opening is formed of aluminum alloy.

22. The golf club head of claim 21, wherein:
the CFY is no more than 14 mm,
the face progression (FP) is less than 17 mm, and
a projected CG location on the striking surface is less than 2 mm above the geometric center of the striking surface.

23. The golf club head of claim 22, wherein:
the projected CG location on the striking surface is less than 1 mm above the geometric center of the striking surface,
a portion of the recessed face opening is formed in an upper face insert support structure that includes an upper rear support member formed of aluminum alloy,
the face insert width is 45-60 mm, and
the face insert length is 90-110 mm.

24. The golf club head of claim 23, wherein a skirt height (S1) measured at the rearward-most portion of the golf club head is 25-40 mm.

25. The golf club head of claim 11, wherein the primary alignment feature is hard tooled into the golf club head at the transition from the face to the crown.

26. The golf club head of claim 11, wherein the golf club head has a Zup less than 30 mm, a CGy between 20 mm and 50 mm, and a rear weight attached below the top portion of the golf club head and proximate a rear portion of the golf club head.

27. The golf club head of claim 11, wherein the golf club head has a Zup less than 30 mm, a CGy between 20 mm and 50 mm, and at least a portion of the bottom portion of the golf club head is formed of a fiber reinforced composite material.

28. The golf club head of claim 11, wherein:
the golf club head has a Zup less than 30 mm and a CGy between 20 mm and 50 mm; and
a rear region of the golf club head proximate a rear portion of the golf club head comprises a low density portion, a medium density portion, and a high density portion, wherein:
the rear region transitions from the low density portion to the medium density portion to the high density portion;
at least a portion of the high density portion is positioned rearward of the medium density portion;
at least a portion of the medium density portion is positioned rearward of the low density portion;
the high density portion has a density between 7 g/cc and 19 g/cc;
the medium density portion has a density between 1 g/cc and 5 g/cc; and
the low density portion has a density between 1 g/cc and 2 g/cc.

29. The golf club head of claim 28, wherein the low density portion and the medium density portion are different materials.

30. The golf club head of claim 29, wherein the low density portion extends from a first location proximate the rear portion of the golf club head to a second location proximate the forward portion of the golf club head.

31. The golf club head of claim 30, wherein the low density portion extends forward of a peak crown height as measured along the origin y-axis.

32. The golf club head of claim 31, wherein:
the high density portion is positioned entirely below a skirt height (S1) measured at the rearward-most portion of the golf club head, and
at least a portion of the low density portion extends above the skirt height (S1).

33. The golf club head of claim 11, wherein:
the volume is at least 430 $cm^3$,
the body height is at least 53 mm,
the body length is at least 103 mm,
the CFY is 11-16 mm,
the face has a peak face thickness of at least 3.8 mm,
the face progression (FP) is at least 10 mm, and
the moment of inertia about the CGz axis ($I_{zz}$) is at least 480 kg·$mm^2$.

34. The golf club head of claim 33, wherein:
the CFY is no more than 15 mm,
the face progression (FP) is less than 19 mm,
the moment of inertia about the CGz axis ($I_{zz}$) is at least 490 kg·$mm^2$, and
the moment of inertia about the CGx axis ($I_{xx}$) is at least 300 kg·$mm^2$.

35. The golf club head of claim 34, wherein:
the CFY is no more than 14.5 mm,
the face progression (FP) is less than 18 mm, and
the face is attached to a front portion of the body that is formed of aluminum alloy.

36. The golf club head of claim 35, wherein:
the CFY is no more than 14 mm,
the face progression (FP) is less than 17 mm, and
a projected CG location on the striking surface is less than 2 mm above the geometric center of the striking surface.

37. The golf club head of claim 36, wherein the projected CG location on the striking surface is less than 1 mm above the geometric center of the striking surface.

38. The golf club head of claim 37, wherein:
a skirt height (S1) measured at the rearward-most portion of the golf club head is 25-40 mm, and
a portion of the hosel of the golf club head extends into a notch of the face.

39. The golf club head of claim 11, further including a sensor integrated into the golf club head and capable of interacting with an external device.

40. The golf club head of claim 39, wherein the external device is a launch monitor.

* * * * *